US008538765B1

(12) United States Patent
Ehara

(10) Patent No.: US 8,538,765 B1
(45) Date of Patent: Sep. 17, 2013

(54) PARAMETER DECODING APPARATUS AND PARAMETER DECODING METHOD

(71) Applicant: Panasonic Corporation, Kadoma (JP)

(72) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/896,397

(22) Filed: May 17, 2013

Related U.S. Application Data

(63) Continuation of application No. 12/514,094, filed as application No. PCT/JP2007/071803 on Nov. 9, 2007, now Pat. No. 8,468,015.

(30) Foreign Application Priority Data

| | | |
|---|---|---|
| Nov. 10, 2006 | (JP) | 2006-305861 |
| May 17, 2007 | (JP) | 2007-132195 |
| Sep. 14, 2007 | (JP) | 2007-240198 |

(51) Int. Cl.
*G10L 19/00* (2013.01)

(52) U.S. Cl.
USPC ..... 704/500; 704/230; 704/223; 704/220; 704/219; 704/208; 704/207; 704/205; 704/201; 375/240.08; 345/418

(58) Field of Classification Search
USPC ..... 704/201, 207, 223, 230, 220, 219, 704/208, 205; 375/240.08; 345/418
See application file for complete search history.

(56) References Cited

U.S. PATENT DOCUMENTS

| | | | | |
|---|---|---|---|---|
| 5,664,055 | A * | 9/1997 | Kroon | 704/223 |
| 5,699,485 | A | 12/1997 | Shoham | |
| 5,732,389 | A | 3/1998 | Kroon et al. | |
| 5,781,880 | A * | 7/1998 | Su | 704/207 |
| 6,104,992 | A * | 8/2000 | Gao et al. | 704/220 |
| 6,188,980 | B1 * | 2/2001 | Thyssen | 704/230 |
| 6,330,533 | B2 * | 12/2001 | Su et al. | 704/220 |
| 6,456,964 | B2 * | 9/2002 | Manjunath et al. | 704/205 |
| 6,463,407 | B2 * | 10/2002 | Das et al. | 704/208 |
| 6,470,309 | B1 * | 10/2002 | McCree | 704/207 |
| 6,470,313 | B1 | 10/2002 | Ojala | |

(Continued)

FOREIGN PATENT DOCUMENTS

| | | |
|---|---|---|
| JP | 2-216200 | 8/1990 |
| JP | 5-113798 | 5/1993 |

(Continued)

OTHER PUBLICATIONS

Extended European Search Report dated Apr. 15, 2011.

(Continued)

*Primary Examiner* — Michael Colucci
(74) *Attorney, Agent, or Firm* — Greenblum & Bernstein, P.L.C.

(57) ABSTRACT

A parameter decoding apparatus includes a prediction residue decoder that finds a quantized prediction residue based on encoded information included in a current frame subject to decoding and an auto-regressive predictor produces a predicted parameter by multiplying a predictive coefficient with a past decoded parameter. An adder decodes a parameter by adding the quantized prediction residue and the predicted parameter, wherein the prediction residue decoder, when the current frame is erased, finds a current-frame quantized prediction residue from a weighted linear sum of a parameter decoded in the past and a future-frame quantized prediction residue.

4 Claims, 24 Drawing Sheets

(56) References Cited

U.S. PATENT DOCUMENTS

| | | | | |
|---|---|---|---|---|
| 6,775,649 | B1 * | 8/2004 | DeMartin | 704/201 |
| 6,963,833 | B1 * | 11/2005 | Singhal | 704/207 |
| 7,587,315 | B2 * | 9/2009 | Unno | 704/223 |
| 2002/0091523 | A1 | 7/2002 | Maekinen et al. | |
| 2002/0123887 | A1 * | 9/2002 | Unno | 704/220 |
| 2006/0133482 | A1 * | 6/2006 | Park et al. | 375/240.08 |
| 2006/0133485 | A1 * | 6/2006 | Park et al. | 375/240.08 |
| 2006/0146046 | A1 * | 7/2006 | Longhurst et al. | 345/418 |
| 2007/0299669 | A1 | 12/2007 | Ehara | |
| 2008/0052066 | A1 | 2/2008 | Oshikiri et al. | |
| 2008/0249767 | A1 * | 10/2008 | Ertan | 704/219 |

FOREIGN PATENT DOCUMENTS

| | | |
|---|---|---|
| JP | 6-130999 | 5/1994 |
| JP | 6-175695 | 6/1994 |
| JP | 9-120297 | 5/1997 |
| JP | 2002-507011 | 3/2002 |
| JP | 2002-328700 | 11/2002 |

OTHER PUBLICATIONS

ITU-T Recommendation G.729, "General Aspects of Digital Transmission Systems, Coding of Speech at 8 kbit/s Using Conjugate-Structure Algebraic-Code-Excited Linear-Prediction (CS-ACELP)," Mar. 1996, pp. 30-32.

3GPP TS 26.091, V5.0.0, Jun. 2002, Technical Specification, "3rd Generation Partnership Project; Techical Specification Group Services and System Aspects; Mandatory Speech Codec speech processing functions; Adaptive Multi-Rate (AMR) speech codec; Error concealment of lose frames (Release 5)," pp. 8-9.

* cited by examiner

PARAMETER DECODING APPARATUS AND PARAMETER DECODING METHOD

CROSS-REFERENCE TO RELATED APPLICATIONS

This application is a continuation of U.S. patent application Ser. No. 12/514,094, filed on May 8, 2009, which is a National Stage of International Patent Application No. PCT/JP2007/071803, filed Nov. 9, 2007, which claims priority to Japanese Application Nos. 2006-305861, filed on Nov. 10, 2006; 2007-132195, filed on May 17, 2007 and 2007-240198, filed on Sep. 14, 2007, the disclosures of which are expressly incorporated by reference herein in their entireties.

TECHNICAL FIELD

The present invention relates to a parameter encoding apparatus that encodes a parameter using a predictor, and a parameter decoding apparatus and parameter decoding method that decode an encoded parameter.

BACKGROUND ART

With an ITU-T Recommendation G.729, 3GPP AMR, or suchlike speech codec, some of the parameters obtained by analyzing a speech signal are quantized by means of a predictive quantization method based on a Moving Average (MA) prediction model (Patent Document 1, Non-patent Document 1, Non-patent Document 2). An MA-type predictive quantizer is a model that predicts a current parameter subject to quantization from the linear sum of past quantized prediction residues, and with a Code Excited Linear Prediction (CELP) type speech codec, is used for Line Spectral Frequency (LSF) parameter and energy parameter prediction.

With an MA-type predictive quantizer, since prediction is performed from the weighted linear sum of quantized prediction residues in a finite number of past frames, even if there is a transmission path error in quantized information, its effect is limited to a finite number of frames. On the other hand, with an Auto Regressive (AR) type of predictive quantizer that uses past decoded parameters recursively, although high prediction gain and quantization performance can generally be obtained, the effect of the error extends over a long period. Consequently, an MA-type predictive parameter quantizer can achieve higher error robustness than an AR-type predictive parameter quantizer, and is used in particular in a speech codec for mobile communication.

Parameter concealment methods to be used when a frame is lost (erased) on the decoding side have been studied for some time. Generally, concealment is performed using a parameter of a frame before an erased frame instead of a parameter of the erased frame. However, in the case of an LSF parameter, parameters prior to an erased frame are gradually modified by gradually approaching an average LSF, or performing gradual attenuation in the case of an energy parameter.

This method is normally also used in a quantizer using an MA-type predictor. In the case of an LSF parameter, processing is performed to update the state of the MA-type predictor by generating a quantized prediction residue so that a parameter generated in a concealed frame is decoded (Non-patent Document 1), and in the case of an energy parameter, processing is performed to update the state of the MA-type predictor using the result of attenuating an average of past quantized prediction residues by a fixed percentage (Patent Document 2, Non-patent Document 1).

There is also a method whereby a parameter of an erased frame is interpolated after obtaining information of a recovered frame (normal frame) that follows the erased frame. For example, in Patent Document 3, a method is proposed whereby pitch gain interpolation is performed, and adaptive codebook contents are regenerated.

Patent Document 1: Japanese Patent Application Laid-Open No. HEI 6-175695

Patent Document 2: Japanese Patent Application Laid-Open No. HEI 9-120297

Patent Document 3: Japanese Patent Application Laid-Open No. 2002-328700

Non-patent Document 1: ITU-T Recommendation G.729

Non-patent Document 2: 3GPP TS 26.091

DISCLOSURE OF INVENTION

Problems to be Solved by the Invention

A method whereby an erased frame parameter is interpolated is used when predictive quantization is not performed, but when predictive quantization is performed, even if encoding information is received correctly in the frame immediately after an erased frame, a predictor is affected by an error in the immediately preceding frame and cannot obtain a correct decoded result, and therefore this method is not generally used.

Thus, with a parameter quantizing apparatus that uses a conventional MA-type predictor, erased frame parameter concealment processing is not performed by means of an interpolative method, and therefore, for example, loss of sound may occur due to excessive attenuation for an energy parameter, causing degradation of subjective quality.

When predictive quantization is performed, a possible method is to decode a parameter simply by interpolating quantized predict ion residues decoded, but whereas a de coded parameter fluctuates moderately between frames through weighted moving averaging even if a quantized prediction residue decoded fluctuates greatly, with this method, the decoded parameter also fluctuates in line with the fluctuation of the quantized prediction residue decoded, so that when the fluctuation of the quantized prediction residue decoded is large, degradation of subjective quality is increased.

The present invention has been implemented taking into account the problems described above, and it is an object of the present invention to provide a parameter decoding apparatus, parameter encoding apparatus, and parameter decoding method that enable parameter concealment processing to be performed so as to suppress degradation of subjective quality when predictive quantization is performed.

Means for Solving the Problems

A parameter decoding apparatus of the present invention employs a configuration having a prediction residue decoding section that finds a quantized prediction residue based on encoded information included in a current frame subject to decoding, and a parameter decoding section that decodes a parameter based on the quantized prediction residue; wherein the prediction residue decoding section, when the current frame is erased, finds a current-frame quantized prediction residue from a weighted linear sum of a parameter decoded in the past and a quantized prediction residue of a future frame.

A parameter encoding apparatus of the present invention employs a configuration having: an analysis section that analyzes an input signal and finds an analysis parameter; an encoding section that predicts the analysis parameter using a predictive coefficient, and obtains a quantized parameter using a quantized prediction residue obtained by quantizing a prediction residue and the predictive coefficient; a preceding-frame concealment section that stores a plurality of sets of weighting coefficients, finds a weighted sum using the weighting coefficient sets for the quantized prediction residue of a current frame, the quantized prediction residue of two frames back, and the quantized parameter of two frames back, and finds a plurality of the quantized parameters of one frame back using the weighted sum; and a determination section that compares a plurality of the quantized parameters of the one frame back found by the preceding-frame concealment section and the analysis parameter found by the analysis section one frame back, selects one of the quantized parameters of the one frame back, and selects and encodes a weighting coefficient set corresponding to the selected quantized parameter of the one frame back.

A parameter decoding method of the present invention employs a method having a prediction residue decoding step of finding a quantized prediction residue based on encoded information included in a current frame subject to decoding, and a parameter decoding step of decoding a parameter based on the quantized prediction residue; wherein, in the prediction residue decoding step, when the current frame is erased, a current-frame quantized prediction residue is found from a weighted linear sum of a parameter decoded in the past and a future-frame quantized prediction residue.

Advantageous Effect of the Invention

According to the present invention, when a current frame is erased when predictive quantization is not performed, parameter concealment processing can be performed so as to suppress degradation of subjective quality by finding a current-frame quantized prediction residue from a weighted linear sum of past-frame quantized prediction residues and future frame quantized prediction residues.

BEST MODE FOR CARRYING OUT THE INVENTION

Embodiments of the present invention will now be described in detail with reference to the accompanying drawings. In the following embodiments, cases are described by way of example in which a parameter decoding apparatus and parameter encoding apparatus of the present invention are applied to a CELP-type speech decoding apparatus and speech encoding apparatus respectively.

Embodiment 1

Figure 1:
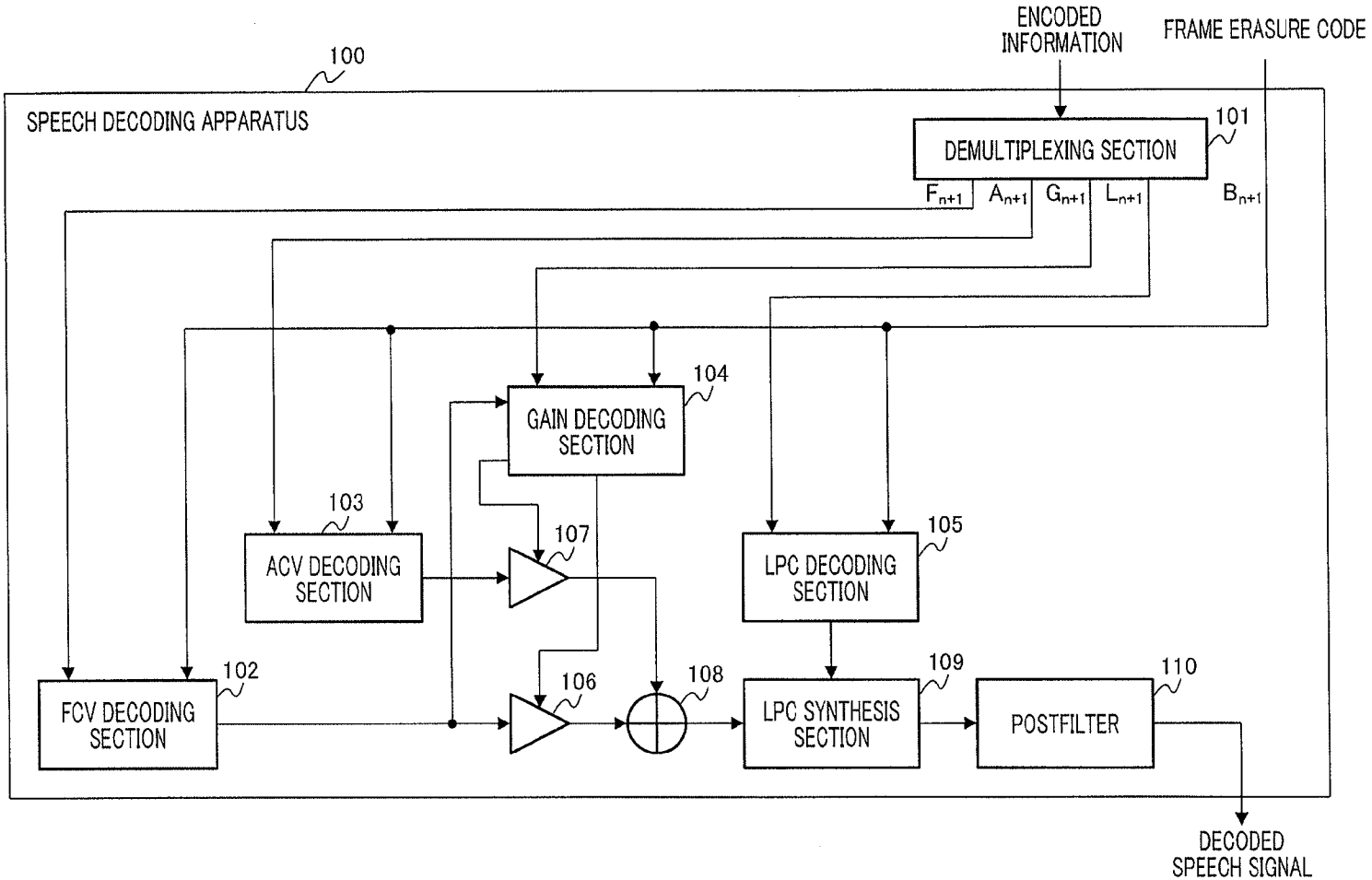
FIG. 1 is a block diagram showing the main configuration of a speech decoding apparatus according to Embodiment 1 of the present invention.

FIG. 1 is a block diagram showing the main configuration of a speech decoding apparatus according to Embodiment 1 of the present invention. In speech decoding apparatus 100 shown in FIG. 1, encoded information transmitted from an encoding apparatus (not shown) is separated into fixed codebook code $F_{n+1}$, adaptive codebook code $A_{n+1}$, gain code $G_{n+1}$, and LPC (Linear Predictive Coefficients) code $L_{n+1}$, by demultiplexing section 101. Separately, frame erasure code $B_{n+1}$ is input to speech decoding apparatus 100. Here, subscript n of each code indicates the number of a frame subject to decoding. That is to say, encoding information in the (n+1)'th frame (hereinafter referred to as "next frame") after the nth frame subject to decoding (hereinafter referred to as "current frame") is separated.

Fixed codebook code $F_{n+1}$ is input to Fixed Codebook Vector (FCV) decoding section 102, adaptive codebook code $A_{n+1}$ to Adaptive Codebook Vector (ACV) decoding section 103, gain code $G_{n+1}$ to gain decoding section 104, and LPC code $L_{n+1}$ to LPC decoding section 105. Frame erasure code $B_{n+1}$ is input to FCV decoding section 102, ACV decoding section 103, gain decoding section 104, and LPC decoding section 105.

FCV decoding section 102 generates a fixed codebook vector using fixed codebook code $F_n$ if frame erasure code $B_n$ indicates that "the n'th frame is a normal frame", and generates a fixed codebook vector by means of frame erasure concealment processing if frame erasure code $B_n$ indicates that "the n'th frame is an erased frame". A generated fixed codebook vector is input to gain decoding section 109 and amplifier 106.

ACV decoding section 103 generates an adaptive codebook vector using adaptive codebook code $A_n$ if frame erasure code $B_n$ indicates that "the n'th frame is a normal frame", and generates an adaptive codebook vector by means of frame erasure concealment processing if frame erasure code $B_n$ indicates that "the n'th frame is an erased frame". A generated adaptive codebook vector is input to amplifier 107.

Gain decoding section 104 generates fixed codebook gain and adaptive codebook gain using gain code $G_n$ and a fixed codebook vector if frame erasure code $B_n$ indicates that "the n'th frame is a normal frame", and generates fixed codebook gain and adaptive codebook gain by means of frame erasure concealment processing if frame erasure code $B_n$ indicates that "the n'th frame is an erased frame". Generated fixed codebook gain is input to amplifier 106, and generated adaptive codebook gain is input to amplifier 107.

LPC decoding section 105 decodes an LPC parameter using LPC code $L_n$ if frame erasure code $B_n$ indicates that "the n'th frame is a normal frame", and decodes an LPC parameter by means of frame erasure concealment processing if frame erasure code $B_n$ indicates that "the n'th frame is an erased frame". A decoded LPC parameter is input to LPC synthesis section 109. Details of LPC decoding section 105 will be given later herein.

Amplifier 106 multiplies fixed codebook gain output from gain decoding section 104 by a fixed codebook vector output from FCV decoding section 102, and outputs the multiplication result to adder 108. Amplifier 107 multiplies adaptive codebook gain output from gain decoding section 104 by an adaptive codebook vector output from ACV decoding section 103, and outputs the multiplication result to adder 108. Adder 108 adds together a fixed codebook vector after fixed codebook gain multiplication output from amplifier 106 and an adaptive codebook vector after adaptive codebook gain multiplication output from amplifier 107, and outputs the addition result (hereinafter referred to as "sum vector") to LPC synthesis section 109.

LPC synthesis section 109 configures linear predictive synthesis filter using a decoded LPC parameter output from LPC decoding section 105, drives the linear predictive synthesis filter with the sum vector output from adder 108 as an excitation signal, and outputs a synthesized signal obtained as a result of the drive to postfilter 110. Postfilter 110 performs formant emphasis and pitch emphasis processing and so forth on the synthesized signal output from LPC synthesis section 109, and outputs the signal as a decoded speech signal.

Figure 2:
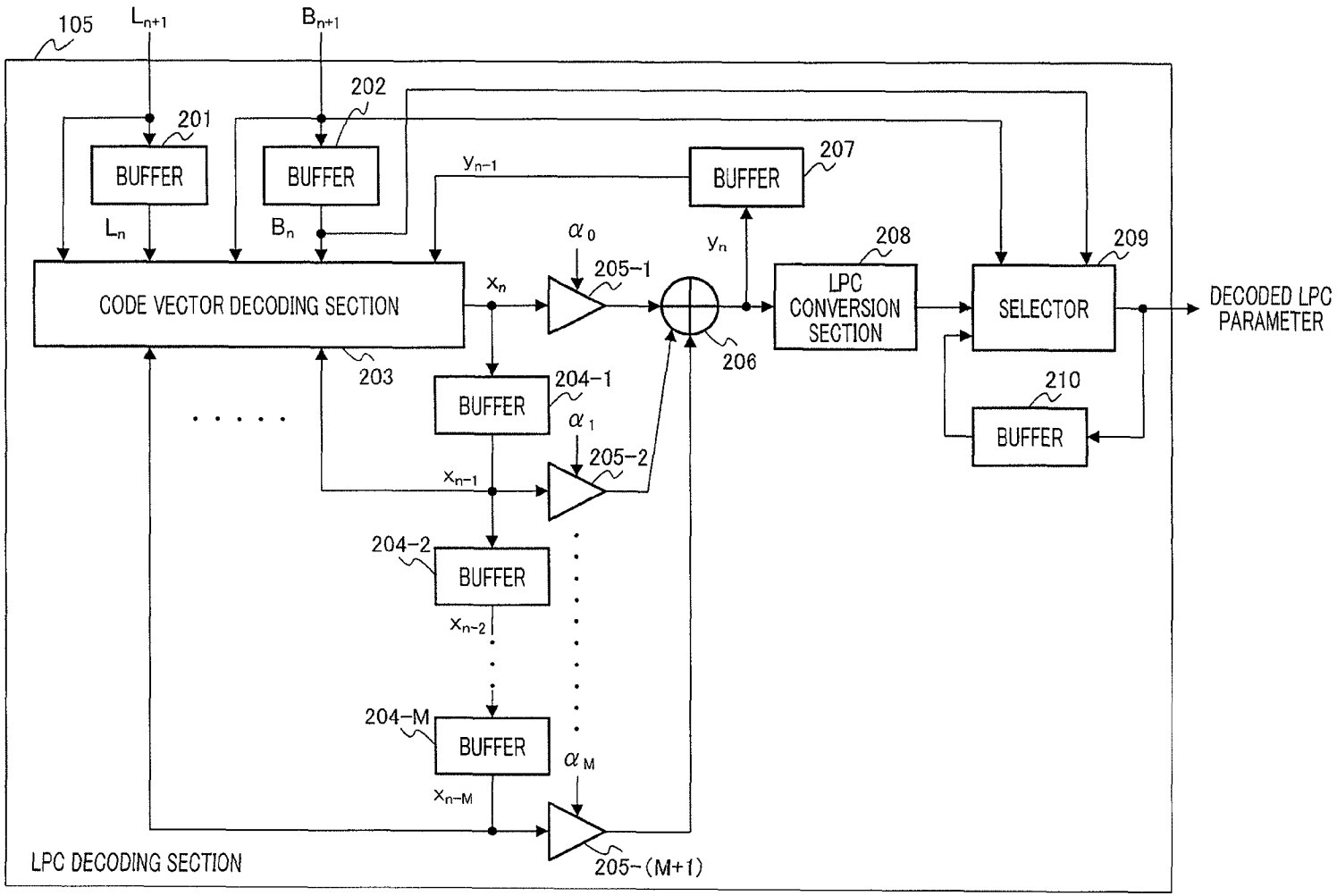
FIG. 2 is a drawing showing the internal configuration of an LPC decoding section of a speech decoding apparatus according to Embodiment 1 of the present invention.

Next, details of parameter concealment processing according to this embodiment will be described in detail, taking a case in which LPC parameter concealment is performed as an example. FIG. 2 is a drawing showing the internal configuration of an LPC decoding section of LPC decoding section 105 in FIG. 1.

LPC code $L_{n+1}$ is input to buffer 201 and code vector decoding section 203, and frame erasure code $B_{n+1}$ is input to buffer 202, code vector decoding section 203, and selector 209.

Buffer 201 holds next-frame LPC code $L_{n+1}$ for the duration of one frame, and then outputs this LPC code to code vector decoding section 203. As a result of being held in buffer 201 for the duration of one frame, the LPC code output from buffer 201 to code vector decoding section 203 is current-frame LPC code $L_n$.

Buffer 202 holds next-frame frame erasure code $B_{n+1}$ for the duration of one frame, and then outputs this frame erasure code to code vector decoding section 203. As a result of being held in buffer 202 for the duration of one frame, the frame erasure code output from buffer 202 to code vector decoding section 203 is current-frame frame erasure code $B_n$.

Code vector decoding section 203 has quantized prediction residual vectors $x_{n-1}$ through $x_{n-M}$ of the past M frames, decoded LSF vector $y_{n-1}$ of one frame before, next-frame LPC code $L_{n+1}$, next-frame frame erasure code $B_{n+1}$, current-frame LPC code $L_n$, and current-frame frame erasure code $B_n$, as input, generates current-frame quantized prediction residual vector $x_n$ based on these items of information, and outputs current-frame quantized prediction residual vector $x_n$ to buffer 204-1 and amplifier 205-1. Details of code vector decoding section 203 will be given later herein.

Buffer 204-1 holds current-frame quantized prediction residual vector $x_n$ for the duration of one frame, and then outputs this quantized prediction residual vector to code vector decoding section 203, buffer 204-2, and amplifier 205-2. As a result of being held in buffer 204-1 for the duration of one frame, the quantized prediction residual vector input to code vector decoding section 203, buffer 204-2, and amplifier 205-2 is quantized prediction residual vector $x_{n-1}$ of one frame before. Similarly, buffers **204-*i* (where i is 2 through M−1) each hold quantized prediction residual vector $x_{n-j+1}$ for the duration of one frame, and then output this quantized prediction residual vector to code vector decoding section 203, buffer 204-(*i*+1), and amplifier 205-(*i*+1). Buffer 204-M holds quantized prediction residual vector $x_{n-M+1}$ for the duration of one frame, and then outputs this quantized prediction residual vector to code vector decoding section 203 and amplifier 205-(M+1)**.

Amplifier 205-1 multiplies quantized prediction residual vector $x_n$ by predetermined MA predictive coefficient $\alpha_0$, and outputs the result to adder 206. Similarly, amplifiers **205-*j* (where j is 2 through M+1) multiply quantized prediction residual vector $x_{n-j+1}$ by predetermined MA predictive coefficient $\alpha_{j-1}$, and output the result to adder 206. The MA predictive coefficient set may be fixed values of one kind, but in ITU-T Recommendation G.729 two kinds of sets are provided, which set is used for performing decoding is decided on the encoder side, and the set is encoded and transmitted as a part of LPC code $L_n$ information. In this case, a configuration is employed whereby LPC decoding section 105 is provided with an MA predictive coefficient set as a table, and a set specified on the encoder side is used as $\alpha_0$ through $\alpha_M$ in FIG. 2**.

Adder 206 calculates the sum total of quantized prediction residual vectors after MA predictive coefficient multiplication output from amplifiers 205-1 through 205-(M+1), and outputs the calculation result, decoded LSF vector $y_n$, to buffer 207 and LPC conversion section 208.

Buffer 207 holds decoded LSF vector $y_n$ for the duration of one frame, and then outputs this decoded LSF vector to code vector decoding section 203. As a result, the decoded LSF vector output from buffer 207 to code vector decoding section 203 is decoded LSF vector $y_{n-1}$ of one frame before.

LPC conversion section 208 converts decoded LSF vector $y_n$ to a set of linear prediction coefficients (decoded LPC parameter), and outputs this to selector 209.

Selector 209 selects a decoded LPC parameter output from LPC conversion section 208 or a decoded LPC parameter in the preceding frame output from buffer 210 based on current-frame frame erasure code $B_n$ and next-frame frame erasure code $B_{n+1}$. Specifically, a decoded LPC parameter output from LPC conversion section 208 is selected if current-frame frame erasure code $B_n$ indicates that "the n'th frame is a normal frame" or next-frame frame erasure code $B_{n+1}$ indicates that "the (n+1)'th frame is a normal frame", and a decoded LPC parameter in the next frame output from buffer 210 is selected if current-frame frame erasure code $B_n$ indicates that "the n'th frame is an erased frame" and next-frame frame erasure code $B_{n+1}$ indicates that "the (n+1)'th frame is an erased frame". Then selector 209 outputs the selection result to LPC synthesis section 109 and buffer 210 as a final decoded LPC parameter. If selector 209 selects a decoded LPC parameter in the next frame output from buffer 210, it is not actually necessary to perform all the processing from code vector decoding section 203 through LPC conversion section 208, and only processing to update the contents of buffers 204-1 through 204-M need be performed.

Buffer 210 holds a decoded LPC parameter output from selector 209 for the duration of one frame, and then outputs this decoded LPC parameter to selector 209. As a result, the decoded LPC parameter output from buffer 210 to selector 209 is a decoded LPC parameter of one frame before.

Figure 3:
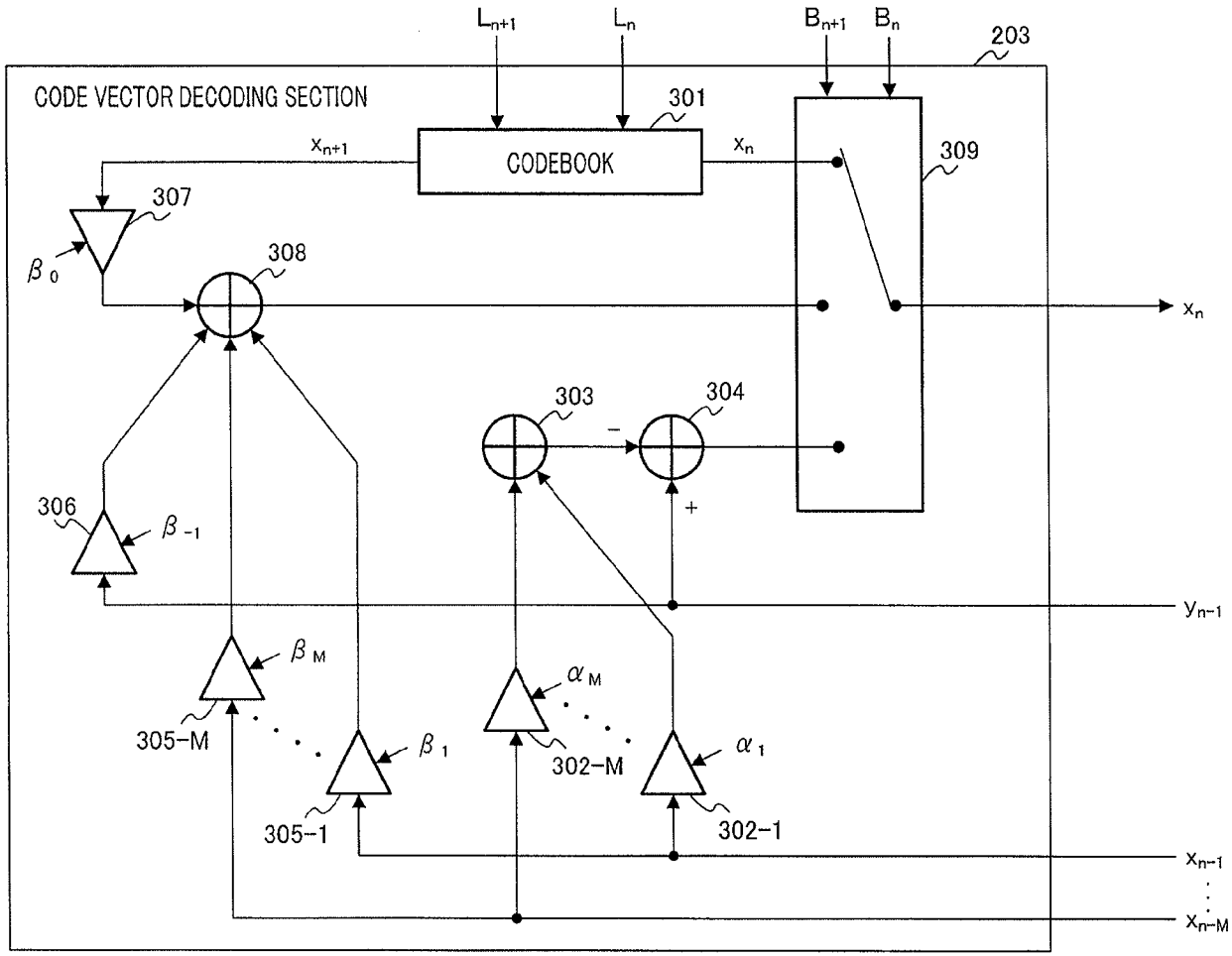
FIG. 3 is a drawing showing the internal configuration of the code vector decoding section in FIG. 2.

Next, the internal configuration of code vector decoding section 203 in FIG. 2 will be described in detail using the block diagram in FIG. 3.

Codebook 301 generates a code vector identified by current-frame LPC code $L_n$ and outputs this to switch 309, and also generates a code vector identified by next-frame LPC code $L_{n+1}$ and outputs this to amplifier 307. As already stated, in ITU-T Recommendation G.729 information that specifies an MA predictive coefficient set is included in LPC code $L_n$, and in this case LPC code $L_n$ is also used for MA predictive coefficient decoding in addition to code vector decoding, but a description of this is omitted here. Also, a codebook may have a multi-stage configuration and may have a split configuration. For example, in ITU-T Recommendation G.729, the codebook configuration is a two-stage configuration with the second stage split into two. A vector output from a multi-stage-configuration or split-configuration codebook is generally not used as it is, and if the interval between its elements is extremely small or the order of the elements is reversed, processing is generally performed to guarantee that the minimum interval becomes a specific value or to maintain ordinality.

Quantized prediction residual vectors $x_{n-1}$ through $x_{n-M}$ of the past M frames are input to corresponding amplifiers 302-1 through 302-M and corresponding amplifiers 305-1 through 305-M respectively.

Amplifiers 302-1 through 302-M multiply input quantized prediction residual vectors $x_{n-1}$ through $x_{n-M}$ by MA predictive coefficients $\alpha_0$ through $\alpha_M$ respectively, and output the results to adder 303. As stated above, in the case of ITU-T Recommendation G.729, there are two kinds of MA predictive coefficient sets, and information as to which is used is included in LPC code $L_n$. Also, with an erased frame for which these multiplications are performed, the MA predictive coefficient set used in the preceding frame is actually used since LPC code $L_n$ has been erased. That is to say, MA predictive coefficient information decoded from preceding-frame LPC code $L_{n-1}$ is used. If the preceding frame is also an erased frame, information of the frame before that is used.

Adder 303 calculates the sum total of quantized prediction residual vectors after MA predictive coefficient multiplication output from amplifiers 302-1 through 302-M, and outputs a vector that is the multiplication result to adder 304. Adder 304 subtracts the vector output from adder 303 from preceding-frame decoded LSF vector $y_{n-1}$ output from buffer 207, and outputs a vector that is the result of this calculation to switch 309.

The vector output from adder 303 is a predictive LSF vector predicted by an MA-type predictor in the current frame, and adder 304 performs processing to find a quantized prediction residual vector in the current frame necessary for a preceding-frame decoded LSF vector to be generated. That is to say, by means of amplifiers 302-1 through 302-M, adder 303, and adder 304, a vector is calculated so that preceding-frame decoded LSF vector $y_{n-1}$ becomes current-frame decoded LSF vector $y_n$.

Amplifiers 305-1 through 305-M multiply input quantized prediction residual vectors $x_{n-1}$ through $x_{n-M}$ by weighting coefficients $\beta_1$ through $\beta_M$ respectively, and output the results to adder 308. Amplifier 306 multiplies preceding-frame decoded LSF vector $y_{n-1}$ output from buffer 207 by weighting coefficient $\beta_{-1}$, and outputs the result to adder 308. Amplifier 307 multiplies code vector $x_{n+1}$ output from codebook 301 by weighting coefficient $\beta_0$, and outputs the result to adder 308.

Adder 308 calculates the sum total of the vectors output from amplifiers 305-1 through 305-M, amplifier 306, and amplifier 307, and outputs a code vector that is the result of this calculation to switch 309. That is to say, adder 308 calculates a vector by performing weighted addition of a code vector identified by next-frame LPC code $L_{n+l}$, the preceding-frame decoded LSF vector, and quantized prediction residual vectors of the past M frames.

If current-frame frame erasure code $B_n$ indicates that "the n'th frame is a normal frame", switch 309 selects a code vector output from codebook 301, and outputs this as current-frame quantized prediction residual vector $x_n$. On the other hand, if current-frame frame erasure code $B_n$ indicates that "the n'th frame is an erased frame", switch 309 further selects a vector to be output according to which information next-frame frame erasure code $B_{n+1}$ has.

That is to say, if next-frame frame erasure code $B_{n+1}$ indicates that "the (n+1)'th frame is an erased frame", switch 309 selects a vector output from adder 304, and outputs this as current-frame quantized prediction residual vector $x_n$. In this case, processing for the vector generation process from codebook 301 and amplifiers 305-1 through 305-M to adder 308 need not be performed.

On the other hand, if next-frame frame erasure code $B_{n+1}$ indicates that "the (n+1)'th frame is a normal frame", switch 309 selects a vector output from adder 308, and outputs this as current-frame quantized prediction residual vector $x_n$. In this case, processing for the vector generation process from amplifiers 302-*i* through 302-M to adder 304 need not be performed.

Thus, according to this embodiment, when a current frame is erased, if the next frame is received normally concealment processing of quantized prediction residue decoded for the current-frame LSF parameter is performed by means of weighted addition processing (weighted linear sum processing) specifically for concealment processing using a parameter decoded in the past, a quantized prediction residue of a frame received in the past, and a quantized prediction residue of a future frame, and LSF parameter decoding is performed using a concealed quantized prediction residue. By this means, higher concealment performance can be achieved than by repeated use of the past decoded LSF parameter.

Results of performing concealment processing of this embodiment will now be described using FIG. 4 through FIG. 7, presenting actual examples in comparison with conventional technology. In FIG. 4 through FIG. 7, ○ indicates a decoded quantized prediction residue, ● indicates a de coded quantized prediction residue obtained by concealment processing, ◇ indicates a decoded parameter, and ◆ indicates a decoded parameter obtained by concealment processing.

Figure 4:
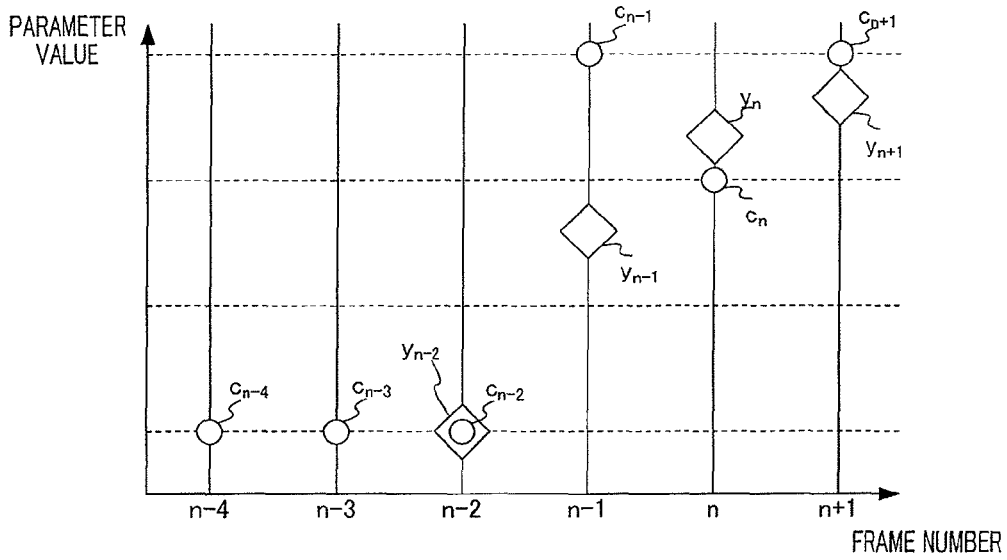
FIG. 4 is a drawing showing an example of the result of performing normal processing when there is no erased frame.

FIG. 4 is a drawing showing an example of the result of performing normal processing when there is no erased frame, in which n'th-frame decoded parameter $y_n$ is found by means of Equation (1) below from decoded quantized prediction residue. In Equation (1), $c_n$ is an n'th-frame decoded quantized prediction residue.

$$y_n=0.6c_n+0.3c_{n-1}+0.1c_{n-2} \quad \text{(Equation 1)}$$

Figure 5:
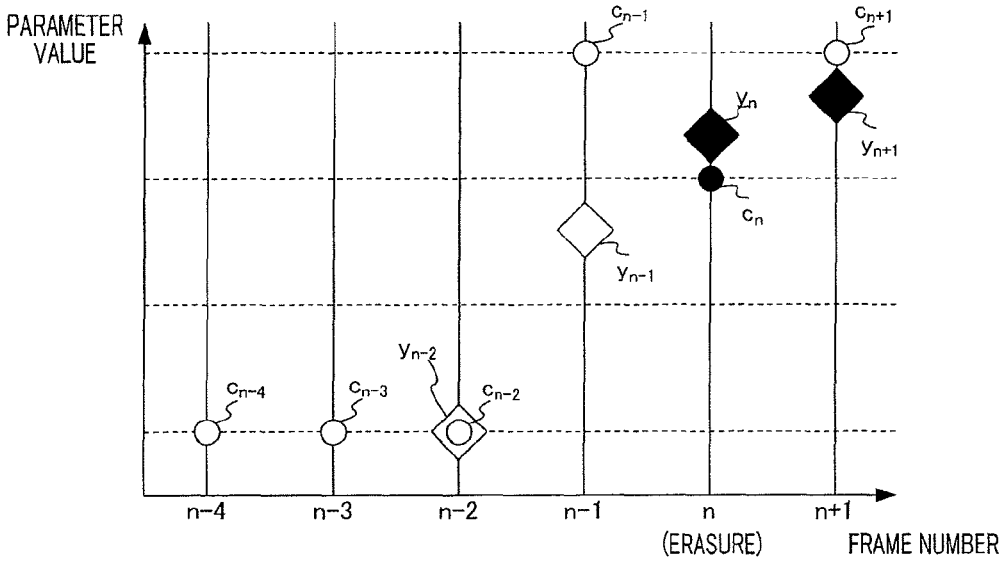
FIG. 5 is a drawing showing an example of the result of performing concealment processing of this embodiment.
Figure 6:
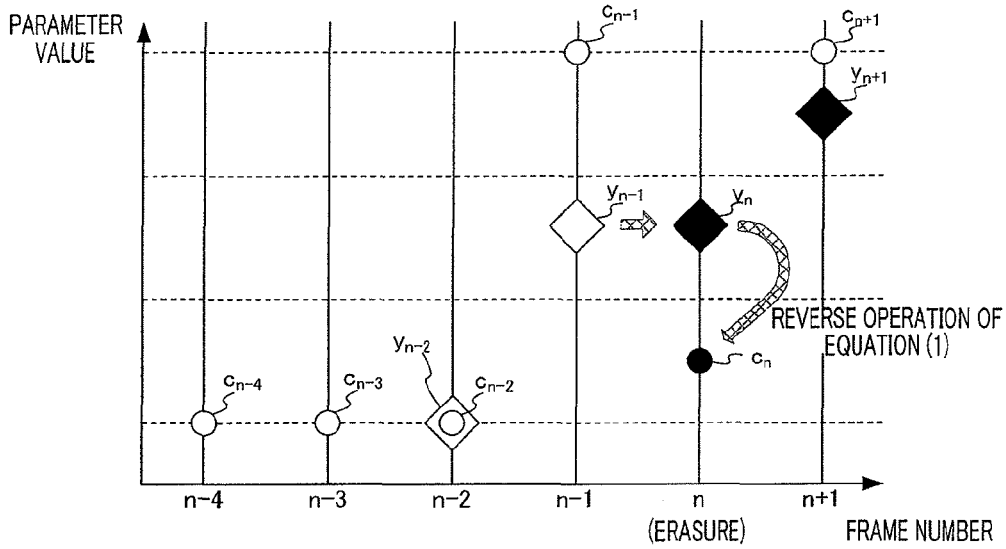
FIG. 6 is a drawing showing an example of the result of performing conventional concealment processing.
Figure 7:
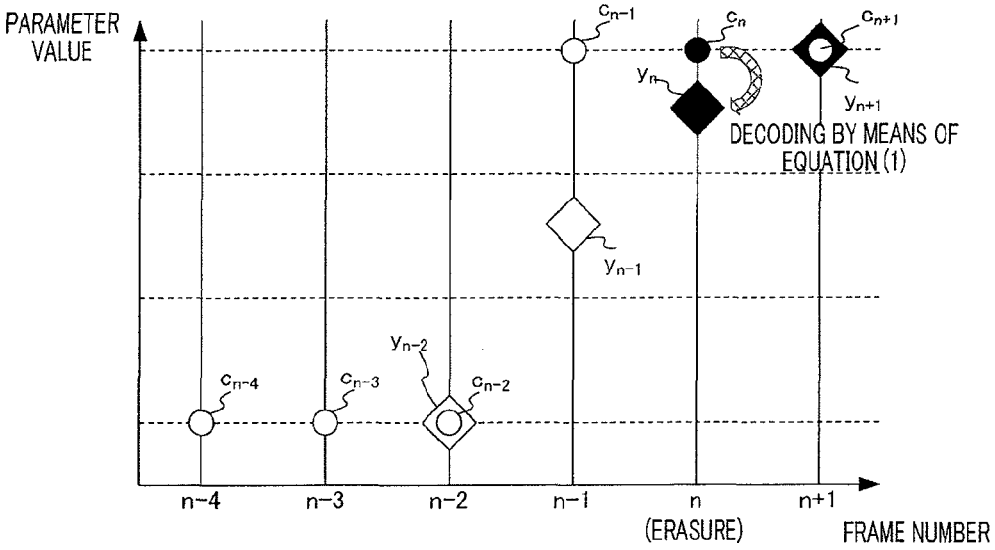
FIG. 7 is a drawing showing an example of the result of performing conventional concealment processing.

FIG. 5 is a drawing showing an example of the result of performing concealment processing of this embodiment, and FIG. 6 and FIG. 7 are drawings showing examples of the result of performing conventional concealment processing. In FIG. 5, FIG. 6, and FIG. 7, it is assumed that the n'th frame is erased and other frames are normal frames.

In the concealment processing of this embodiment shown in FIG. 5, quantized prediction residue $C_n$ decoded for an erased n'th-frame is found using Equation (3) below so as to make sum D (where D is defined by Equation (2) below) of the distance between (n−1)'th-frame decoded parameter $y_{n-1}$ and n'th-frame decoded parameter $y_n$ and the distance between n'th-frame decoded parameter $y_n$ and (n+1)'th-frame decoded parameter $y_{n+1}$ a minimum, so that fluctuation of the decoded parameter between frames becomes moderate.

$$\begin{aligned} D &= |y_{n+1}-y_n|^2+|y_n-y_{n-1}|^2 \quad \text{(Equation 2)} \\ &= 0.6c_{n+1}+0.3c_n+0.1c_{n-1}-0.6c_n-0.3c_{n-1}- \\ &\quad 0.1c_{n-2}|^2+|0.6c_n+0.3c_{n-1}+0.1c_{n-1}-y_{n-1}|^2 \\ &= |0.6c_{n+1}-0.3_n_0.2_{n-1}-0.1c_{n-2}|^2+ \\ &\quad 0.6c_n+0.3c_{n-1}+0.1c_{n-1}-y_{n-1}|^2 \end{aligned}$$

$$\frac{\partial D}{\partial c_n}=0.9c_n-0.36c_{n+1}+0.24c_{n-1}+0.06c_{n-2}-1.2y_{n-1}-0 \quad \text{(Equation 3)}$$

$$c_n=0.4c_{n+1}-0.533333c_{n-1}-0.2c_{n-2}+1.333333y_{n-1}$$

Then concealment processing of this embodiment finds erased n'th-frame decoded parameter $y_n$ by means of Equation (1) above using erased n'th-frame decoded quantized prediction residue $C_n$ is found by means of Equation (3). As a result, as is clear from a comparison of FIG. 4 and FIG. 5, decoded parameter $y_n$ obtained by means of concealment processing of this embodiment becomes almost the same value as that obtained by normal processing when there is no erased frame.

In contrast, with the conventional concealment processing shown in FIG. 6, when the n'th frame is erased, (n−1)'th-frame decoded parameter $y_{n-1}$ is used directly as n'th-frame decoded parameter $y_n$. Also, in the conventional concealment processing shown in FIG. 6, n'th-frame decoded quantized prediction residue $C_n$ is found by means of a reverse operation of Equation (1) above.

In this case, since decoded parameter fluctuation accompanying decoded quantized prediction residue fluctuation is not taken into consideration, as is clear from a comparison of FIG. 4 and FIG. 6, decoded parameter $y_n$ obtained by means of the conventional concealment processing in FIG. 6 has a greatly different value from that obtained by means of normal processing when there is no erased frame. Also, since n'th-frame decoded quantized prediction residue $C_n$ is also different, (n+1)'th-frame decoded parameter $y_{n+1}$ obtained by means of the conventional concealment processing in FIG. 6 also has a different value from that obtained by means of normal processing when there is no erased frame.

The conventional concealment processing shown in FIG. 7 finds a decoded quantized prediction residue by means of interpolation, and when the n'th frame is erased, uses the average of (n−1)'th-frame decoded quantized prediction residue $C_{n-1}$ and (n+1)'th-frame decoded quantized prediction residue $C_{n+1}$ as n'th-frame decoded quantized prediction residue $C_n$.

Then the conventional concealment processing shown in FIG. 7 finds erased n'th-frame decoded parameter $y_n$ by means of Equation (1) above using decoded quantized prediction residue $C_n$ found by means of interpolation.

As a result, as is clear from a comparison of FIG. 4 and FIG. 7, decoded parameter $y_n$ obtained by means of the conventional concealment processing in FIG. 7 has a greatly different value from that obtained by means of normal processing when there is no erased frame. This is because, whereas a decoded parameter fluctuates moderately between frames through weighted moving averaging, with this conventional concealment processing a decoded parameter also fluctuates together with decoded quantized prediction residue fluctuation. Also, since n'th-frame decoded quantized prediction residue $C_n$ is also different, (n+1)'th-frame decoded parameter $y_{n+1}$ obtained by means of the conventional concealment processing in FIG. 7 also has a different value from that obtained by means of normal processing when there is no erased frame.

Embodiment 2

Figure 8:
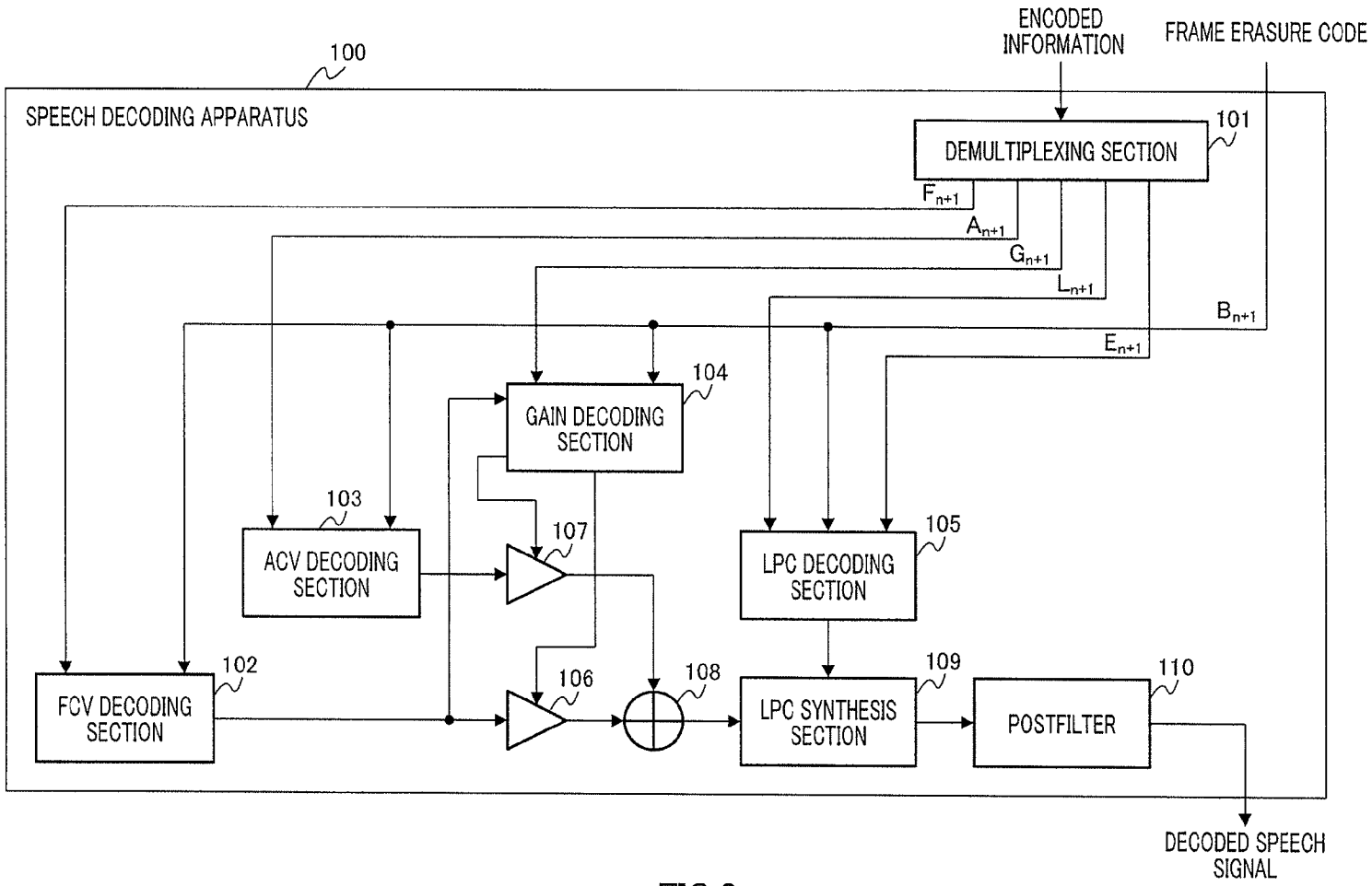
FIG. 8 is a block diagram showing the main configuration of a speech decoding apparatus according to Embodiment 2 of the present invention.

FIG. 8 is a block diagram showing the main configuration of a speech decoding apparatus according to Embodiment 2 of the present invention. Speech decoding apparatus 100 shown in FIG. 8 differs from that in FIG. 1 only in the further addition of concealment mode information $E_{n+1}$ as a parameter input to LPC decoding section 105.

Figure 9:
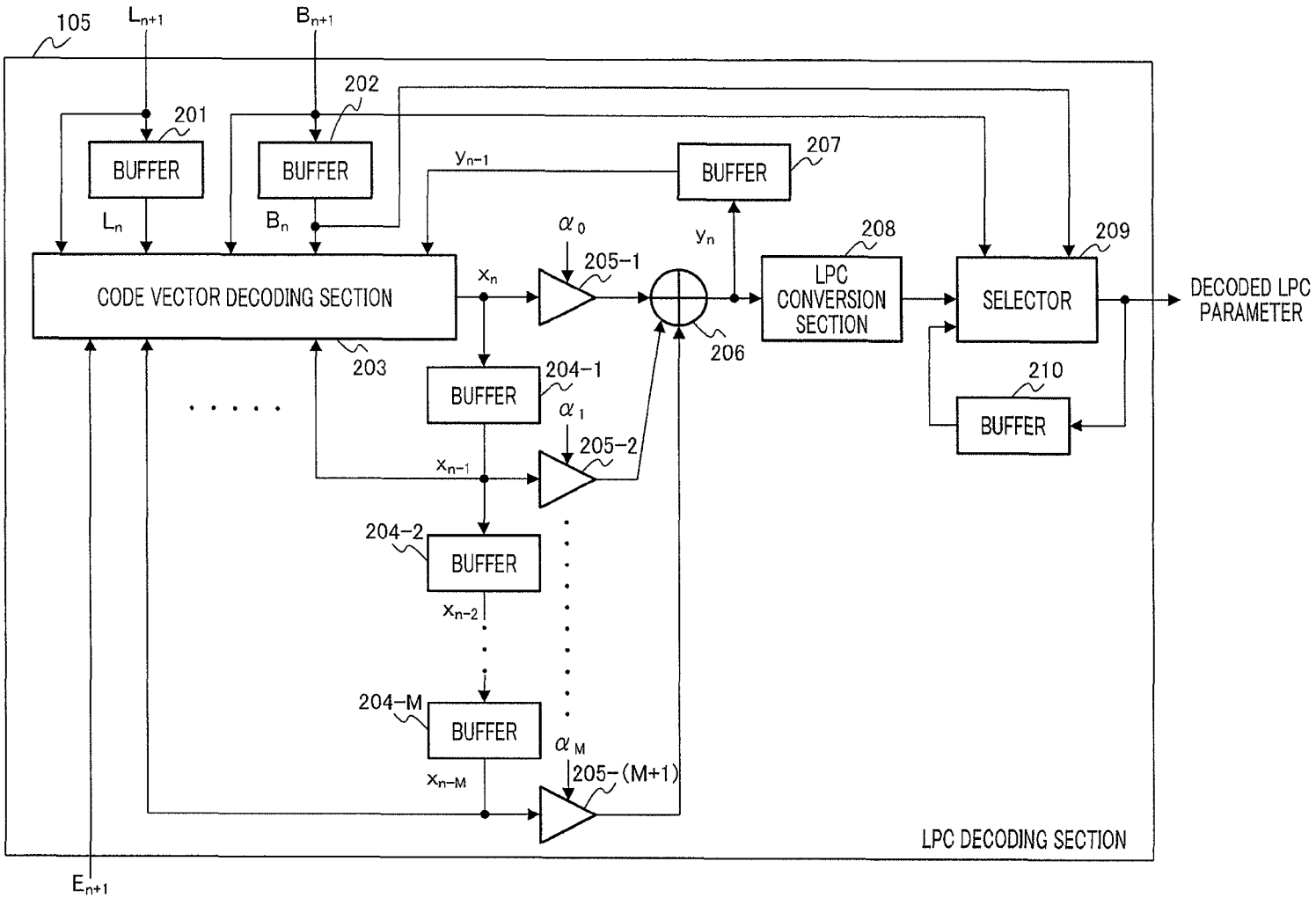
FIG. 9 is a block diagram showing the internal configuration of the LPC decoding section in FIG. 8.

FIG. 9 is a block diagram showing the internal configuration of LPC decoding section 105 in FIG. 8. LPC decoding section 105 shown in FIG. 9 differs from that in FIG. 2 only in the further addition of concealment mode information $E_{n+1}$ as a parameter input to code vector decoding section 203.

Figure 10:
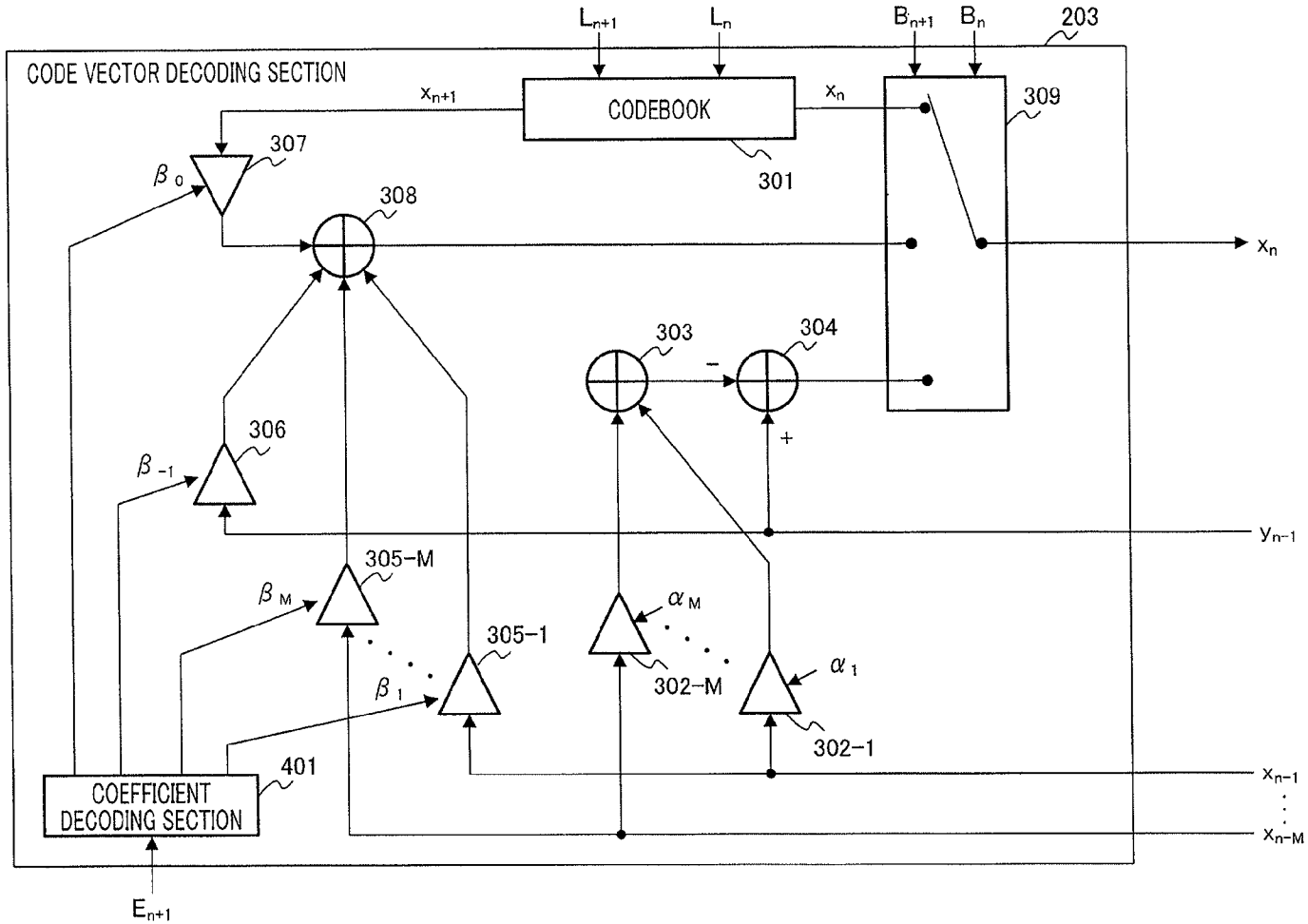
FIG. 10 is a block diagram showing the internal configuration of the code vector decoding section in FIG. 9.

FIG. 10 is a block diagram showing the internal configuration of code vector decoding section 203 in FIG. 9. Code vector decoding section 203 shown in FIG. 10 differs from that in FIG. 3 only in the further addition of coefficient decoding section 401.

Coefficient decoding section 401 stores a plurality of kinds of sets of weighting coefficients ($\beta_{-1}$ through $\beta_M$) (hereinafter referred to as "coefficient sets"), selects one weighting coefficient set from among the coefficient sets according to input concealment mode $E_{n+1}$, and outputs this to amplifiers 305-1 through 305-M, 306, and 307.

Thus, according to this embodiment, in addition to the provision of the features described in Embodiment 1, a plurality of weighted-addition weighting coefficient sets for performing concealment processing are provided, information for identifying an optimal set is transmitted to the decoder side after confirming for the use of which weighting coefficient set on the encoder side high concealment performance is obtained, and concealment processing is performed using a specified weighting coefficient set based on information received on the decoder side, enabling still higher concealment performance to be obtained than in Embodiment 1.

Embodiment 3

Figure 11:
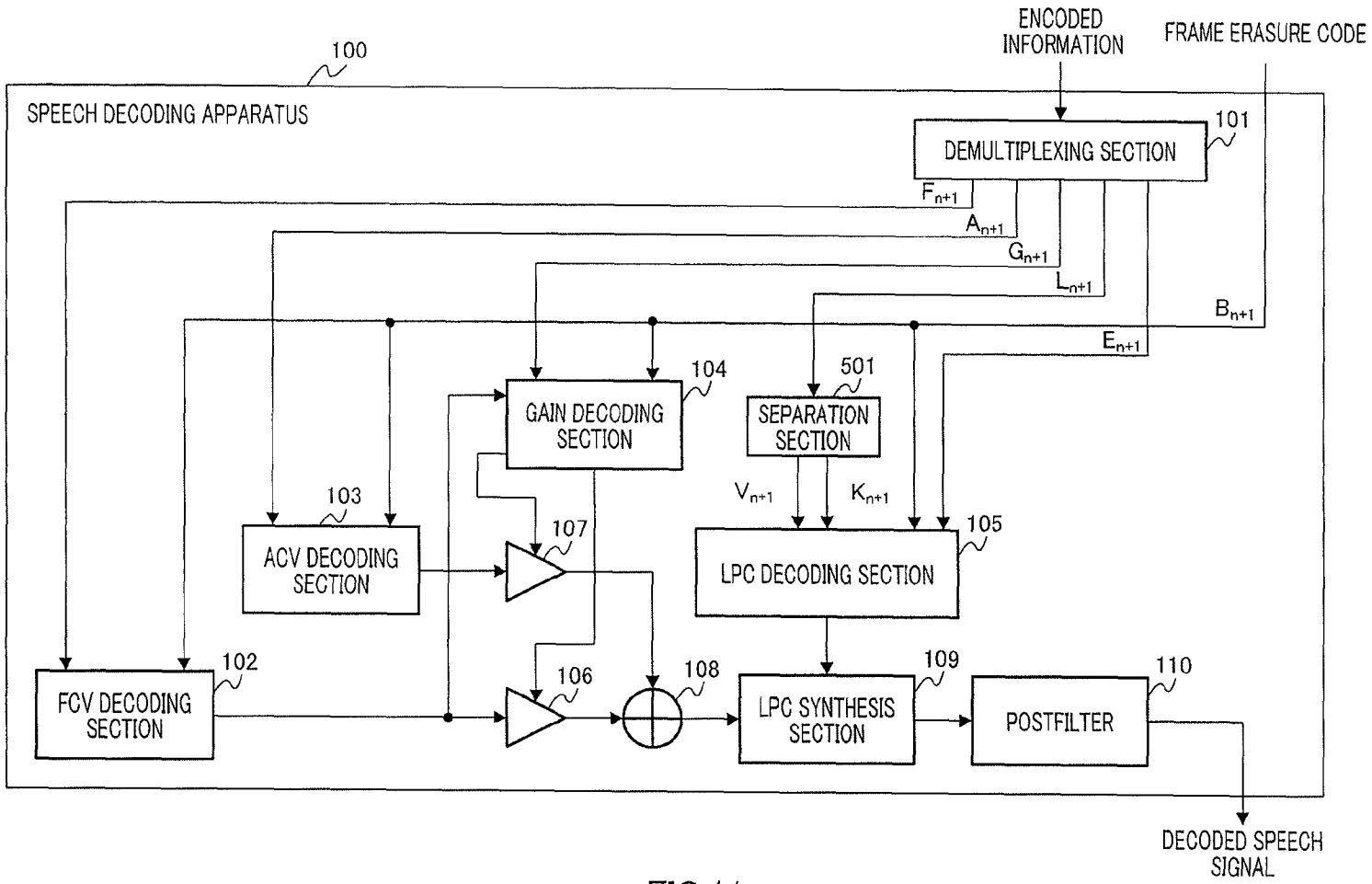
FIG. 11 is a block diagram showing the main configuration of a speech decoding apparatus according to Embodiment 3 of the present invention.

FIG. 11 is a block diagram showing the main configuration of a speech decoding apparatus according to Embodiment 3 of the present invention. Speech decoding apparatus 100 shown in FIG. 11 differs from that in FIG. 8 only in the further addition of separation section 501 that separates LPC code $L_{n+1}$ input to LPC decoding section 105 into two kinds of codes, $V_{n+1}$ and $K_{n+1}$. Code V is code for generating a code vector, and code K is MA predictive coefficient code.

Figure 12:
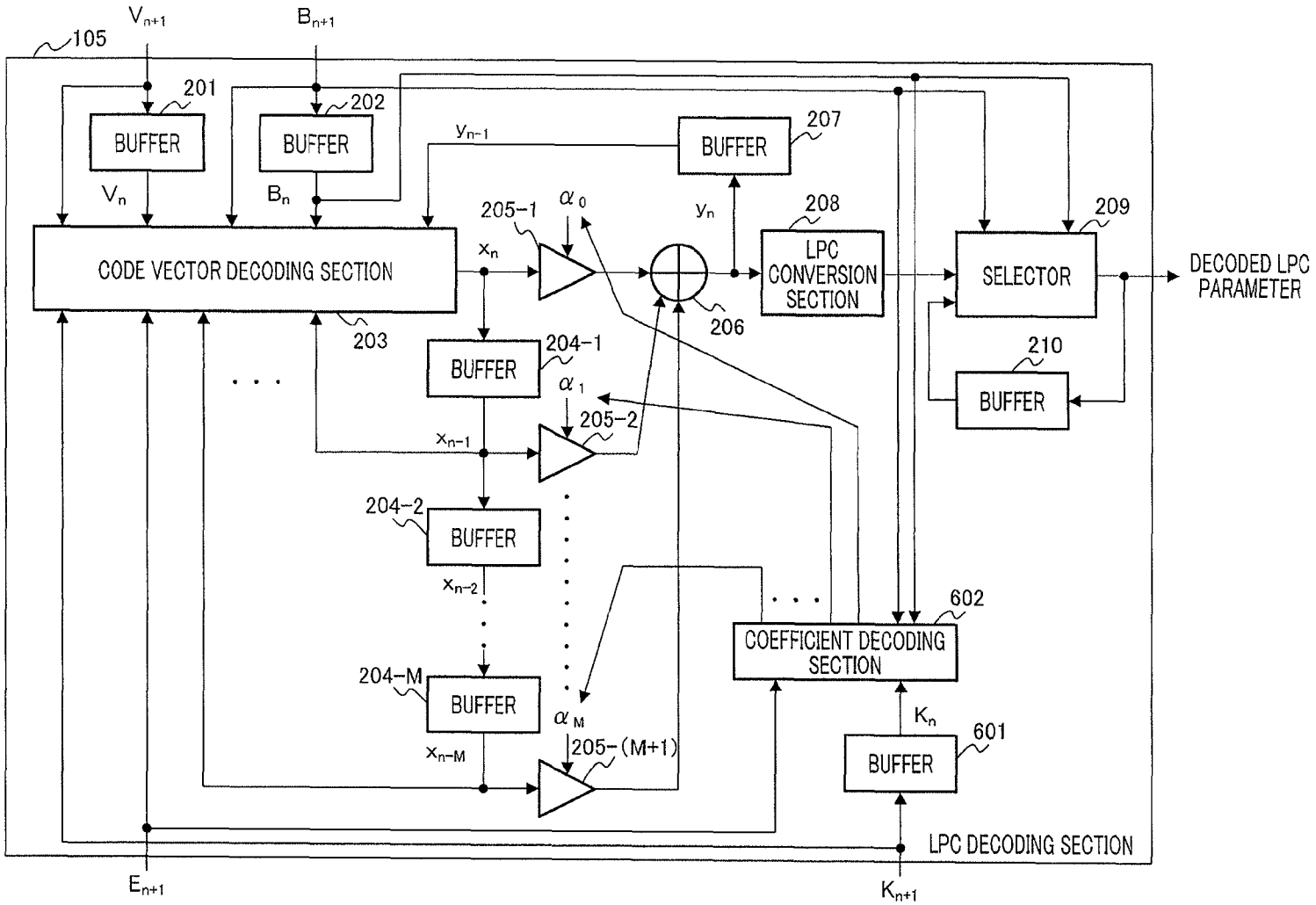
FIG. 12 is a block diagram showing the internal configuration of the LPC decoding section in FIG. 11.

FIG. 12 is a block diagram showing the internal configuration of LPC decoding section 105 in FIG. 11. Codes $V_n$ and $V_{n+1}$ that generate a code vector are used in the same way as LPC codes $L_n$ and $L_{n+1}$, and therefore a description thereof is omitted here. LPC decoding section 105 shown in FIG. 12 differs from that in FIG. 9 only in the further addition of buffer 601 and coefficient decoding section 602, and the further addition of MA predictive coefficient code $K_{n+1}$ as a parameter input to code vector decoding section 203.

Buffer 601 holds MA predictive coefficient code $K_{n+1}$ for the duration of one frame, and then outputs this MA predictive coefficient code to coefficient decoding section 602. As a result, the MA predictive coefficient code output from buffer 601 to coefficient decoding section 602 is MA predictive coefficient code $K_n$ of one frame before.

Coefficient decoding section 602 stores a plurality of kinds of coefficient sets, identifies a coefficient set by means of frame erasure codes $B_n$ and $B_{n+1}$, concealment mode $E_{n+1}$, and MA predictive coefficient code $K_n$, and outputs this to amplifiers 205-1 through 205-(M+1). Here, there are three ways in which coefficient set identification can be performed in coefficient decoding section 602, as follows.

If input frame erasure code $B_n$ indicates that "the n'th frame is a normal frame", coefficient decoding section 602 selects a coefficient set specified by MA predictive coefficient code $K_n$.

If input frame erasure code $B_n$ indicates that "the n'th frame is an erased frame" and frame erasure code $B_{n+1}$ indicates that "the (n+1)'th frame is a normal frame", coefficient decoding section 602 decides a coefficient set to be subject to selection using concealment mode $F_{n+1}$ received as an (n+1)'th frame parameter. For example, if concealment mode code $E_{n+1}$ is decided beforehand so as to indicate an MA predictive coefficient mode to be used with an n'th frame that is a concealed frame, concealment mode code $E_{n+1}$ can be used directly instead of MA predictive coefficient code $K_n$.

Also, if input frame erasure code $B_n$ indicates that "the n'th frame is an erased frame" and frame erasure code $B_{n+1}$ indicates that "the (n+1)'th frame is an erased frame", the only information that can be used is information of the coefficient set used by the preceding frame, and therefore coefficient decoding section 602 repeatedly uses the coefficient set used by the preceding frame. Alternatively, provision may be made for a coefficient set of a mode decided beforehand to be used in a fixed manner.

Figure 13:
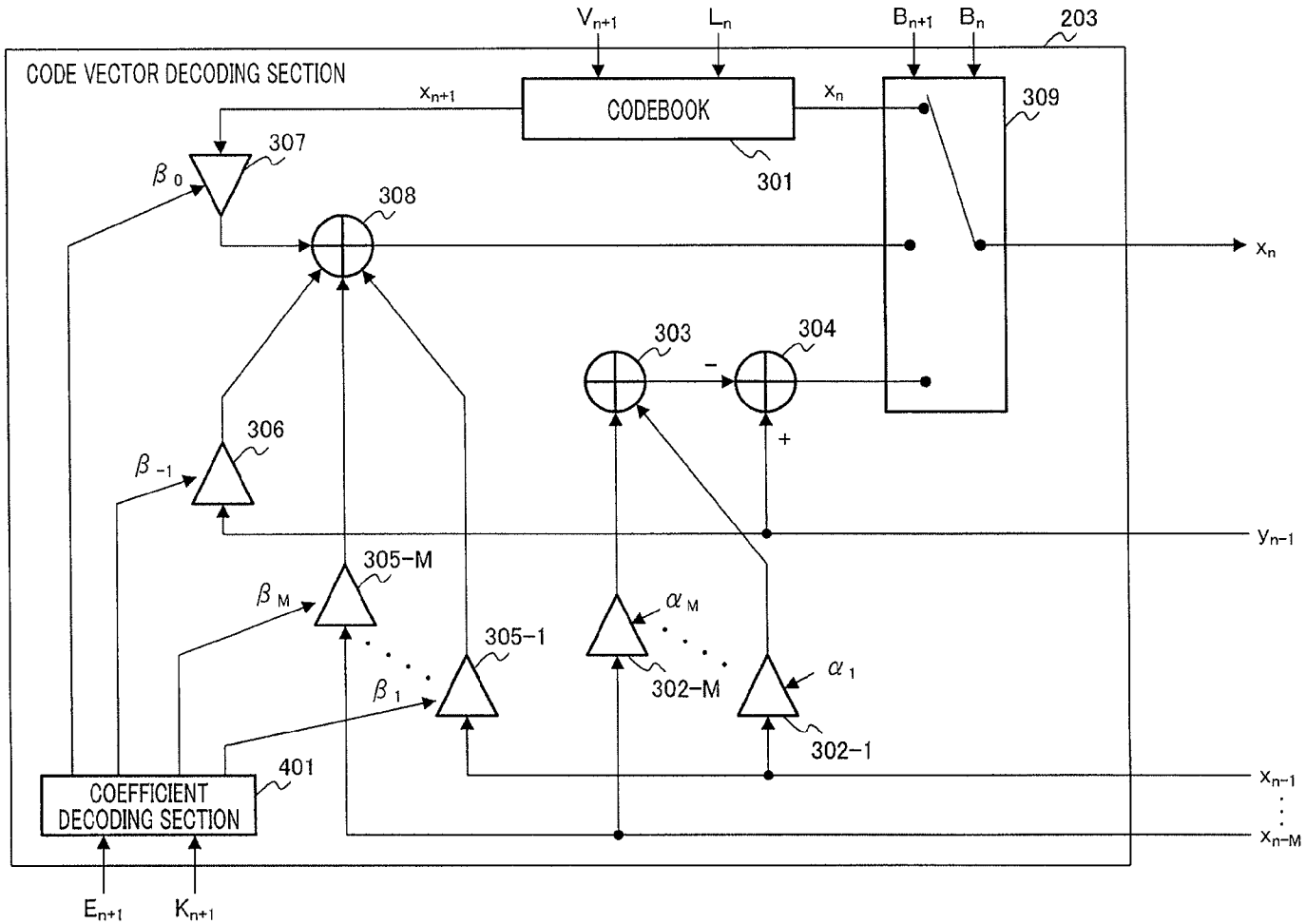
FIG. 13 is a block diagram showing the internal configuration of the code vector decoding section in FIG. 12.

FIG. 13 is a block diagram showing the internal configuration of the code vector decoding section 203 in FIG. 12. Code vector decoding section 203 shown in FIG. 13 differs from that in FIG. 10 only in that coefficient decoding section 401 selects a coefficient set using both concealment mode $E_{n+1}$ and MA predictive coefficient code $K_{n+1}$.

In FIG. 13, coefficient decoding section 401 is provided with a plurality of weighting coefficient sets, and a weighting coefficient set is prepared according to the MA predictive coefficient used by the next frame. For example, in a casein which MA predictive coefficient sets are of two kinds, with one designated mode 0 and the other mode 1, MA predictive coefficient sets comprise a group of weighting coefficient sets specifically for use when the next-frame MA predictive coefficient set is mode 0, and a group of weighting coefficient sets specifically for use when the next-frame MA predictive coefficient set is mode 1.

In this case, coefficient decoding section 401 decides a weighting coefficient set group for one or the other of the above, selects one weighting coefficient set from among the coefficient sets according to input concealment mode $E_{n+1}$, and outputs this to amplifiers 305-1 through 305-M, 306, and 307.

An example of the method of deciding weighting coefficients $\beta_{-1}$ through $\beta_M$ is shown below. As already stated, if the n'th frame is erased, and the (n+1)'th frame is received, final decoded parameters are unknown in both frames even if a decoded quantized prediction residue in the (n+1)'th frame can be decoded correctly. Consequently, decoded parameters of both frames are not decided uniquely unless an assumption (condition of constraint) of some kind is set. Thus, quantized prediction residue $y_n$ is found by means of Equation (4) below so as to minimize $D^{(j)}$, the sum of the distance between a decoded parameter in the n'th frame and a decoded parameter in the (n−1)'th frame, and the distance between a decoded parameter in the (n+1)'th frame and a decoded parameter in the n'th frame, so that n'th-frame and (n+1)'th-frame decoded parameters are as far as possible not separated, from an already decoded (n−1)'th-frame decoded parameter.

$$D^{(j)} = \left|y_n^{(j)} - y_{n-1}^{(j)}\right|^2 + \left|y_{n+1}^{(j)} - y_n^{(j)}\right|^2 \quad \text{(Equation 4)}$$

$$y_n^{(j)} = \sum_{i=0}^{M} \alpha_i^{(j)} x_{n-1}^{(j)}$$

$$y_{n+1}^{(j)} = \sum_{i=0}^{M} \alpha_i'^{(j)} x_{n+1-i}^{(j)}$$

When a parameter is an LSF parameter, $x_n^{(j)}$, $y_n^{(j)}$, $\alpha_i^{(j)}$, and $\alpha'^{(j)}_i$ in Equation (4) are as follows.

$x_n^{(j)}$: Quantized prediction residue of j'th component of LSF parameter in n'th frame $y_n^{(j)}$: j'th component of LSF parameter in n'th frame $\alpha_i^{(j)}$: j'th component of i'th-order component within MA predictive coefficient set in n'th frame $\alpha'^{(j)}_i$: j'th component of i'th-order component within MA predictive coefficient set in (n+1)'th frame M: MA prediction order Here, solving an equation obtained by partially differentiating $D^{(j)}$ by $x_n^{(j)}$ to give 0, $x_n^{(j)}$ is expressed in the form of Equation (5) below.

$$x_n^{(j)} = \beta_0^{(j)} x_{n+1}^{(j)} + \sum_{i=1}^{M} \beta_i^{(j)} x_{n-i}^{(j)} + \beta_{-1}^{(j)} y_{n-1}^{(j)} \quad \text{(Equation 5)}$$

In Equation (5), $\beta_i^{(j)}$ is a weighting coefficient, expressed by $\alpha_i^{(j)}$ and $\alpha'^{(j)}_i$. That is to say, if there is only one kind of MA predictive coefficient set, there is also only one kind of weighting coefficient $\beta_i^{(j)}$ set, but if there are a plurality of kinds of MA predictive coefficient sets, a plurality of kinds of weighting coefficient sets are obtained by combinations of $\alpha_i^{(j)}$ and $\alpha'_i{}^{(j)}$.

For example, in the case of ITU-T Recommendation G.729, MA predictive coefficient sets are of two kinds, and therefore if these are designated mode 0 and mode 1, it is possible for four kinds of sets to be obtained—when the n'th frame and (n+1)'th frame are both mode 0, when the n'th frame is mode 0 and the (n+1)'th frame is mode 1, when the n'th frame is mode 1 and the (n+1)'th frame is mode 0, and when the n'th frame and (n+1)'th frame are both mode 1. A number of methods can be conceived of for deciding which weighting coefficient set is to be used of these four kinds of sets.

A first method is to generate an n'th-frame decoded LSF and (n+1)'th-frame decoded LSF on the encoder side using all four kinds of sets, calculate the Euclidian distance between the generated n'th-frame decoded LSF and an unquantized LSF obtained by analyzing an input signal, calculate the Euclidian distance between the generated (n+1)'th-frame decoded LSF and an unquantized LSF obtained by analyzing an input signal, choosing one of the weighting coefficient β sets that minimizes the sum of these Euclidian distances, encoding the chosen set as two bits and transmitting this to the decoder. In this case, two bits per frame are necessary for weighting coefficient β encoding in addition to ITU-T Recommendation G.729 encoding information. Auditorily better quality can be achieved by using weighted Euclidian distances, as used in ITU-T Recommendation G.729 LSF quantization, instead of Euclidian distances.

A second method is to make the number of additional bits per frame one by using (n+1)'th-frame MA predictive coefficient mode information. Since (n+1)'th-frame MA predictive coefficient mode information on the decoder side, combinations of $\alpha_i^{(j)}$ and $\alpha'_i{}^{(j)}$ are limited to two. That is to say, if the (n+1)'th-frame MA prediction mode is mode 0, an n'th-frame and (n+1)'th-frame MA prediction mode combination is either (0-0) or (1-0), enabling weighting coefficient β sets to be limited to two kinds. On the encoder side, it is only necessary to perform encoding using whichever of these two kinds of weighting coefficient β sets has a smaller error with respect to an unquantized LSF in the same way as in the first method above, and to transmit this to the decoder.

A third method is one in which no selection information whatever is sent, a used weighting coefficient set is one for which MA prediction mode combinations are of only two kinds, (0-0) or (1-0), with the former being selected when the (n+1)'th-frame MA predictive coefficient mode is 0, and the latter being selected when the (n+1)'th-frame MA predictive coefficient mode is 1. Alternatively, a method may be used whereby an erasure-frame mode is fixed at a specific mode, such as (0-0) or (0-1).

Other possible methods are a method whereby, with a frame for which an input signal can be determined to be stationary, provision is made for (n−1)'th-frame and n'th-frame decoded parameters to become equal, as with a conventional method, and a method that uses a weighting coefficient β set found on the assumption that (n+1)'th-frame and n'th-frame decoded parameters become equal.

Here, (n−1)'th-frame and (n+1)'th-frame pitch period information, MA predictive coefficient mode information, or the like, can be used to determine stationarity. That is to say, possible methods are to determine that a signal is stationary when a decoded pitch period difference between the (n−1)'th-frame and (n+1)'th-frame is small, or to determine that a signal is stationary when a mode suitable for encoding a frame for which MA predictive coefficient mode information decoded in the (n+1)'th frame is stationary (that is, a mode in which a high-order MA predictive coefficient also has weight of a certain size) has been selected.

Thus, in this embodiment, in addition to the provisions of Embodiment 2, MA predictive coefficient modes are of two kinds, allowing different MA predictive coefficient sets to be used for a stationary section and a section that is not so, and enabling LSF quantizer performance to be improved.

Also, by using an Equation (5) weighting coefficient set that minimizes Equation (4), decoded LSF parameters of an erased frame and a normal frame that is the next frame after the erased frame are guaranteed not to become values that deviate greatly from an LSF parameter of the frame preceding the erased frame. Consequently, even if a decoded LSF parameter of the next frame is unknown, reception information (a quantized prediction residue) of the next frame can continue to be used effectively, and the risk of concealment being performed in the wrong direction—that is, the risk of deviating greatly from a correct decoded LSF parameter—can be kept to a minimum.

Furthermore, if the second method above is used as a concealment mode selection method, MA predictive coefficient mode information can be used as part of the information that identifies a weighting coefficient set for concealment processing use, enabling the amount of additionally transmitted weighting coefficient set information for concealment processing use to be reduced.

Embodiment 4

Figure 14:
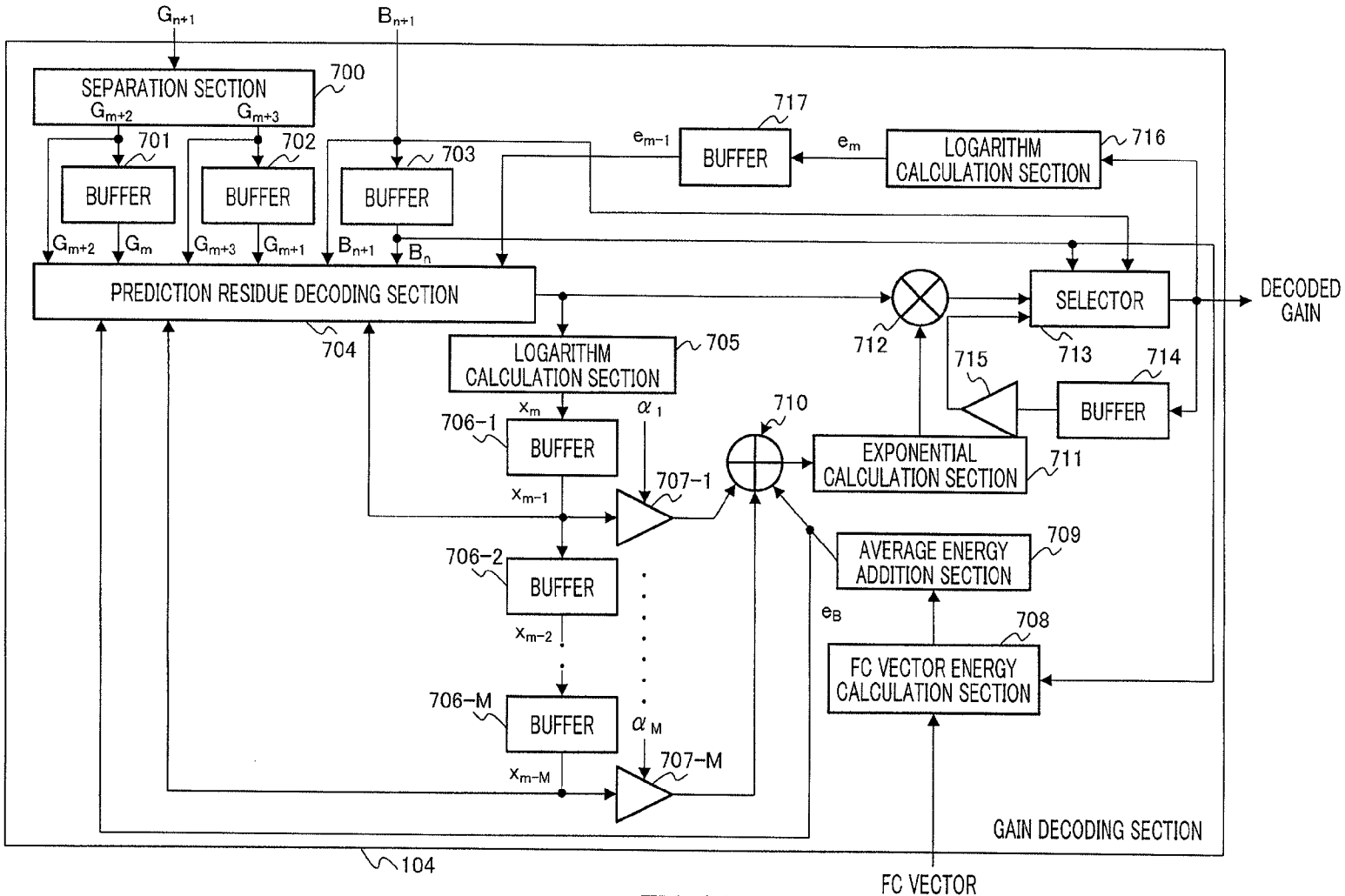
FIG. 14 is a block diagram showing the internal configuration of the gain decoding section in FIG. 1.

FIG. 14 is a block diagram showing the internal configuration of gain decoding section 104 in FIG. 1 (the same applying to gain decoding section 104 in FIG. 8 and FIG. 11). In this embodiment, as in the case of ITU-T Recommendation G.729, gain decoding is performed once on a subframe and one frame is composed of two subframes, and FIG. 14 illustrates sequential decoding of gain codes ($G_m$ and $G_{m+1}$) of two subframes of the n'th frame, where n denotes a frame number and m denotes a subframe number (the subframe numbers of the first subframe and second subframe of the n'th frame being designated m and m+1 respectively).

In FIG. 14, (n+1)'th-frame gain code $G_{n+1}$ is input to gain decoding section 104 from demultiplexing section 101. Gain code $G_{n+1}$ is input to separation section 700, and is separated into (n+1)'th-frame first-subframe gain code $G_{m+2}$ and second-subframe gain code $G_{m+3}$. Separation into gain codes $G_{m+2}$ and $G_{m+3}$ may also be performed by demultiplexing section 101.

Gain decoding section 104 decodes subframe m decoded gain and subframe m+1 decoded gain in order using $G_m$, $G_{m+1}$ $G_{m+2}$ and $G_{m+3}$ generated from input $G_n$ and $G_{n+1}$.

The operation of each section of gain decoding section 104 when decoding gain code $G_m$ will now be described with reference to FIG. 14.

Gain code $G_{m+2}$ is input to buffer 701 and prediction residue decoding section 704, and frame erasure code $B_{n+1}$ is input to buffer 703, prediction residue decoding section 704, and selector 713.

Buffer 701 holds an input gain code for the duration of one frame, and then outputs this gain code to prediction residue decoding section 704, so that the gain code input to prediction residue decoding section 704 is the gain code for one frame before. That is to say, if the gain code input to buffer 701 is $G_{m+2}$, the output gain code is $G_m$. Buffer 702 also performs the same kind of processing as buffer 701. That is to say, an input gain code is held for the duration of one frame, and then output to prediction residue decoding section 704. The only difference is that buffer 701 input/output is first-subframe gain code, and buffer 702 input/output is second-subframe gain code.

Buffer 703 holds next-frame frame erasure code $\beta_{n+1}$ for the duration of one frame, and then outputs this frame erasure code to prediction residue decoding section 704, selector 713, and FC vector energy calculation section 708. The frame erasure code output from buffer 703 to prediction residue decoding section 704, selector 713, and FC vector energy calculation section 708 is the frame erasure code of one frame before the input frame, and is thus current-frame frame erasure code $B_n$.

Prediction residue decoding section 704 has logarithmic quantized prediction residues (resulting from finding the logarithms of quantized MA prediction residues) $x_{m-1}$ through $x_{m-M}$ of the past M subframes, decoded energy (logarithmic decoded gain) $e_{m-1}$ of one subframe before, prediction residue bias gain $e_B$, next-frame gain codes $G_{m+2}$ and $G_{m+3}$, next-frame frame erasure code $B_{n+1}$, current-frame gain codes $G_m$ and $G_{m+1}$, and current-frame frame erasure code $B_n$, as input, generates a current-frame quantized prediction residue based on these items of information, and outputs this to logarithm calculation section 705 and multiplication section 712. Details of prediction residue decoding section 704 will be given later herein.

Logarithm calculation section 705 calculates logarithm $x_m$ of a quantized prediction residue output from prediction residue decoding section 704 (in ITU-T Recommendation G.729, $20\times\log_{10}(x)$, where x is input), and outputs this to buffer 706-1.

Buffer 706-1 has logarithmic quantized prediction residue $x_m$ output from logarithm calculation section 705 as input, holds this for the duration of one subframe, and then outputs this logarithmic quantized prediction residue to predict ion residue decoding section 704, buffer 706-2 and buffer 707-1. That is to say, the logarithmic quantized prediction residue input to prediction residue decoding section 704, buffer 706-2, and amplifier 707-1 is logarithmic quantized prediction residue $x_{m-1}$ of one subframe before. Similarly, buffers **706-*i* (where i is 2 through M−1) each hold input logarithmic quantized prediction residue $x_{m-i}$ for the duration of one subframe, and then output this logarithmic quantized prediction residue to prediction residue decoding section 704, buffer 706-(*i*+1), and amplifier 707-*i*. Buffer 706-M holds input logarithmic quantized prediction residue $x_{m-M-1}$ for the duration of one subframe, and then outputs this logarithmic quantized prediction residue to prediction residue decoding section 704 and amplifier 707**-M.

Amplifier 707-1 multiplies logarithmic quantized prediction residue $x_{m-i}$ by predetermined MA predictive coefficient $\alpha_1$, and outputs the result to adder 710. Similarly, amplifiers **707-*j* (where j is 2 through M) each multiply logarithmic quantized prediction residue $x_{m-j}$ by predetermined MA predictive coefficient $\alpha_j$, and output the result to adder 710**. The MA predictive coefficient set comprises fixed values of one kind in ITU-T Recommendation G.729, but a configuration may also be used whereby a plurality of kinds of sets are provided and a suitable one is selected.

If current-frame frame erasure code $B_n$ indicates that "the n'th frame is a normal frame", FC vector energy calculation section 708 calculates the energy of an FC (fixed codebook) vector decoded separately, and outputs the calculation result to average energy addition section 709. If current-frame frame erasure code $B_n$ indicates that "the n'th frame is an erased frame", FC vector energy calculation section 708 outputs the FC vector energy of the preceding subframe to average energy addition section 709.

Average energy addition section 709 subtracts the FC vector energy output from FC vector energy calculation section 708 from the average energy, and outputs the subtraction result, prediction residue bias gain $e_B$, to prediction residue decoding section 704 and adder 710. Here, average energy is assumed to be a preset constant. Also, energy addition/subtraction is performed in the logarithmic domain.

Adder 710 calculates the sum total of logarithmic quantized prediction residues after MA predictive coefficient multiplication output from amplifiers 707-1 through 707-M and prediction residue bias gain $e_B$ output from average energy addition section 709, and outputs logarithmic prediction gain that is the result of this calculation to exponential calculation section 711.

Exponential calculation section 711 calculates an exponential ($10^x$, where x is input) of logarithmic prediction gain output from adder 710, and outputs prediction gain that is the result of this calculation to multiplier 712.

Multiplier 712 multiplies the prediction gain output from exponential calculation section 711 by the quantized prediction residue output from prediction residue decoding section 704, and outputs decoded gain that is the result of this calculation to selector 713.

Selector 713 selects either decoded gain output from multiplier 712 or post-attenuation preceding-frame decoded gain output from amplifier 715 based on current-frame frame erasure code $B_n$ and next-frame frame erasure code $B_{n+1}$. Specifically, decoded gain output from multiplier 712 is selected if current-frame frame erasure code $B_n$ indicates that "the n'th frame is a normal frame" or next-frame frame erasure code $B_{n+1}$ indicates that "the (n+1)'th frame is a normal frame", and post-attenuation preceding-frame decoded gain output from amplifier 715 is selected if current-frame frame erasure code $B_n$ indicates that "the n'th frame is an erased frame" and next-frame frame erasure code $B_{n+1}$ indicates that "the (n+1)'th frame is an erased frame". Then selector 713 outputs the selection result as final prediction gain to amplifiers 106 and 107, buffer 714, and logarithm calculation section 716. If selector 713 selects post-attenuation preceding-frame decoded gain output from amplifier 715, it is not actually necessary to perform all the processing from prediction residue decoding section 704 through multiplier 712, and only processing to update the contents of buffers 706-1 through 706-M need be performed.

Buffer 714 holds decoded gain output from selector 713 for the duration of one subframe, and then outputs this decoded gain to amplifier 715. As a result, the decoded gain output from buffer 714 to amplifier 715 is the decoded gain of one subframe before. Amplifier 715 multiplies the decoded gain of one subframe before output from buffer 714 by a predetermined attenuation coefficient, and outputs the result to selector 713. The value of this predetermined attenuation coefficient is 0.98 in ITU-T Recommendation G.729, for example, but an optimal value for the codec may be set as appropriate, and the value may also be changed according to the characteristics of an erased frame signal, such as whether the erased frame is a voiced frame or an unvoiced frame.

Logarithm calculation section 716 calculates logarithm $e_m$ of decoded gain output from selector 713 (in ITU-T Recommendation G.729, $20\times\log_{10}(x)$, where x is input), and outputs this to buffer 717. Buffer 717 has logarithmic decoded gain $e_m$ as input from logarithm calculation section 716, holds this for the duration of one subframe, and then outputs this logarithmic decoded gain to prediction residue decoding section 704.

That is to say, the logarithmic prediction gain input to prediction residue decoding section 704 is logarithmic decoded gain $e_{m-1}$ of one subframe before.

Figure 15:
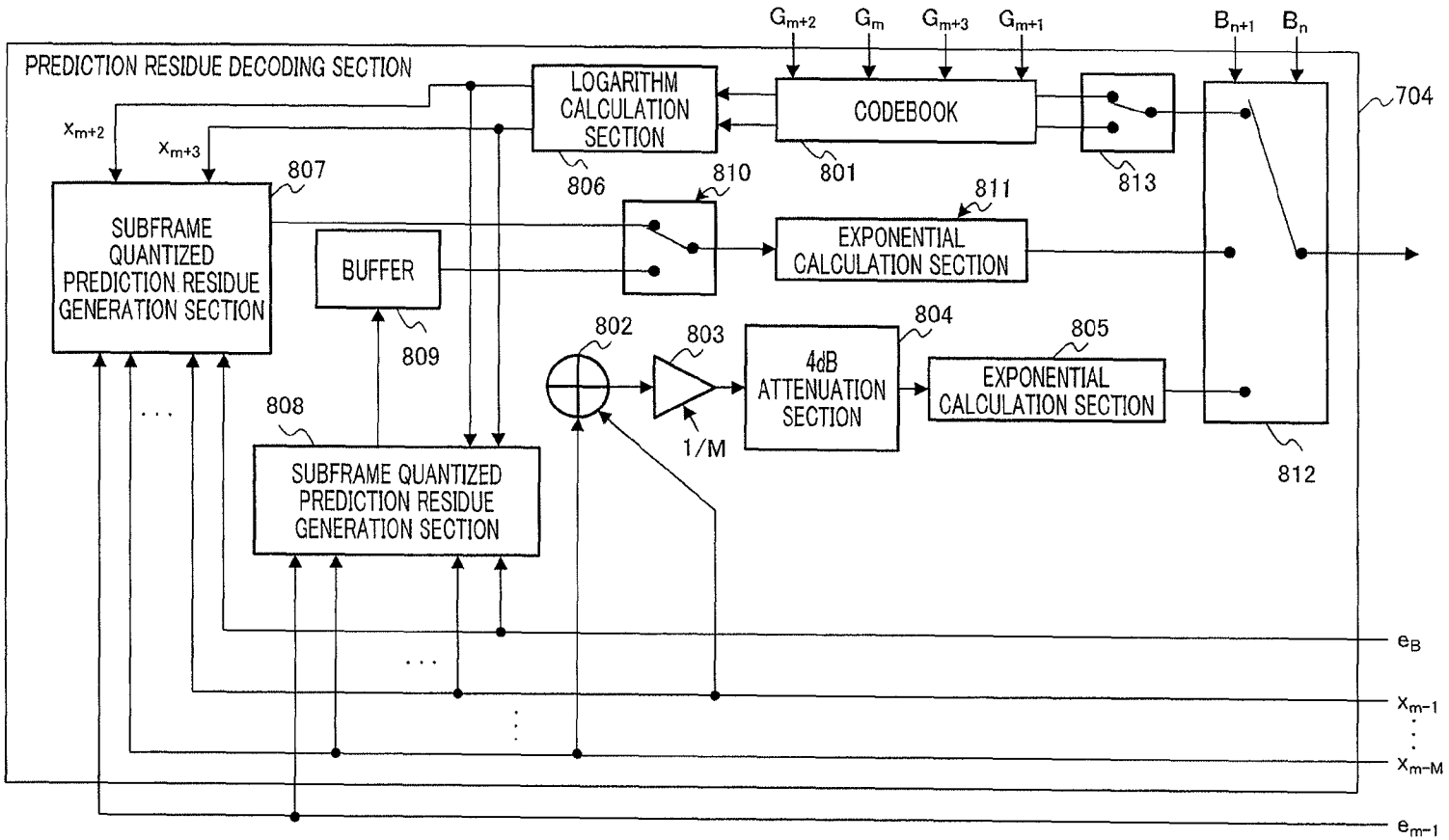
FIG. 15 is a block diagram showing the internal configuration of the prediction residue decoding section in FIG. 14.

FIG. 15 is a block diagram showing the internal configuration of prediction residue decoding section 704 in FIG. 14. In FIG. 15, gain codes $G_m$, $G_{m+1}$, $G_{m+2}$, and $G_{m+3}$ are input to codebook 801, frame erasure codes $B_n$ and $B_{n+1}$ are input to switch 812, logarithmic quantized prediction residues $x_{m-1}$ through $x_{m-M}$ of the past M sub frames are input to adder 802, and logarithmic decoded gain $e_{m-1}$ of one subframe before and prediction residue bias gain $e_B$ are input to subframe quantized prediction residue generation section 807 and subframe quantized prediction residue generation section 808.

Codebook 801 decodes corresponding quantized prediction residues from input gain codes $G_m$, $G_{m+1}$, $G_{m+2}$, and $G_{m+3}$, outputs quantized prediction residues corresponding to input gain codes $G_m$ and $G_{m+1}$ to switch 812 via switch 813, and outputs quantized prediction residues corresponding to input gain codes $G_{m+2}$ and $G_{m+3}$ to logarithm calculation section 806.

Switch 813 selects either of quantized prediction residues decoded from gain codes $G_m$ and $G_{m+1}$, and outputs this to switch 812. Specifically, a quantized prediction residue decoded from gain code $G_m$ is selected when first-subframe gain decoding processing is performed, and a quantized prediction residue decoded from gain code $G_{m+1}$ is selected when second-subframe gain decoding processing is performed.

Adder 802 calculates the sum total of logarithmic quantized prediction residues $x_{m-1}$ through $x_{m-M}$ of the past M subframes, and outputs the result of this calculation to amplifier 803. Amplifier 803 calculates an average by multiplying the adder 802 output value by 1/M, and outputs the result of this calculation to 4 dB attenuation section 804.

4 dB attenuation section 804 lowers the amplifier 803 output value by 4 dB, and outputs the result to exponential calculation section 805. This 4 dB attenuation is to prevent a predictor outputting an excessively large prediction value in a frame (subframe) recovered from frame erasure, and an attenuator is not necessarily essential in a configuration example in which such a necessity does not arise. With regard to the 4 dB attenuation amount, also, it is possible to design an optimal value freely.

Exponential calculation section 805 calculates an exponential of the 4 dB attenuation section 804 output value, and outputs a concealed prediction residue that is the result of this calculation to switch 812.

Logarithm calculation section 806 calculates logarithms of two quantized prediction residues output from codebook 801 (resulting from decoded gain codes $G_{m+2}$ and $G_{m+3}$), and outputs logarithmic quantized prediction residues $x_{m+2}$ and $x_{m+3}$ that are the results of the calculations to subframe quantized prediction residue generation section 807 and subframe quantized prediction residue generation section 808.

Subframe quantized prediction residue generation section 807 has logarithmic quantized prediction residues $x_{m+2}$ and $x_{m+3}$, logarithmic quantized prediction residues $x_{m-1}$ through $x_{m-M}$ of the past M subframes, decoded energy $e_{m-1}$ of one subframe before, and prediction residue bias gain $e_B$, as input, calculates a first-subframe logarithmic quantized prediction residue based on these items of information, and outputs this to switch 810. Similarly, subframe quantized prediction residue generation section 808 has logarithmic quantized prediction residues $x_{m+2}$ and $x_{m+3}$, logarithmic quantized prediction residues $x_{m-1}$ through $x_{m-M}$ of the past M subframes, decoded energy $e_{m-1}$ of one subframe before, and prediction residue bias gain $e_B$, as input, calculates a second-subframe logarithmic quantized prediction residue based on these items of information, and outputs this to buffer 809. Details of subframe quantized prediction residue generation sections 807 and 808 will be given later herein.

Buffer 809 holds the second-subframe logarithmic quantized prediction residue output from subframe quantized prediction residue generation section 808 for the duration of one subframe, and outputs this second-subframe logarithmic quantized prediction residue to switch 810 when second-subframe processing is performed. At the time of second-subframe processing, $x_{m-1}$ through $x_{m-M}$, $e_{m-1}$, and $e_B$ are updated outside prediction residue decoding section 704, but no processing is performed by either subframe quantized prediction residue generation section 807 or subframe quantized prediction residue generation section 808, and all processing is performed at the time of first-subframe processing.

At the time of first-subframe processing, switch 810 is connected to subframe quantized prediction residue generation section 807, and outputs a generated first-subframe logarithmic quantized prediction residue to exponential calculation section 811, whereas at the time of second-subframe processing, switch 810 is connected to buffer 809, and outputs a second-subframe logarithmic quantized prediction residue generated by subframe quantized prediction residue generation section 808 to exponential calculation section 811. Exponential calculation section 811 exponentiates a logarithmic quantized residue output from switch 810, and outputs a concealed prediction residue that is the result of this calculation to switch 812.

If current-frame frame erasure code $B_n$ indicates that "the n'th frame is a normal frame", switch 812 selects a quantized prediction residue output from codebook 801 via switch 813. On the other hand, if current-frame frame erasure code $B_n$ indicates that "the n'th frame is an erased frame", switch 812 further selects a quantized prediction residue to be output according to which information next-frame frame erasure code $B_{n+1}$ has.

That is to say, switch 812 selects a concealed prediction residue output from exponential calculation section 805 if next-frame frame erasure code $B_{n+1}$ indicates that "the (n+1)'th frame is an erased frame", and selects a concealed prediction residue output from exponential calculation section 811 if next-frame frame erasure code $B_{n+1}$ indicates that "the (n+1)'th frame is a normal frame". Data input to a terminal other than the selected terminal is not necessary, and therefore, in actual processing, it is usual first to decide which terminal is to be selected in switch 812, and to perform processing to generate a signal to be output to the decided terminal.

Figure 16:
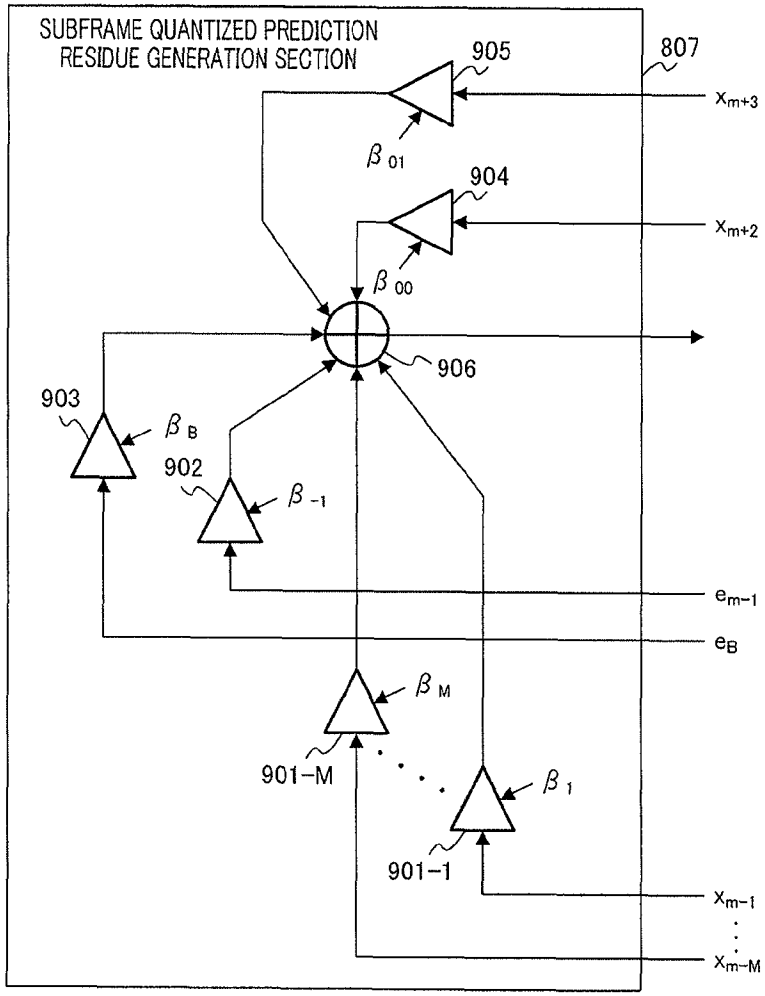
FIG. 16 is a block diagram showing the internal configuration of a sub frame quantized prediction residue generation section in FIG. 15.

FIG. 16 is a block diagram showing the internal configuration of subframe quantized prediction residue generation section 807 in FIG. 15. The internal configuration of subframe quantized prediction residue generation section 808 is also identical to that in FIG. 16, and only the weighting coefficient values differ from those in subframe quantized prediction residue generation section 807.

Amplifiers 901-1 through 901-M multiply input logarithmic quantized prediction residues $x_{m-1}$ through $x_{m-M}$ by weighting coefficients $\beta_1$ through $\beta_M$ respectively, and output the results to adder 906. Amplifier 902 multiplies preceding-subframe logarithmic gain $e_{m-1}$ by weighting coefficient $\beta_{-1}$, and outputs the result to adder 906. Amplifier 903 multiplies logarithmic bias gain $e_B$ by weighting coefficient $\beta_B$, and outputs the result to adder 906. Amplifier 904 multiplies logarithmic quantized prediction residue $x_{m+2}$ by weighting coefficient $\beta_{00}$, and outputs the result to adder 906. Amplifier

905 multiplies logarithmic quantized prediction residue $x_{m+3}$ by weighting coefficient $\beta_{01}$, and outputs the result to adder 906.

Adder 906 calculates the sum total of the logarithmic quantized prediction residues output from amplifiers 901-1 through 901-M, amplifier 902, amplifier 903, amplifier 904, and amplifier 905, and outputs the result of this calculation to switch 810.

An example is shown below of a method of deciding weighting coefficient β in this embodiment. As already stated, in the case of ITU-T Recommendation G.729, gain quantization is subframe processing and one frame is composed of two subframes, and therefore erasure of one frame is a burst erasure of two consecutive subframes. Therefore, a weighting coefficient β set cannot be decided by means of the method described in Embodiment 3. Thus, in this embodiment, $x_m$ and $x_{m+1}$ are found that minimize D in Equation (6) below.

$$D = |y_m - y_{m-1}|^2 + |y_{m+1} - y_m|^2 + |y_{m+2} - y_{m+1}|^2 + |y_{m+3} - y_{m+2}|^2 \quad \text{(Equation 6)}$$

$$y_m = \sum_{i=0}^{M} \alpha_i x_{m-i} + x_B$$

$$y_{m+1} = \sum_{i=0}^{M} \alpha_i x_{m+1-i} + x_B$$

$$y_{m+2} = \sum_{i=0}^{M} \alpha_i x_{m+2-i} + x_B$$

$$y_{m+3} = \sum_{i=0}^{M} \alpha_i x_{m+3-i} + x_B$$

Here, a case is described by way of example in which one frame is composed of two subframes as in ITU-T Recommendation G.729, and an MA predictive coefficient is of only one kind. In Equation (6), $y_{m-1}$, $y_m$, $y_{m+1}$, $y_{m+2}$, $y_{m+3}$, $x_m$, $x_{m+1}$, $x_{m+2}$, $x_{m+3}$, $x_B$, and $\alpha_i$ are as follows.

$y_{m-1}$: Preceding-frame second-sub frame decoded logarithmic gain $y_m$: Current-frame first-subframe decoded logarithmic gain $y_{m+1}$: Current-frame second-subframe decoded logarithmic gain $y_{m+2}$: Next-frame first-subframe decoded logarithmic gain $y_{m+3}$: Next-frame second-subframe decoded logarithmic gain $x_m$: Current-frame first-subframe logarithmic quantized prediction residue $x_{m+1}$: Current-frame second-subframe logarithmic quantized prediction residue $x_{m+2}$: Next-frame first-subframe logarithmic quantized prediction residue $x_{m+3}$: Next-frame second-subframe logarithmic quantized prediction residue $x_B$: Logarithmic bias gain $\alpha_i$: i'th-order MA predictive coefficient Solving for $x_m$ and $x_{m+1}$ with an equation obtained by partially differentiating Equation (6) for $x_m$ to give 0 and an equation obtained by partially differentiating Equation (6) for $x_{m+1}$ to give 0 as simultaneous equations, Equation (7) and Equation (8) are obtained. As $\alpha_{00}$, $\beta_{01}$, $\beta_1$ through $\beta_M$, $\beta_{-1}$, $\beta_B$, $\beta'_{00}$, $\beta'_{01}$, $\beta'_1$ through $\beta'_M$, $\beta'_{-1}$, and $\beta'_B$ are found from $\alpha_0$ through $\alpha_M$, they are decided uniquely.

$$x_m = \beta_{01} x_{m+3} \beta_{00} x_{m+2} + \sum_{i=1}^{M} \beta_i x_{m-i} + \beta_{-1} y_{m-1} + \beta_0 x_B \quad \text{(Equation 7)}$$

$$x_{m+1} = \beta'_{01} x_{m+3} \beta'_{00} x_{m+2} + \sum_{i=1}^{M} \beta'_i x_{m-1} + \beta'_{-1} y_{m-1} + \beta'_0 x_B \quad \text{(Equation 8)}$$

Thus, when the next frame is received normally, current-frame logarithmic quantized prediction residue concealment processing is performed by means of weighted addition processing specifically for concealment processing using a logarithmic quantized prediction residue received in the past and a next-frame logarithmic quantized predict ion residue, and gain parameter decoding is performed using a concealed logarithmic quantized prediction residue, enabling higher concealment performance to be achieved than when a past decoded gain parameter is used after monotonic decay.

Also, by using a weighting coefficient set of Equation (7) and Equation (8) that minimizes Equation (6), decoded logarithmic gain parameters of an erased frame (two subframes) and a normal frame (two subframes) that is the next frame (two subframes) after the erased frame are guaranteed not to be greatly separated from a logarithmic gain parameter of the frame preceding the erased frame. Consequently, even if a decoded logarithmic gain parameter of the next frame (two subframes) is unknown, reception information (a logarithmic quantized prediction residue) of the next frame (two sub frames) can continue to be used effectively, and the risk of concealment being performed in the wrong direction (the risk of deviating greatly from a correct decoded gain parameter) can be kept to a minimum.

Embodiment 5

Figure 17:
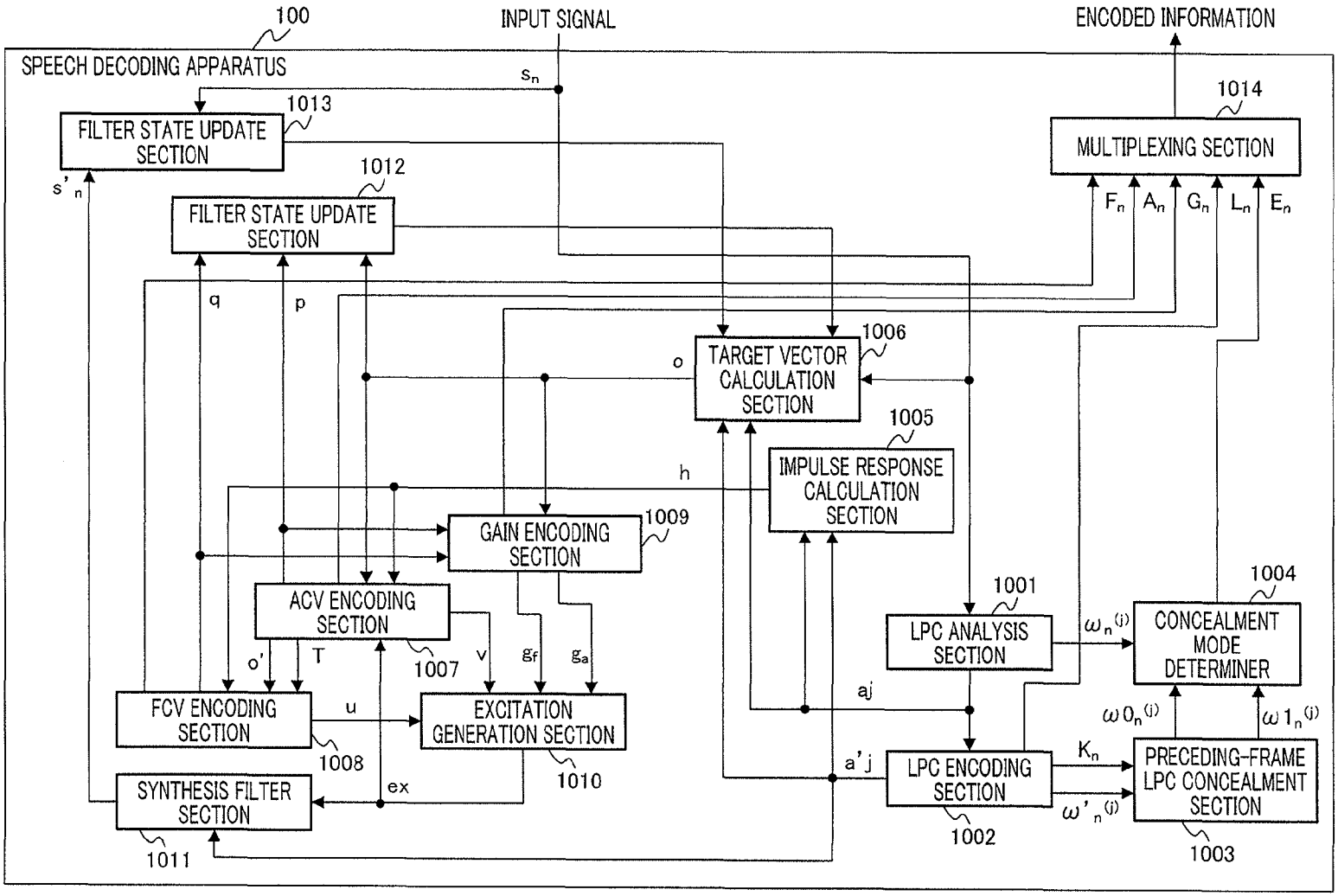
FIG. 17 is a block diagram showing the main configuration of a speech encoding apparatus according to Embodiment 5 of the present invention.

FIG. 17 is a block diagram showing the main configuration of a speech encoding apparatus according to Embodiment 5 of the present invention. FIG. 17 shows an example of encoding of concealment mode information $E_{n+1}$ to decide a weighting coefficient set by means of the second method described in Embodiment 3—that is, a method whereby (n−1)'th-frame concealment mode information is represented by one bit using n'th-frame MA predictive coefficient mode information.

In this case, preceding-frame LPC concealment section 1003 finds an (n−1)'th-frame concealment LSF as described using FIG. 13 by means of the weighted sum of the current-frame decoded quantized prediction residue and the decoded quantized prediction residues of two frames before through M+1 frames before. Whereas in FIG. 13 an n'th-frame concealment LSF was found using (n+1)'th-frame encoding information, here an (n−1)'th-frame concealment LSF is found using n'th-frame encoding information, and therefore the correspondence relationship is one of displacement by one frame number. That is to say, combinations of $\alpha_i^{(j)}$ and $\alpha'^{(j)}_i$ are limited to two out of four by n'th-frame (=current-frame) MA predictive coefficient code (that is, when the n'th-frame MA prediction mode is mode 0, a combination of (n−1)'th-frame and n'th-frame MA prediction modes is either (0-0) or (0-1), and therefore weighting coefficient β sets are limited to two kinds), and preceding-frame LPC concealment section 1003 generates two kinds of concealment LSF—$\omega 0_n^{(j)}$ and $\omega 1_n^{(j)}$—using these two kinds of weighting coefficient β sets.

Concealment mode determiner 1004 performs a mode decision based on which of $\omega 0_n^{(j)}$ and $\omega 1_n^{(j)}$ is closer to input LSF $\omega_n^{(j)}$. The degree of separation of $\omega 0_n^{(j)}$ and $\omega 1_n^{(j)}$ from $\omega_n^{(j)}$ may be based on simple Euclidian distance, or may be based on a weighted Euclidian distance such as used in ITU-T Recommendation G.729 LSF quantization.

The operation of each section of the speech encoding apparatus in FIG. 17 will now be described.

Input signal $s_n$ is input to LPC analysis section 1001, target vector calculation section 1006, and filter state update section 1013.

LPC analysis section 1001 performs heretofore known linear predictive analysis on input signal $s_n$, and outputs linear prediction coefficients $a_j$ (j=0 through M, where M is the order of linear predictive analysis; $a_0$=1.0) to impulse response calculation section 1005, target vector calculation section 1006, and LPC encoding section 1002. Also, LPC analysis section 1001 converts linear predictive coefficients $a_j$ to LSF parameter $\omega_n^{(j)}$, and outputs this to concealment mode determiner 1004.

LPC encoding section 1002 performs quantization and encoding of the input LPC (linear predictive coefficients), and outputs quantized linear predictive coefficients $a'_j$ to impulse response calculation section 1005, target vector calculation section 1006, and synthesis filter section 1011. In this example, LPC quantization and encoding are performed in the LSF parameter domain. Also, LPC encoding section 1002 outputs LPC encoding result $L_n$ to multiplexing section 1014, and outputs quantized prediction residue $x_n$, decoded quantized LSF parameter $\omega'^{(j)}_n$, and MA predictive quantization mode $K_n$ to preceding-frame LPC concealment section 1003.

Preceding-frame LPC concealment section 1003 holds n'th-frame decoded quantized LSF parameter $\omega'^{(j)}_n$ output from LPC encoding section 1002 in a buffer for the duration of two frames. The decoded quantized LSF parameter of two frames before is $\omega'^{(j)}_{n-2}$. Also, preceding-frame LPC concealment section 1003 holds n'th-frame decoded quantized prediction residue $x_n$ for the duration of M+1 frames. Furthermore, preceding-frame LPC concealment section 1003 generates (n−1)'th-frame de coded quantized LSF parameters $\omega 0_n^{(j)}$ and $\omega 1_n^{(j)}$ by means of the weighted sum of quantized prediction residue $x_n$, decoded quantized LSF parameter $\omega'^{(j)}_{n-2}$ of two frames before, and decoded quantized prediction residues $x_{n-2}$ through $x_{n-M-1}$ of two frames before through M+1 frames before, and outputs the result to concealment mode determiner 1004. Here, preceding-frame LPC concealment section 1003 is provided with four kinds of weighting coefficient sets when finding a weighted sum, but two of the four kinds are chosen according to whether MA predictive quantization mode information $K_n$ input from LPC encoding section 1002 is 0 or 1, and are used for $\omega 0_n^{(j)}$ and $\omega 1_n^{(j)}$ generation.

Concealment mode determiner 1004 determines which of the two kinds of concealment LSF parameters $\omega 0_n^{(j)}$ and $\omega 1_n^{(j)}$ output from preceding-frame LPC concealment section 1003 is closer to unquantized LSF parameter $\omega_n^{(j)}$ output from LPC analysis section 1001, and outputs code $E_n$ corresponding to a weighting coefficient set that generates the closer concealed LSF parameter to multiplexing section 1014.

Impulse response calculation section 1005 generates perceptual weighting synthesis filter impulse response h using unquantized linear predictive coefficients $a_j$ output from LPC analysis section 1001 and quantized linear predictive coefficients $a'_j$ output from LPC encoding section 1002, and outputs these to ACV encoding section 1007 and FCV encoding section 1008.

Target vector calculation section 1006 calculates target vector o (a signal in which a perceptual weighting synthesis filter zero input response has been subtracted from a signal resulting from applying a perceptual weighting filter to an input signal) from input signal $s_n$, unquantized linear predictive coefficients $a_j$ output from LPC analysis section 1001, and quantized linear predictive coefficients $a'_j$ output from LPC encoding section 1002, and outputs these to ACV encoding section 1007, gain encoding section 1009, and filter state update section 1012.

ACV encoding section 1007 has target vector o from target vector calculation section 1006, perceptual weighting synthesis filter impulse response h from impulse response calculation section 1005, and excitation signal ex from excitation generation section 1010, as input, performs an adaptive codebook search, and outputs resulting adaptive codebook code $A_n$ to multiplexing section 1014, quantized pitch lag T to FCV encoding section 1008, AC vector v to excitation generation section 1010, filtered AC vector contribution p in which convolution of perceptual weighting synthesis filter impulse response h has been performed on AC vector v to filter state update section 1012 and gain encoding section 1009, and target vector o' updated for fixed codebook search use to FCV encoding section 1008. Amore concrete search method is similar to that described in ITU-T Recommendation G.729 and so forth. Although omitted in FIG. 17, it is usual for the amount of computation necessary for an adaptive codebook search to be kept down by deciding a range in which a closed-loop pitch search is performed by means of an open-loop pitch search or the like.

FCV encoding section 1008 has fixed codebook target vector o' and quantized pitch lag T as input from ACV encoding section 1007, and perceptual weighting synthesis filter impulse response h as input from impulse response calculation section 1005, performs a fixed codebook search by means of a method such as described in ITU-T Recommendation G.729, for example, and outputs fixed codebook code $F_n$ to multiplexing section 1014, FC vector u to excitation generation section 1010, and filtered FC contribution q obtained by performing convolution of a perceptual weighting synthesis filter impulse response on FC vector u to filter state update section 1012 and gain encoding section 1009.

Gain encoding section 1009 has target vector o as input from target vector calculation section 1006, filtered AC vector contribution p as input from ACV encoding section 1007, and filtered FC vector contribution q as input from FCV encoding section 1008, and outputs a pair of ga and gf for which $|o-(ga\times p+gf\times q)|^2$ becomes a minimum to excitation generation section 1010 as quantized adaptive codebook gain and quantized fixed codebook gain.

Excitation generation section 1010 has adaptive codebook vector v as input from ACV encoding section 1007, fixed codebook vector u as input from FCV encoding section 1008, adaptive codebook vector gain ga and fixed codebook vector gain gf as input from gain encoding section 1009, calculates excitation vector ex as $ga\times v+gf\times u$, and outputs this to ACV encoding section 1007 and synthesis filter section 1011. Excitation vector ex output to ACV encoding section 1007 is used for updating ACB (past generated excitation vector buffer) in the ACV encoding section.

Synthesis filter section 1011 drives a linear predictive filter configured by means of quantized linear predictive coefficients $a'_j$ output from LPC encoding section 1002 by means of excitation vector ex output from excitation generation section 1010, generates local decoded speech signal $s'_n$, and outputs this to filter state update section 1013.

Filter state update section 1012 has synthesis adaptive codebook vector p as input from ACV encoding section 1007, synthesis fixed codebook vector q as input from FCV encoding section 1008, and target vector o as input from target vector calculation section 1006, generates a filter state of a perceptual weighting filter in target vector calculation section 1006, and outputs this to target vector calculation section 1006.

Filter state updating section 1013 calculates error between local decoded speech signal $s'_n$ input from synthesis filter section 1011 and input signal $s_n$, and outputs this to target vector calculation section 1006 as the state of the synthesis filter in target vector calculation section 1006.

Multiplexing section 1014 outputs encoding information in which codes $F_n$, $A_n$, $G_n$, $L_n$, and $E_n$ are multiplexed.

In this embodiment, an example has been shown in which error with respect to an unquantized LSF parameter is calculated only for an (n−1)'th-frame decoded quantized LSF parameter, but provision may also be made for a concealment mode to be decided taking error between an n'th-frame decoded quantized LSF parameter and n'th-frame unquantized LSF parameter into consideration.

Thus, according to a speech encoding apparatus of this embodiment, an optimal concealment processing weighting coefficient set is identified for concealment processing for a speech decoding apparatus of Embodiment 3, and that information is transmitted to the decoder side, enabling higher concealment performance to be obtained and decoded speech signal quality to be improved on the decoder side.

Embodiment 6

Figure 18:
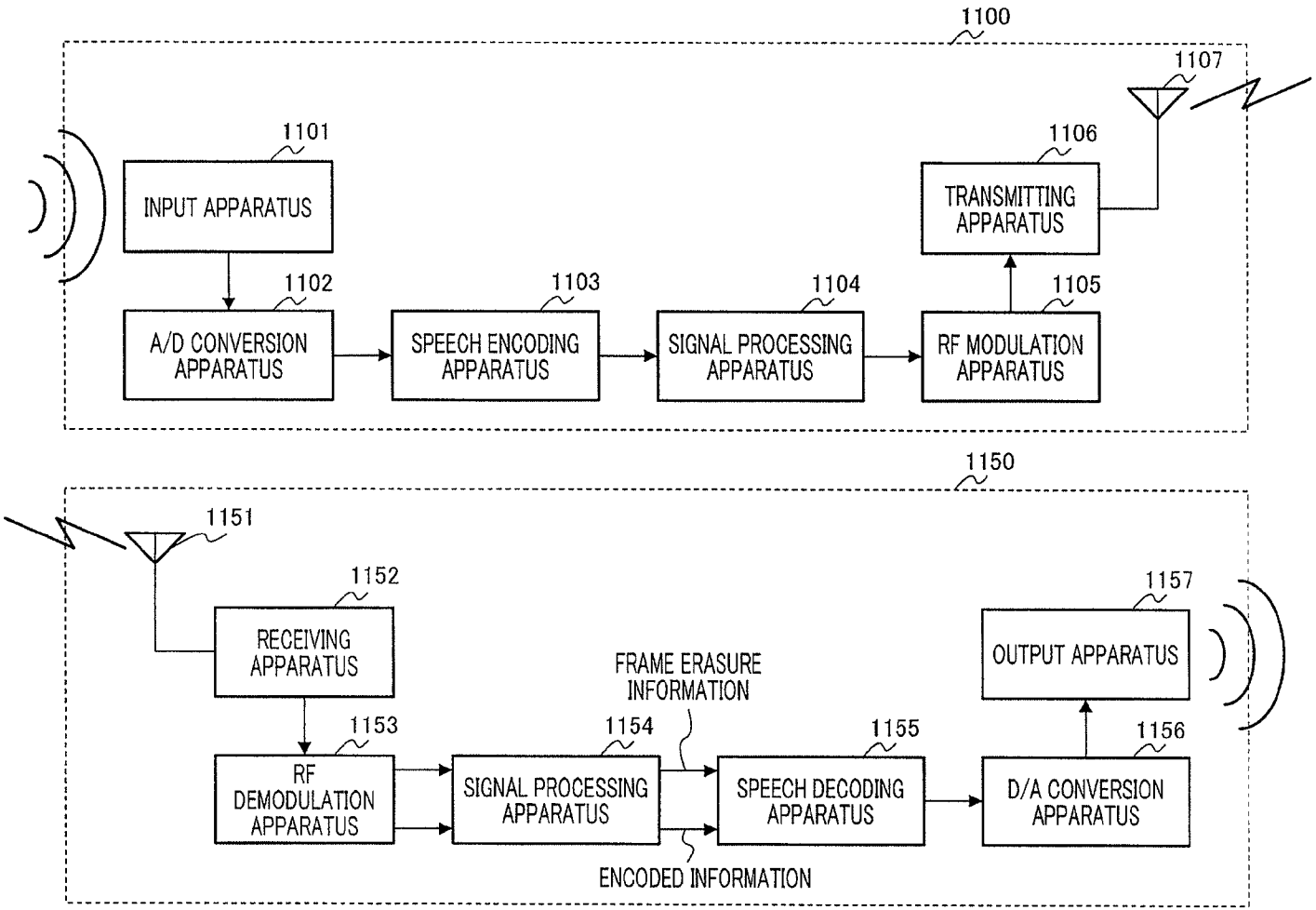
FIG. 18 is a block diagram showing the configuration of a speech signal transmitting apparatus and speech signal receiving apparatus configuring a speech signal transmission system according to Embodiment 6 of the present invention.

FIG. 18 is a block diagram showing the configuration of a speech signal transmitting apparatus and speech signal receiving apparatus configuring a speech signal transmission system according to Embodiment 6 of the present invention. The only difference from conventional system is that a speech encoding apparatus of Embodiment 5 is applied to a speech signal transmitting apparatus, and a speech decoding apparatus of any of Embodiments 1 through 3 is applied to a speech signal receiving apparatus.

Speech signal transmitting apparatus 1100 has input apparatus 1101, A/D conversion apparatus 1102, speech encoding apparatus 1103, signal processing apparatus 1104, RF modulation apparatus 1105, transmitting apparatus 1106, and antenna 1107.

An input terminal of A/D conversion apparatus 1102 is connected to input apparatus 1101. An input terminal of speech encoding apparatus 1103 is connected to an output terminal of A/D conversion apparatus 1102. An input terminal of signal processing apparatus 1104 is connected to an output terminal of speech encoding apparatus 1103. An input terminal of RF modulation apparatus 1105 is connected to an output terminal of signal processing apparatus 1104. An input terminal of transmitting apparatus 1106 is connected to an output terminal of RF modulation apparatus 1105. Antenna 1107 is connected to an output terminal of transmitting apparatus 1106.

Input apparatus 1101 receives a speech signal, converts this to an analog speech signal that is an electrical signal, and provides this signal to A/D conversion apparatus 1102. A/D conversion apparatus 1102 converts the analog speech signal from input apparatus 1101 to a digital speech signal, and provides this signal to speech encoding apparatus 1103. Speech encoding apparatus 1103 encodes the digital speech signal from A/D conversion apparatus 1102 and generates a speech encoded bit stream, and provides this bit stream to signal processing apparatus 1104. Signal processing apparatus 1104 performs channel encoding processing, packetization processing, transmission buffer processing, and so forth on the speech encoded bit stream from speech encoding apparatus 1103, and then provides that speech encoded bit stream to RF modulation apparatus 1105. RF modulation apparatus 1105 modulates the speech encoded bit stream signal from signal processing apparatus 1104 on which channel encoding processing and so forth has been performed, and provides the signal to transmitting apparatus 1106. Transmitting apparatus 1106 transmits the modulated speech encoded bit stream from RF modulation apparatus 1105 as a radio wave (RF signal) via antenna 1107.

In speech signal transmitting apparatus 1100, processing is performed on a digital speech signal obtained via A/D conversion apparatus 1102 in frame units of several tens of ms. If a network configuring a system is a packet network, one frame or several frames of encoded data are put into one packet, and this packet is transmitted to the packet network. If the network is a circuit switched network, packetization processing and transmission buffer processing are unnecessary.

Speech signal receiving apparatus 1150 has antenna 1151, receiving apparatus 1152, RF demodulation apparatus 1153, signal processing apparatus 1154, speech decoding apparatus 1155, D/A conversion apparatus 1156, and output apparatus 1157.

An input terminal of receiving apparatus 1152 is connected to antenna 1151. An input terminal of RF demodulation apparatus 1153 is connected to an output terminal of receiving apparatus 1152. Two input terminals of signal processing apparatus 1154 are connected to two output terminals of RF demodulation apparatus 1153. Two input terminals of speech decoding apparatus 1155 are connected to two output terminals of signal processing apparatus 1154. An input terminal of D/A conversion apparatus 1156 is connected to an output terminal of speech decoding apparatus 1155. An input terminal of output apparatus 1157 is connected to an output terminal of D/A conversion apparatus 1156.

Receiving apparatus 1152 receives a radio wave (RF signal) including speech encoded information via antenna 1151 and generates a received speech encoded signal that is an analog electrical signal, and provides this signal to RF demodulation apparatus 1153. If there is no signal attenuation or noise superimposition in the transmission path, the radio wave (RF signal) received via the antenna is exactly the same as the radio wave (RF signal) transmitted by the speech signal transmitting apparatus.

RF demodulation apparatus 1153 demodulates the received speech encoded signal from receiving apparatus 1152, and provides this signal to signal processing apparatus 1154. RF demodulation apparatus 1153 also separately provides signal processing apparatus 1154 with information as to whether or not the received speech encoded signal has been able to be demodulated normally. Signal processing apparatus 1154 performs jitter absorption buffering processing, packet assembly processing, channel decoding processing, and so forth on the received speech encoded signal from RF demodulation apparatus 1153, and provides a received speech encoded bit stream to speech decoding apparatus 1155. Also, information as to whether or not the received speech encoded signal has been able to be demodulated normally is input from RF demodulation apparatus 1153, and if the information input from RF demodulation apparatus 1153 indicates that "demodulation has not been able to be performed normally", or if packet assembly processing or the like in the signal processing apparatus has not been able to be performed normally and the received speech encoded bit stream has not been able to be decoded normally, the occurrence of frame erasure is conveyed to speech decoding apparatus 1155 as frame erasure information. Speech decoding apparatus 1155 performs decoding processing on the received speech encoded bit stream from signal processing apparatus 1154 and generates a decoded speech signal, and provides this signal to D/A conversion apparatus 1156. Speech decoding apparatus 1155 decides whether to perform normal decoding processing or to perform decoding processing by means of frame erasure concealment processing in accordance with frame erasure information input in parallel with the received speech encoded bit string. D/A conversion apparatus 1156 converts the digital decoded speech signal from speech decoding apparatus 1155 to an analog decoded speech signal, and provides this signal to output apparatus 1157. Output apparatus 1157 converts the analog decoded speech signal from D/A conversion apparatus 1156 to vibrations of the air, and outputs these as a sound wave audible to the human ear.

Thus, by providing a speech encoding apparatus and speech decoding apparatus shown in Embodiments 1 through 5, a decoded speech signal of better quality than heretofore can be obtained even if a transmission path error (in particular, a frame erasure error typified by a packet loss) occurs.

Embodiment 7

In above Embodiments 1 through 6, cases have been described in which an MA type is used as a prediction model, but the present invention is not limited to this, and an AR type can also be used as a prediction model. In Embodiment 7, a case will be described in which an AR type is used as a prediction model. With the exception of the internal configuration of the LPC decoding section, the configuration of a speech decoding apparatus according to Embodiment 7 is identical to that in FIG. 1.

Figure 19:
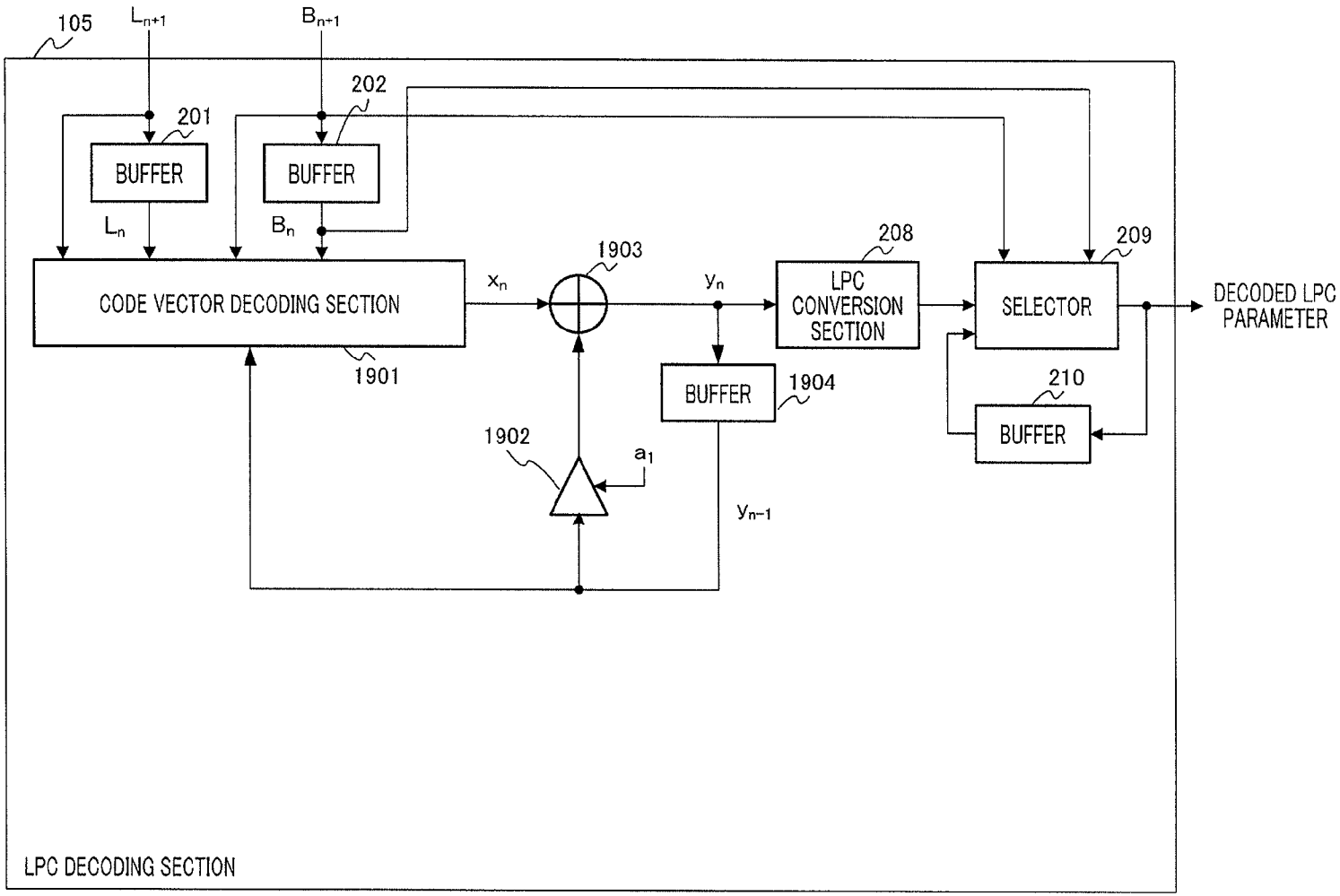
FIG. 19 is a drawing showing the internal configuration of an LPC decoding section of a speech decoding apparatus according to Embodiment 7 of the present invention.

FIG. 19 is a drawing showing the internal configuration of LPC decoding section 105 of a speech decoding apparatus according to this embodiment. Configuration parts in FIG. 19 common to FIG. 2 are assigned the same reference codes as in FIG. 2, and detailed descriptions thereof are omitted here.

LPC decoding section 105 shown in FIG. 19 employs a configuration in which, in comparison with FIG. 2, parts relating to prediction (buffers 204, amplifiers 205, and adder 206) and parts relating to frame erasure concealment (code vector decoding section 203 and buffer 207) have been eliminated, and configuration parts replacing these (code vector decoding section 1901, amplifier 1902, adder 1903, and buffer 1904) have been added.

LPC code $L_{n+1}$ is input to buffer 201 and code vector decoding section 1901, and frame erasure code $B_{n+1}$ is input to buffer 202, code vector decoding section 1901, and selector 209.

Buffer 201 holds next-frame LPC code $L_{n+1}$ for the duration of one frame, and then outputs this LPC code to code vector decoding section 1901. As a result of being held in buffer 201 for the duration of one frame, the LPC code output from buffer 201 to code vector decoding section 1901 is current-frame LPC code $L_n$.

Buffer 202 holds next-frame frame erasure code $B_{n+1}$ for the duration of one frame, and then outputs this frame erasure code to code vector decoding section 1901. As a result of being held in buffer 202 for the duration of one frame, the frame erasure code output from buffer 202 to code vector decoding section 1901 is current-frame frame erasure code $B_n$.

Code vector decoding section 1901 has decoded LSF vector $y_{n-1}$ of one frame before, next-frame LPC code $L_{n+1}$, next-frame frame erasure code $B_{n+1}$, current-frame LPC code $L_n$, and current-frame frame erasure code $B_n$, as input, generates current-frame quantized prediction residual vector $x_n$ based on these items of information, and outputs current-frame quantized prediction residual vector $x_n$ to adder 1903. Details of code vector decoding section 1901 will be given later herein.

Amplifier 1902 multiplies next-frame decoded LSF vector $y_{n-1}$ by predetermined MA predictive coefficient and outputs the result to adder 1903.

Adder 1903 calculates the sum the predictive LSF vector output from amplifier 1902 (that is, the result of multiplying the preceding-frame decoded LSF vector by an AR predictive coefficient) and current-frame quantized prediction residual vector $x_n$, and outputs the multiplication result, decoded LSF vector $y_n$, to buffer 1904 and LPC conversion section 208.

Buffer 1904 holds decoded LSF vector $y_n$ for the duration of one frame, and then outputs this decoded LSF vector to code vector decoding section 1901 and amplifier 1902. As a result of being held in buffer 1904 for the duration of one frame, the decoded LSF vector input to code vector decoding section 1901 and amplifier 1902 is decoded LSF vector $y_{n-1}$ of one frame before.

If selector 209 selects a decoded LPC parameter in the preceding frame output from buffer 210, it is not actually necessary to perform all the processing from code vector decoding section 1901 through LPC conversion section 208.

Figure 20:
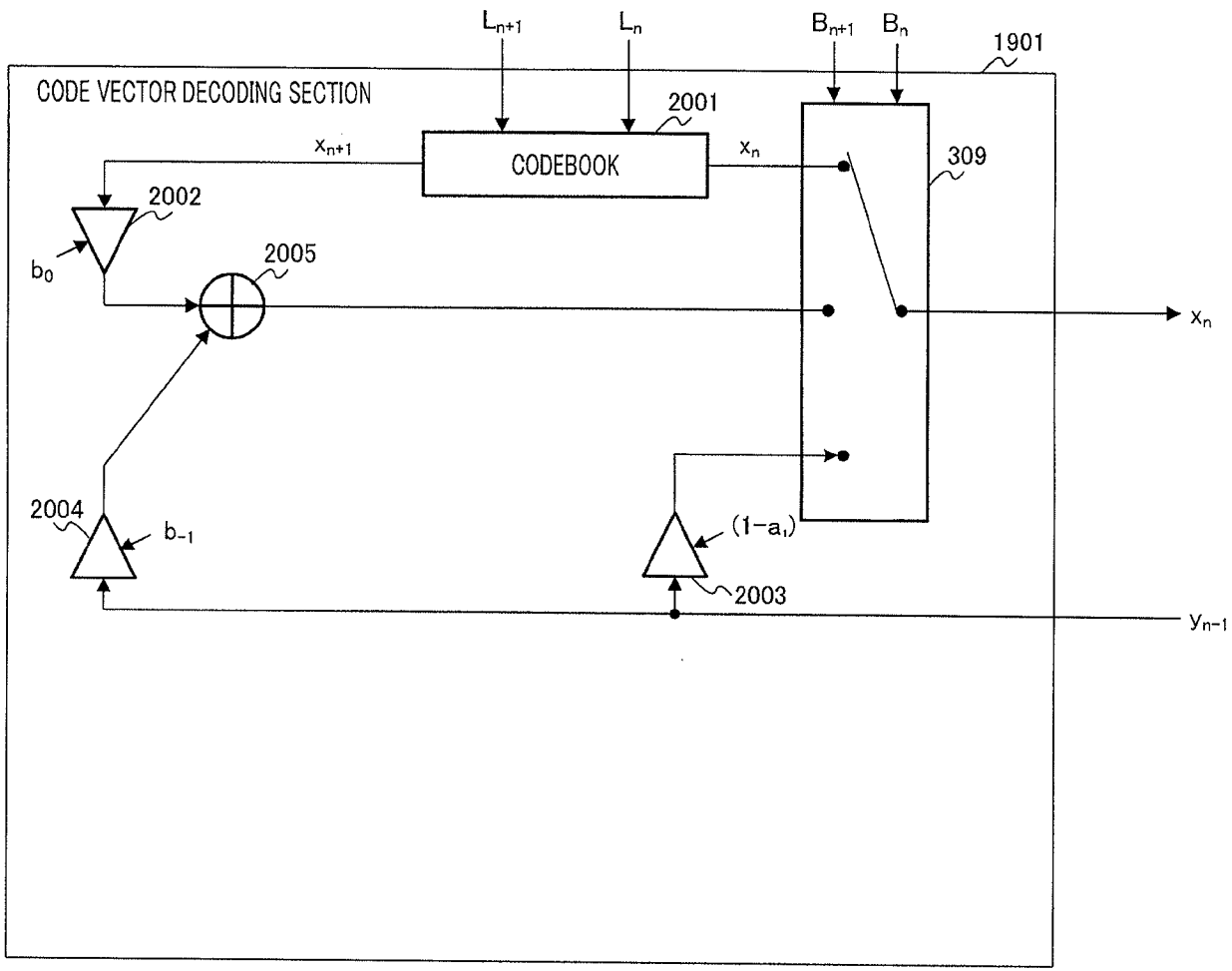
FIG. 20 is a drawing showing the internal configuration of the code vector decoding section in FIG. 19.

Next, the internal configuration of code vector decoding section 1901 in FIG. 19 will be described in detail using the block diagram in FIG. 20.

Codebook 2001 generates a code vector identified by current-frame LPC code $L_n$ and outputs this to switch 309, and also generates a code vector identified by next-frame LPC code $L_{n+1}$ and outputs this to amplifier 2002. Also, a codebook may have a multi-stage configuration and May have a split configuration.

Amplifier 2002 multiplies code vector xn+1 output from codebook 2001 by weighting coefficient $b_0$, and outputs the result to adder 2005.

Amplifier 2003 performs processing to find a quantized prediction residual vector in the current frame necessary for a preceding-frame decoded LSF vector to be generated. That is to say, amplifier 2003 calculates current-frame vector $x_n$ so that preceding-frame decoded LSF vector $y_{n-1}$ becomes current-frame decoded LSF vector $y_n$. Specifically, amplifier 2003 multiplies input preceding-frame decoded LSF vector $y_{n-1}$ by coefficient $(1-a_1)$. Then amplifier 2003 outputs the result of this calculation to switch 309.

Amplifier 2004 multiplies input preceding-frame decoded LSF vector $y_{n-1}$ by weighting coefficient $b_{-1}$, and outputs the result to adder 2005.

Adder 2005 calculates the sum of the vectors output from amplifier 2002 and amplifier 2004, and outputs a code vector that is the result of this calculation to switch 309. That is to say, adder 2005 calculates current-frame vector $x_n$ by performing weighted addition of a code vector identified by next-frame LPC code $L_{n+1}$ and the preceding-frame decoded LSF vector.

If current-frame frame erasure code $B_n$ indicates that "the n'th frame is a normal frame", switch 309 selects a code vector output from codebook 2001, and outputs this as current-frame quantized prediction residual vector $x_n$. On the other hand, if current-frame frame erasure code $B_n$ indicates that "the n'th frame is an erased frame", switch 309 further selects a vector to be output according to which information next-frame frame erasure code $B_{n+1}$ has.

That is to say, if next-frame frame erasure code $B_{n+1}$ indicates that "the (n+1)'th frame is an erased frame", switch 309 selects a vector output from coding apparatus 2003, and outputs this as current-frame quantized prediction residual vector $x_n$. In this case, processing for the vector generation process from codebook 2001 and amplifiers 2002 and 2004 through adder 2005 need not be performed. Also, in this case, since $y_{n-1}$ may be used as $y_n$, $x_n$ need not necessarily be generated by amplifier 2003 processing.

On the other hand, if next-frame frame erasure code $B_{n+1}$ indicates that "the (n+1)'th frame is a normal frame", switch 309 selects a vector output from adder 2005, and outputs this as current-frame quantized prediction residual vector $x_n$. In this case, amplifier 2003 processing need not be performed.

In the concealment processing of this embodiment, weighting coefficients $b_{-1}$ and $b_0$ are decided so that sum D (where D is as shown in Equation (9) below) of the distance between (n−1)'th-frame decoded parameter $y_{n-1}$ and n'th-frame decoded parameter $y_n$ and the distance between n'th-frame decoded parameter $y_n$ and (n+1)'th-frame decoded parameter $y_{n+1}$ becomes small, so that fluctuation between decoded parameter frames becomes moderate.

$$\begin{aligned} D &= |y_{n+1} - y_n|^2 + |y_n - y_{n-1}|^2 \\ &= |x_{n+1} + a_1 y_n - x_n - a_1 y_{n-1}|^2 + \\ &\quad |x_n + a_1 y_{n-1} - y_{n-1}|^2 \\ &= |x_{n+1} + a_1(x_n + a_1 y_{n-1}) - x_n - a_1 y_{n-1}|^2 + \\ &\quad |x_n + (a_1 - 1) y_{n-1}|^2 \end{aligned} \quad \text{(Equation 9)}$$

An example of a method of deciding weighting coefficients $b_{-1}$ and $b_0$ is shown below. In order to minimize D in Equation (9), Equation (10) below is solved for decoded quantized prediction residual vector $x_n$ of an erased n'th frame. As a result, $x_n$ can be found by means of Equation (11) below. If predictive coefficients differ at each order, Equation (9) is replaced by Equation (12). Here, $a_1$ represents an AR predictive coefficient and $a_1^{(j)}$ represents the j'th element of an AR predictive coefficient set (that is, a coefficient multiplied by $y_{n-1}^{(j)}$, the j'th element of preceding-frame decoded LSF parameter $y_{n-1}$).

$$\begin{aligned} &\frac{\partial D}{\partial x_n} 2(a_1^2 - 2a_{1+2})x_n + \\ &\quad 2\{a_1(a_1^2 + a_1' + 2) - 1\}y_{n-1} + 2(a_1 - 1)x_{n+1} = 0 \end{aligned} \quad \text{(Equation 10)}$$

$$\begin{aligned} x_n &= b_0 x_{n+1} + b_{-1} y_{n-1} \\ b_0 &= (1 - a_1)(a_1^2 - 2a_1 + 2)^{-1} \\ b_{-1} &= (a_1^2 - 2a_1 + 2)^{-1} - a_1 \end{aligned} \quad \text{(Equation 11)}$$

$$\begin{aligned} D^{(j)} &= \left|y_n^{(j)} - y_{n-1}^{(j)}\right|^2 + \left|y_{n+1}^{(j)} - y_n^{(j)}\right|^2 \\ y_n^{(j)} &= a_1^{(j)} y_{n-1}^{(j)} + x_n^{(j)} \\ y_{n+1}^{(j)} &= a_1^{(j)} y_n^{(j)} + x_{n+1}^{(j)} \\ x_n^{(j)} &= b_0^{(j)} x_{n+1}^{(j)} + b_{-1}^{(j)} y_{n-1}^{(j)} (12) \\ b_0^{(j)} &= \left(1 - a_1^{(j)}\right)\left(\left(a_1^{(j)}\right)^2 - 2a_1'^{(j)} + 2\right)^{-1} \\ b_{-1}^{(j)} &= \left(\left(a_1^{(j)}\right)^2 - 2a_1^{(j)} + 2\right)^{-1} - a_1^{(j)} \end{aligned} \quad \text{(Equation 12)}$$

Terms x, y, and a in the above equations are as follows.

$x_n^{(j)}$: Quantized prediction residue of j'th component of LSF parameter in n'th-frame $y_n^{(j)}$: j'th component of decoded LSF parameter in n'th-frame $a_1^{(j)}$: j'th component of AR predictive coefficient set Thus, according to this embodiment that uses an AR type as a prediction model, when the current frame is erased, if the next frame is received normally current-frame LSF parameter decoded quantized prediction residue concealment processing is performed by means of weighted addition processing (weighted linear sum processing) specifically for concealment processing using a parameter decoded in the past and a next-frame a quantized prediction residue, and LSF parameter decoding is performed using a concealed quantized prediction residue. By this means, higher concealment performance can be achieved than by repeated use of past decoded LSF parameters.

It is also possible for the contents described in Embodiments 2 through 4 to be applied to an embodiment that uses an AR type, in which case, also, the same kind of effects as described above can be obtained.

Embodiment 8

In above Embodiment 7, a case has been described in which there is only one kind of predictive coefficient set, but the present invention is not limited to this and can also be applied to a case in which there are a plurality of kinds of predictive coefficient sets, in the same way as in Embodiments 2 and 3. In Embodiment 8, an example of a case will be described in which an AR type for which there are a plurality of kinds of predictive coefficient sets is used.

Figure 21:
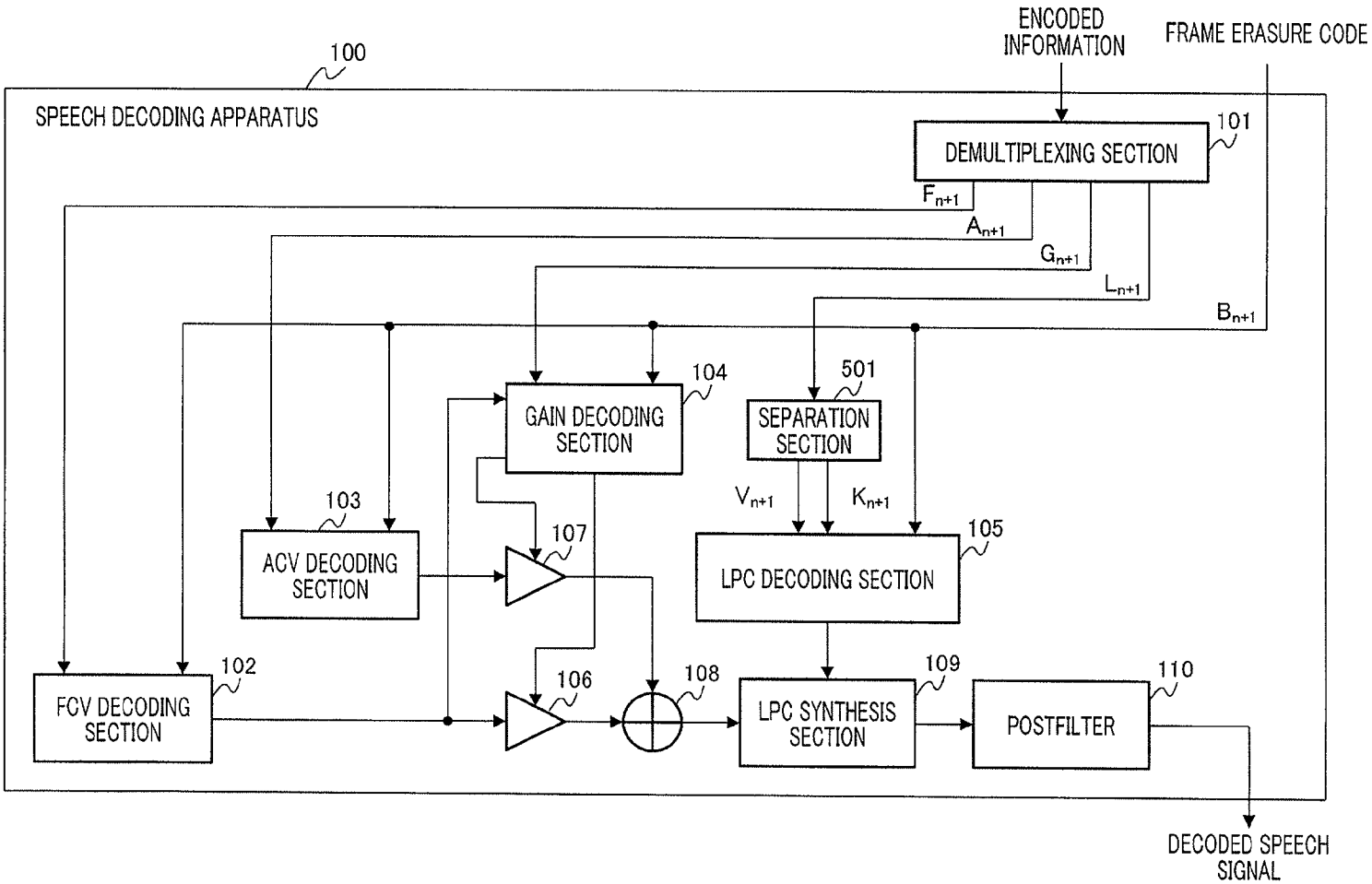
FIG. 21 is a block diagram showing the main configuration of a speech decoding apparatus according to Embodiment 8 of the present invention.

FIG. 21 is a block diagram of a speech decoding apparatus according to this embodiment. Except for a difference in the internal configuration of the LPC decoding section and the absence of a concealment mode information $E_{n+1}$ input line from demultiplexing section 101 to LPC decoding section 105, the configuration of speech decoding apparatus 100 shown in FIG. 21 is identical to that in FIG. 11.

Figure 22:
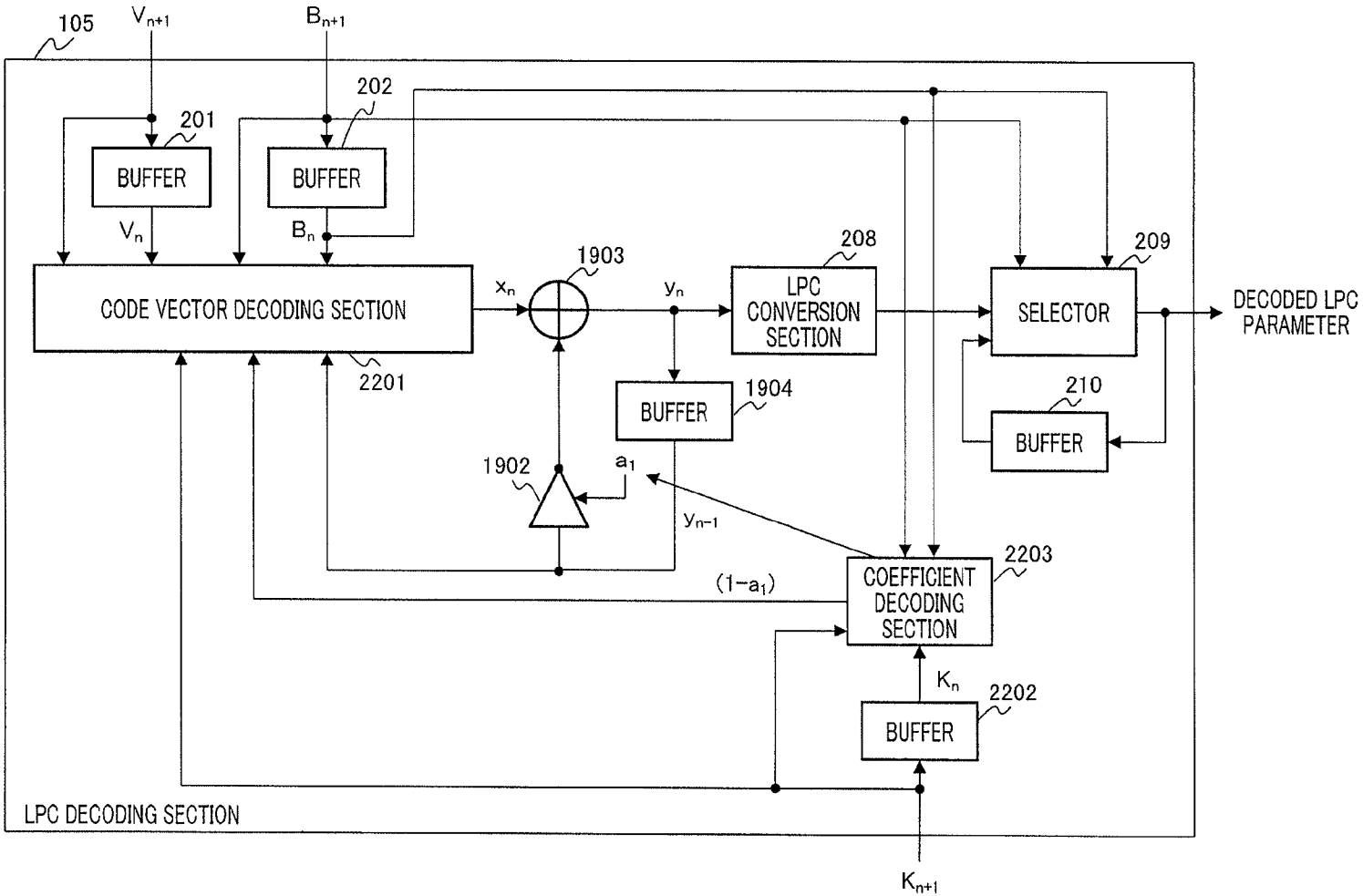
FIG. 22 is a drawing showing the internal configuration of an LPC decoding section of a speech decoding apparatus according to Embodiment 8 of the present invention.

FIG. 22 is a drawing showing the internal configuration of LPC decoding section 105 of a speech decoding apparatus according to this embodiment. Configuration parts in FIG. 22 common to FIG. 19 are assigned the same reference codes as in FIG. 19, and detailed descriptions thereof are omitted here.

LPC decoding section 105 shown in FIG. 22 employs a configuration in which, in comparison with FIG. 19, buffer 2202 and coefficient decoding section 2203 have been added. Also, the operation and internal configuration of code vector decoding section 2201 in FIG. 22 differ from those of code vector decoding section 1901 in FIG. 19.

LPC code $V_{n+1}$ is input to buffer 201 and code vector decoding section 2201, and frame erasure code $B_{n+1}$ is input to buffer 202, code vector decoding section 2201, and selector 209.

Buffer 201 holds next-frame LPC code $V_{n+1}$ for the duration of one frame, and then outputs this LPC code to code vector decoding section 2201. As a result of being held in buffer 201 for the duration of one frame, the LPC code output from buffer 201 to code vector decoding section 2201 is current-frame LPC code $V_n$. Also, buffer 202 holds next-frame frame erasure code $B_{n+1}$ for the duration of one frame, and then outputs this frame erasure code to code vector decoding section 2201.

Code vector decoding section 2201 has decoded LSF vector $y_{n-1}$ of one frame before, next-frame LPC code $V_{n+1}$, next-frame frame erasure code $B_{n+i}$, current-frame LPC code next-frame predictive coefficient code $K_{n+1}$, and current-frame frame erasure code $B_n$, as input, generates current-frame quantized prediction residual vector $x_n$ based on these items of information, and outputs current-frame quantized prediction residual vector $x_n$ to adder 1903. Details of code vector decoding section 2201 will be given later herein.

Buffer 2202 holds AR predictive coefficient code $K_{n+i}$ for the duration of one frame, and then outputs this AR predictive coefficient code to coefficient decoding section 2203. As a result, the AR predictive coefficient code output from buffer 2202 to coefficient decoding section 2203 is AR predictive coefficient code $K_n$ of one frame before.

Coefficient decoding section 2203 stores a plurality of kinds of coefficient sets, and identifies a coefficient set by means of frame erasure codes $B_n$ and $B_{n+1}$ and AR predictive coefficient codes $K_n$ and $K_{n+1}$. Here, there are three ways in which coefficient set identification can be performed in coefficient decoding section 2203, as follows.

If input frame erasure code $B_n$ indicates that "the n'th frame is a normal frame", coefficient decoding section 2203 selects a coefficient set specified by AR predictive coefficient code $K_n$.

If input frame erasure code $B_n$ indicates that "the n'th frame is an erased frame" and frame erasure code $B_{n+1}$ indicates that "the (n+1)'th frame is a normal frame", coefficient decoding section 2203 decides a coefficient set to be selected using AR predictive coefficient code $K_{n+1}$ received as an (n+1)'th-frame parameter. That is to say, $K_{n+1}$ is used directly instead of AR predictive coefficient code $K_n$. Alternatively, provision may be made for a coefficient set to be used in this kind of case to be decided beforehand, and for this previously decided coefficient set to be used without regard to $K_{n+1}$.

If input frame erasure code $B_n$ indicates that "the n'th frame is an erased frame" and frame erasure code $B_{n+1}$ indicates that "the (n+1)'th frame is an erased frame", the only information that can be used is information of the coefficient set used by the preceding frame, and therefore coefficient decoding section 2203 repeatedly uses the coefficient set used by the preceding frame. Alternatively, provision may be made for a coefficient set of a mode decided beforehand to be used in a fixed manner.

Then coefficient decoding section 2203 outputs AR predictive coefficient $a_1$ to amplifier 1902, and outputs AR predictive coefficient $(1-a_1)$ to code vector decoding section 2201.

Amplifier 1902 multiplies preceding-frame decoded LSF vector $y_{n-1}$ by AR predictive coefficient $a_1$ input from coefficient decoding section 2203, and outputs the result to adder 1903.

Figure 23:
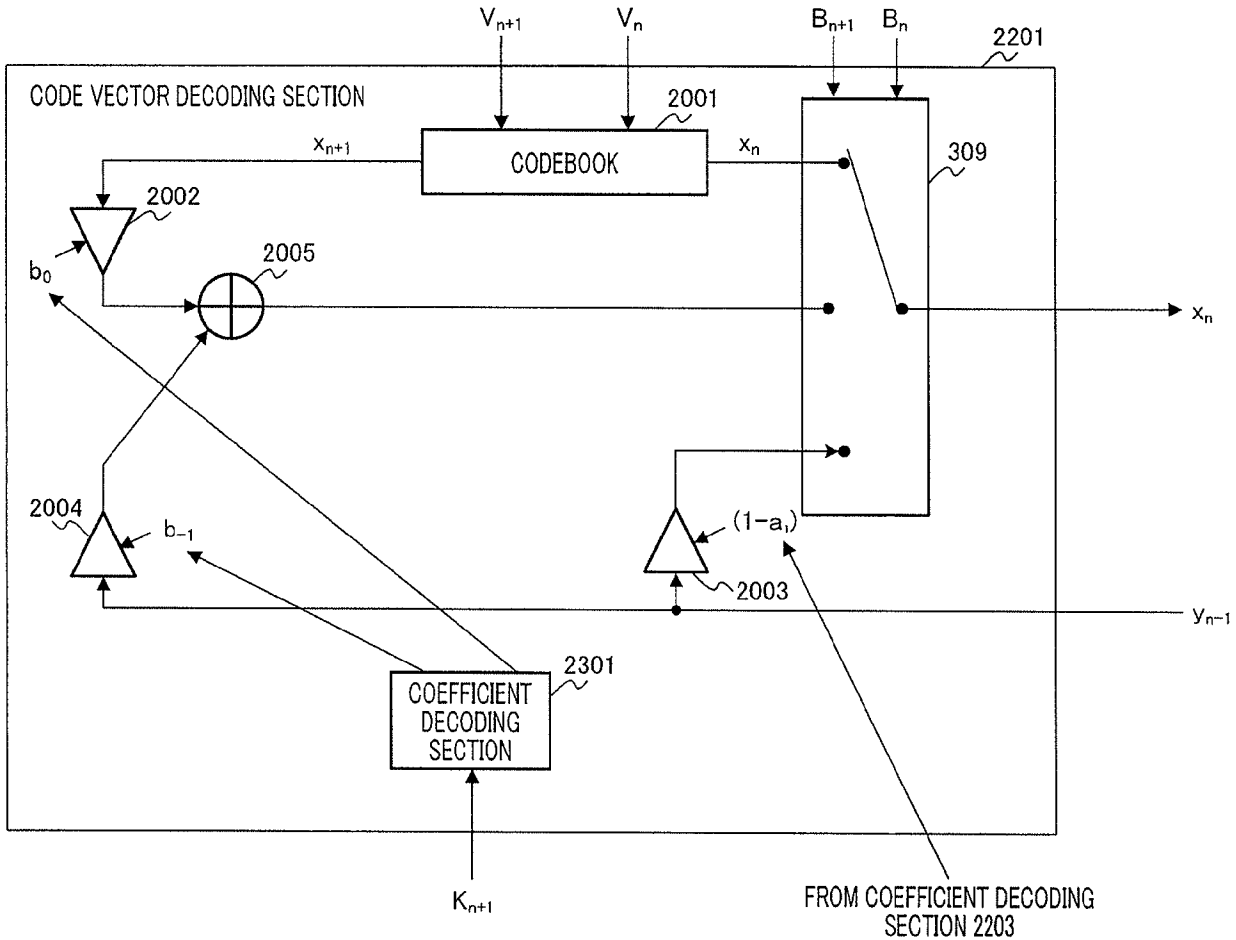
FIG. 23 is a drawing showing the internal configuration of the code vector decoding section in FIG. 22.

Next, the internal configuration of code vector decoding section 2201 in FIG. 22 will be described in detail using the block diagram in FIG. 23. Configuration parts in FIG. 23 common to FIG. 20 are assigned the same reference codes as in FIG. 20, and detailed descriptions thereof are omitted here. Code vector decoding section 2201 in FIG. 23 employs a configuration in which coefficient decoding section 2301 has been added to code vector decoding section 1901 in FIG. 20.

Coefficient decoding section 2301 stores a plurality of kinds of coefficient sets, identifies a coefficient set by means of AR predictive coefficient code $K_{n+1}$, and outputs this to amplifiers 2002 and 2004. It is also possible for a coefficient set used here to be calculated using AR predictive coefficient $a_1$ output from coefficient decoding section 2203, in which case it is not necessary to store coefficient sets, and calculation can be performed after inputting AR predictive coefficient $a_1$. Details of the calculation method will be given later herein.

Codebook 2001 generates a code vector identified by current-frame LPC code $V_n$ and outputs this to switch 309, and also generates a code vector identified by next-frame LPC code $V_{n+1}$ and outputs this to amplifier 2002. Also, a codebook may have a multi-stage configuration and may have a split configuration.

Amplifier 2002 multiplies code vector xn+1 output from codebook 2001 by weighting coefficient $b_0$, and outputs the result to adder 2005.

Amplifier 2003 multiplies AR predictive coefficient $(1-a_1)$ output from coefficient decoding section 2203 by preceding-frame decoded LSF vector $y_{n-1}$, and outputs the result to switch 309. In terms of implementation, if this kind of path is not created and a switching configuration is provided such that buffer 1904 output is changed to adder 1903 output and input to LPC conversion section 208 instead of performing amplifier 2003, amplifier 1902, and adder 1903 processing, a path via amplifier 2003 is unnecessary.

Amplifier 2004 multiplies input preceding-frame decoded LSF vector $y_{n-1}$ by weighting coefficient $b_{-1}$ output from coefficient decoding section 2301, and outputs the result to adder 2005.

In the concealment processing of this embodiment, weighting coefficients $b_{-1}$ and $b_0$ are decided so that sum D (where D is as shown in Equation (13) below) of the distance between (n−1)'th-frame decoded parameter $y_{n-1}$ and n'th-frame decoded parameter $y_n$ and the distance between n'th-frame decoded parameter $y_n$ and (n+1)'th-frame decoded parameter $y_{n+1}$ becomes small, so that fluctuation between de coded parameter frames becomes moderate.

$$\begin{aligned} D &= |y_{n+1} - y_n|^2 + |y_n - y_{n-1}|^2 \\ &= |x_{n+1} + a_1' y_n - x_n - a_1 y_{n-1}|^2 + \\ &\quad |x_n + a_1 y_{n-1} - y_{n-1}|^2 \\ &= |x_{n+1} + a_1'(x_n + a_1 y_{n-1}) - x_n - a_1 y_{n-1}|^2 + \\ &\quad |x_n + (a_1 - 1) y_{n-1}|^2 \end{aligned} \quad \text{(Equation 13)}$$

An example of a method of deciding weighting coefficients $b^{-1}$ and $b_0$ is shown below. In order to minimize D in Equation (13), Equation (14) below is solved for decoded quantized prediction residual vector $x_n$ of an erased n'th frame. As a result, $x_n$ can be found by means of Equation (15) below. If predictive coefficients differ at each order, Equation (13) is replaced by Equation (16). Here, $a'_1$ represents an AR predictive coefficient in the (n+1)'th-frame, $a_1$ represents an AR predictive coefficient in the n'th-frame, and $a_1^{(j)}$ represents the j'th element of an AR predictive coefficient set (that is, a coefficient multiplied by $y_{n-1}^{(j)}$, the j'th element of preceding-frame decoded LSF parameter $y_{n-1}$).

$$\begin{aligned} &\frac{\partial D}{\partial x_n} 2(a_1'^2 - 2a_{1'+2})x_n + \\ &\qquad 2\{a_1(a_1'^2 + a_1' + 2) - 1\}y_{n-1} + 2(a_1 - 1)x_{n+1} = 0 \end{aligned} \quad \text{(Equation 14)}$$

$$\begin{aligned} x_n &= b_0 x_{n+1} + b_{-1} y_{n-1} \\ b_0 &= (1 - a_1')(a_1'^2 - 2a_1' + 2)^{-1} \\ b_{-1} &= (a_1'^2 - 2a_1' + 2)^{-1} - a_1 \end{aligned} \quad \text{(Equation 15)}$$

$$\begin{aligned} D^{(j)} &= \left|y_n^{(j)} - y_{n-1}^{(j)}\right|^2 + \left|y_{n+1}^{(j)} - y_n^{(j)}\right|^2 \\ y_n^{(j)} &= a_1^{(j)} y_{n-1}^{(j)} + x_n^{(j)} \\ y_{n+1}^{(j)} &= a_1'^{(j)} y_n^{(j)} + x_{n+1}^{(j)} \\ x_n^{(j)} &= b_0^{(j)} x_{n+1}^{(j)} + b_{-1}^{(j)} y_{n-1}^{(j)} (12) \\ b_0^{(j)} &= \left(1 - a_1'^{(j)}\right)\left(\left(a_1'^{(j)}\right)^2 - 2a_1'^{(j)} + 2\right)^{-1} \\ b_{-1}^{(j)} &= \left(\left(a_1'^{(j)}\right)^2 - 2a_1'^{(j)} + 2\right)^{-1} - a_1^{(j)} \end{aligned} \quad \text{(Equation 16)}$$

Terms x, y, and a in the above equations are as follows.

$x_n^{(j)}$: Quantized prediction residue of j'th component of LSF parameter in n'th-frame $y_n^{(j)}$: j'th component of decoded LSF parameter in n'th-frame $a_1^{(j)}$: j'th component of AR predictive coefficient set of n'th-frame $a'_1^{(j)}$: j'th component of AR predictive coefficient set of (n+1)'th-frame Here, if the n'th-frame is an erased frame, the predictive coefficient set of the n'th-frame is unknown. There are a number of possible methods of deciding $a_1$. First, there is a method whereby $a_1$ is sent as additional information in the (n+1)'th-frame. However, an additional bit is necessary, and modification is also necessary on the encoder side. Then there is a method whereby the predictive coefficient used by the (n−1)'th-frame is used, and there is also a method whereby a predictive coefficient set received in the (n+1)'th-frame is used. In this case, $a_1=a'_1$. Furthermore, there is a method whereby a specific predictive coefficient set is always used. However, as described later herein, even if different $a_1$ is used here, decoded $y_n$'s will be equal by performing AR prediction using the same $a_1$. In the case of predictive quantization using AR prediction, quantized prediction residue $x_n$ is not related to prediction, and only decoded quantized parameter $y_n$ is related to prediction, and therefore $a_1$ may be an arbitrary value in this case.

If $a_1$ is decided, $b_0$ and $b_1$ can be decided from Equation (15) or Equation (16), and code vector $x_n$ of the erased frame can be generated.

If erasure-frame code vector $x_n$ obtained by means of above Equation (16) is substituted in an equation representing $y_n$ ($y_n=a_1y_{n-1}+x_n$), the result is as shown in Equation (17) below. Therefore, a decoded parameter in an erased frame generated by concealment processing can be found directly from $x_{n+i}$, $y_{n-1}$, and $a'_1$. In this case, concealment processing that does not use predictive coefficient $a_1$ in an erased frame becomes possible.

$$y_n^{(j)}=((a'^{(j)}_1)^2-2a'^{(j)}_1+2)^{-1}((1-a'^{(j)}_1)x_{n+1}^{(j)}+y_{n-1}^{(j)}) \quad \text{(Equation 17)}$$

Thus, according to this embodiment, in addition to the provision of the features described in Embodiment 7, a plurality of predictive coefficient sets for performing concealment processing are provided and concealment processing is performed, enabling still higher concealment performance to be obtained than in Embodiment 7.

Embodiment 9

In above Embodiments 1 through 8, cases have been described in which n'th-frame decoding is performed after the (n+1)'th-frame is received, but the present invention is not limited to this, and it is also possible to perform n'th-frame generation using an (n−1)'th-frame decoded parameter, to perform n'th-frame parameter decoding using a method of the present invention at the time of (n+1)'th-frame decoding, and to perform (n+1)'th-frame decoding after updating the internal state of a predictor with that result.

In Embodiment 9, this case will be described. The configuration of a speech decoding apparatus according to Embodiment 9 is identical to that in FIG. 1. Also, the configuration of LPC decoding section 105 may be identical to that in FIG. 19, but is redrawn as shown in FIG. 24 to make it clear that (n+1)'th-frame decoding is performed on (n+1)'th-frame encoding information input.

Figure 24:
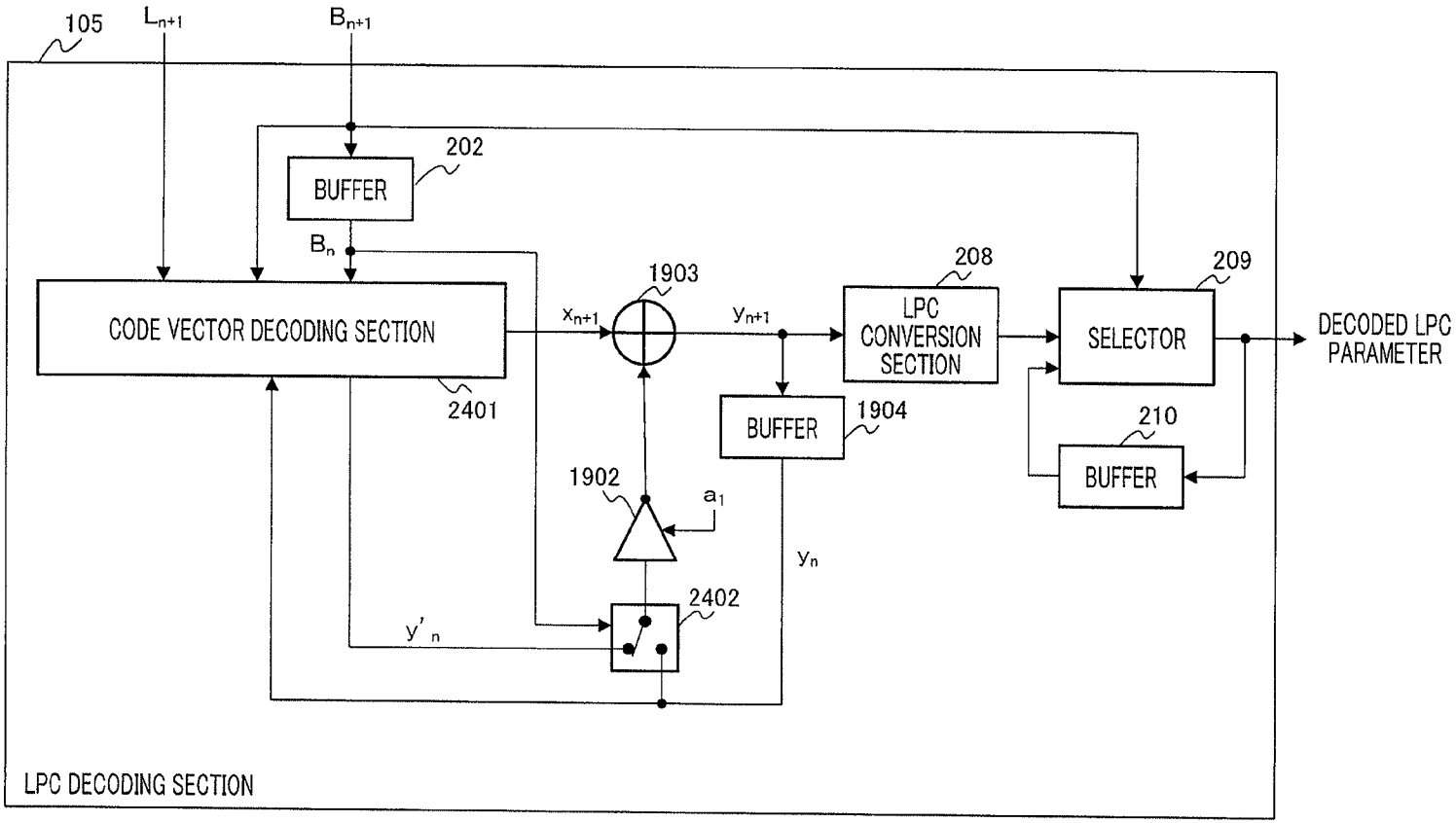
FIG. 24 is a drawing showing the internal configuration of an LPC decoding section of a speech decoding apparatus according to Embodiment 9 of the present invention.

FIG. 24 is a block diagram showing the internal configuration of LPC decoding section 105 of a speech decoding apparatus according to this embodiment. Configuration parts in FIG. 24 common to FIG. 19 are assigned the same reference codes as in FIG. 19, and detailed descriptions thereof are omitted here.

LPC decoding section 105 shown in FIG. 24 employs a configuration in which, in comparison with FIG. 19, buffer 201 has been eliminated, code vector decoding section output is $x_{n+1}$, a decoded parameter is that of the (n+1)'th-frame ($y_n$), and switch 2402 has been added. Also, the operation and internal configuration of code vector decoding section 2401 in FIG. 24 differ from those of code vector decoding section 1901 in FIG. 19.

LPC code $L_{n+1}$ is input to code vector decoding section 2401, and frame erasure code $B_{n+1}$ is input to buffer 202, code vector decoding section 2401, and selector 209.

Buffer 202 holds current-frame frame erasure code $B_{n+1}$ for the duration of one frame, and then outputs this frame erasure code to code vector decoding section 2401. As a result of being held in buffer 202 for the duration of one frame, the frame erasure code output from buffer 202 to code vector decoding section 2401 is preceding-frame frame erasure code $B_n$.

Code vector decoding section 2401 has decoded LSF vector $y_{n-1}$ of two frames before, current-frame LPC code $L_{n+1}$, and current-frame frame erasure code $B_{n+1}$, as input, generates current-frame quantized prediction residual vector $x_{n+1}$ and preceding-frame decoded LSF vector $y'_n$ based on these items of information, and outputs these to adder 1903 and switch 2402. Details of code vector decoding section 2401 will be given later herein.

Amplifier 1902 multiplies preceding-frame decoded LSF vector $y_{n-1}$ or $y'_n$ by predetermined AR predictive coefficient $a_1$, and outputs the result to adder 1903.

Adder 1903 calculates a predictive LSF vector output from amplifier 1902 (that is, the result of multiplying the preceding-frame decoded LSF vector by an AR predictive coefficient), and outputs the result of this calculation, decoded LSF vector $y_{n+1}$, to buffer 1904 and LPC conversion section 208.

Buffer 1904 holds current-frame decoded LSF vector $y_{n+1}$ for the duration of one frame, and then outputs this decoded LSF vector to code vector decoding section 2401 and switch 2402. As a result of being held in buffer 1904 for the duration of one frame, the decoded LSF vector input to code vector decoding section 2401 and switch 2402 is decoded LSF vector $y_n$ of one frame before.

Switch 2402 selects either preceding-frame decoded LSF vector $y_n$, or preceding-frame decoded LSF vector $y'_n$ generated by code vector decoding section 2401 using current-frame LPC code $L_{n+1}$ according to preceding-frame frame erasure code $B_n$. If $B_n$ indicates an erased frame, switch 2402 selects $y'_n$.

If selector 209 selects a decoded LPC parameter in the preceding frame output from buffer 210, it is not actually necessary to perform all the processing from code vector decoding section 2401 through LPC conversion section 208.

Figure 25:
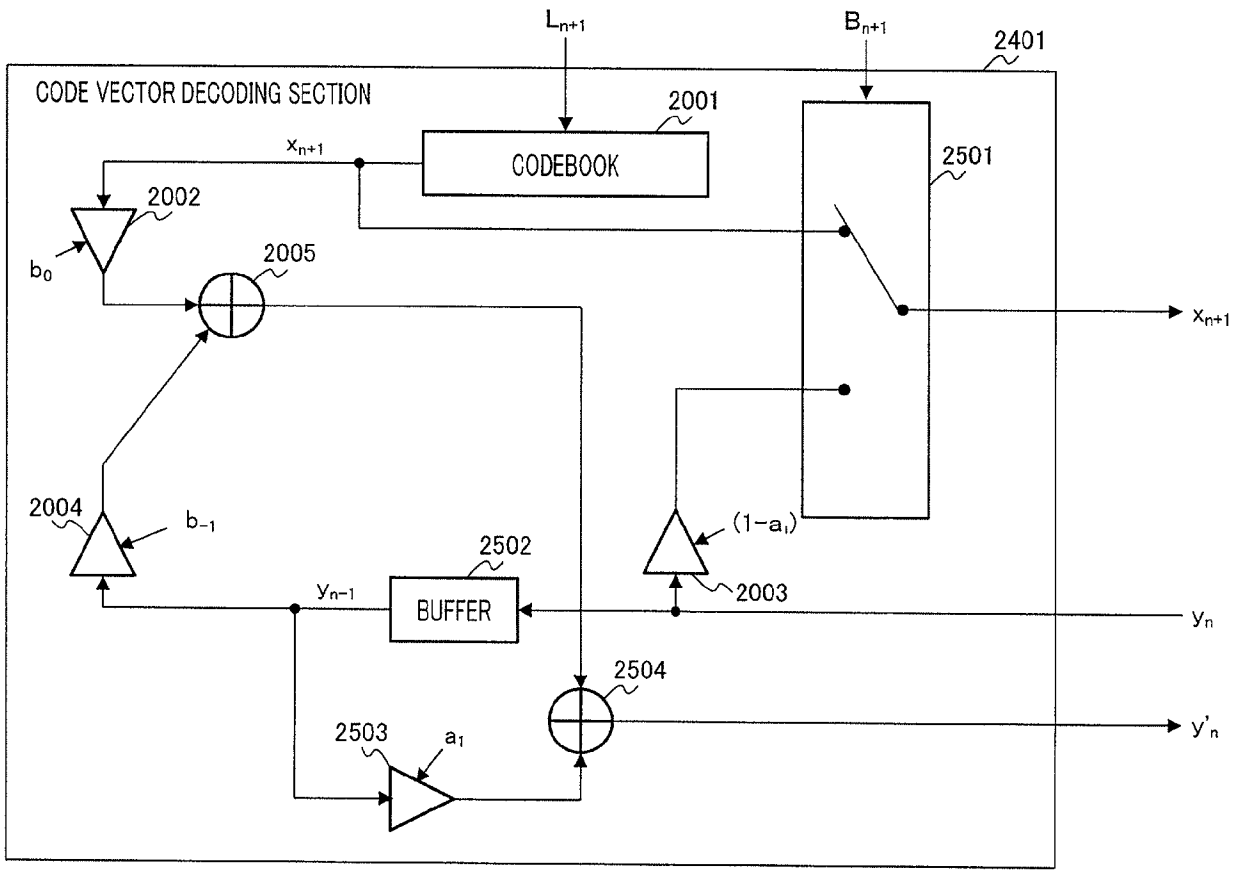
FIG. 25 is a drawing showing the internal configuration of the code vector decoding section in FIG. 24.

Next, the internal configuration of code vector decoding section 2401 in FIG. 24 will be described in detail using the block diagram in FIG. 25. Configuration parts in FIG. 25 common to FIG. 20 are assigned the same reference codes as in FIG. 20, and detailed descriptions thereof are omitted here. Code vector decoding section 2401 in FIG. 25 employs a configuration in which buffer 2502, amplifier 2503, and adder 2504 have been added to code vector decoding section 1901 in FIG. 20. Also, the operation and internal configuration of switch 2501 in FIG. 25 differ from those of switch 309 in FIG. 20.

Codebook 2001 generates a code vector identified by current-frame LPC code $L_{n+1}$, and outputs this to switch 2501 and also to amplifier 2002.

Amplifier 2003 performs processing to find a quantized prediction residual vector in the current frame necessary for a preceding-frame decoded LSF vector to be generated. That is to say, amplifier 2003 calculates current-frame vector $x_{n+1}$ so that preceding-frame decoded LSF vector $y_n$ becomes current-frame decoded LSF vector $y_{n+1}$. Specifically, amplifier 2003 multiplies input preceding-frame decoded LSF vector $y_n$ by coefficient $(1-a_1)$. Then amplifier 2003 outputs the result of this calculation to switch 2501.

If current-frame frame erasure code $B_{n+1}$ indicates that "the (n+1)'th-frame is a normal frame", switch 2501 selects a vector output from codebook 2001, and outputs this as current-frame quantized prediction residual vector $x_{n+1}$. On the other hand, if current-frame frame erasure code $B_{n+1}$ indicates that "the (n+1)'th-frame is an erased frame", switch 2501 selects a vector output from amplifier 2003, and outputs this as current-frame quantized prediction residual vector $x_{n+1}$. In this case, processing for the vector generation process from codebook 2001 and amplifiers 2002 and 2004 through adder 2005 need not be performed.

Buffer 2502 holds preceding-frame decoded LSF vector $y_n$ for the duration of one frame, and then outputs this decoded LSF vector to amplifier 2004 and amplifier 2503 as decoded LSF vector $y_{n-1}$ of two frames before.

Amplifier 2004 multiplies input decoded LSF vector $y_{n-1}$ of two frames before by weighting coefficient $b_{-1}$, and outputs the result to adder 2005.

Adder 2005 calculates the sum of the vectors output from amplifier 2002 and amplifier 2004, and outputs a code vector that is the result of this calculation to adder 2504. That is to say, adder 2005 calculates preceding-frame vector $x_n$ by performing weighted addition of a code vector identified by current-frame LPC code $L_{n+1}$ and the decoded LSF vector of two frames before, and outputs this to adder 2504.

Amplifier 2503 multiplies decoded LSF vector $y_{n-1}$ of two frames before by predictive coefficient $a_1$, and outputs the result to adder 2504.

Adder 2504 adds together adder 2005 output (preceding-frame decoded vector $x_n$ recalculated using current-frame LPC code $L_{n+1}$) and amplifier 2503 output (a vector resulting from multiplying decoded LSF vector $y_{n-1}$ of two frames before by predictive coefficient $a_1$), and recalculates preceding-frame decoded LSF vector $y'_n$.

The decoded LSF vector $y'_n$ recalculation method of this embodiment is the same as the concealment processing in Embodiment 7.

Thus, according to this embodiment, the use of a configuration whereby decoded vector $x_n$ obtained by means of the concealment processing of Embodiment 7 is used only for a predictor internal state in (n+1)'th-frame decoding enables the one-frame processing de lay necessary in Embodiment 7 to be reduced.

Embodiment 10

In above Embodiments 1 through 9, only features relating to the internal configuration and processing of the LPC decoding section are provided, but the configuration of a speech decoding apparatus according to this embodiment has a feature regarding the configuration outside the LPC decoding section. While the present invention can be applied to any of FIG. 1, FIG. 8, FIG. 11, or FIG. 21, in this embodiment a case is described by way of example in which the present invention is applied to FIG. 1.

Figure 26:
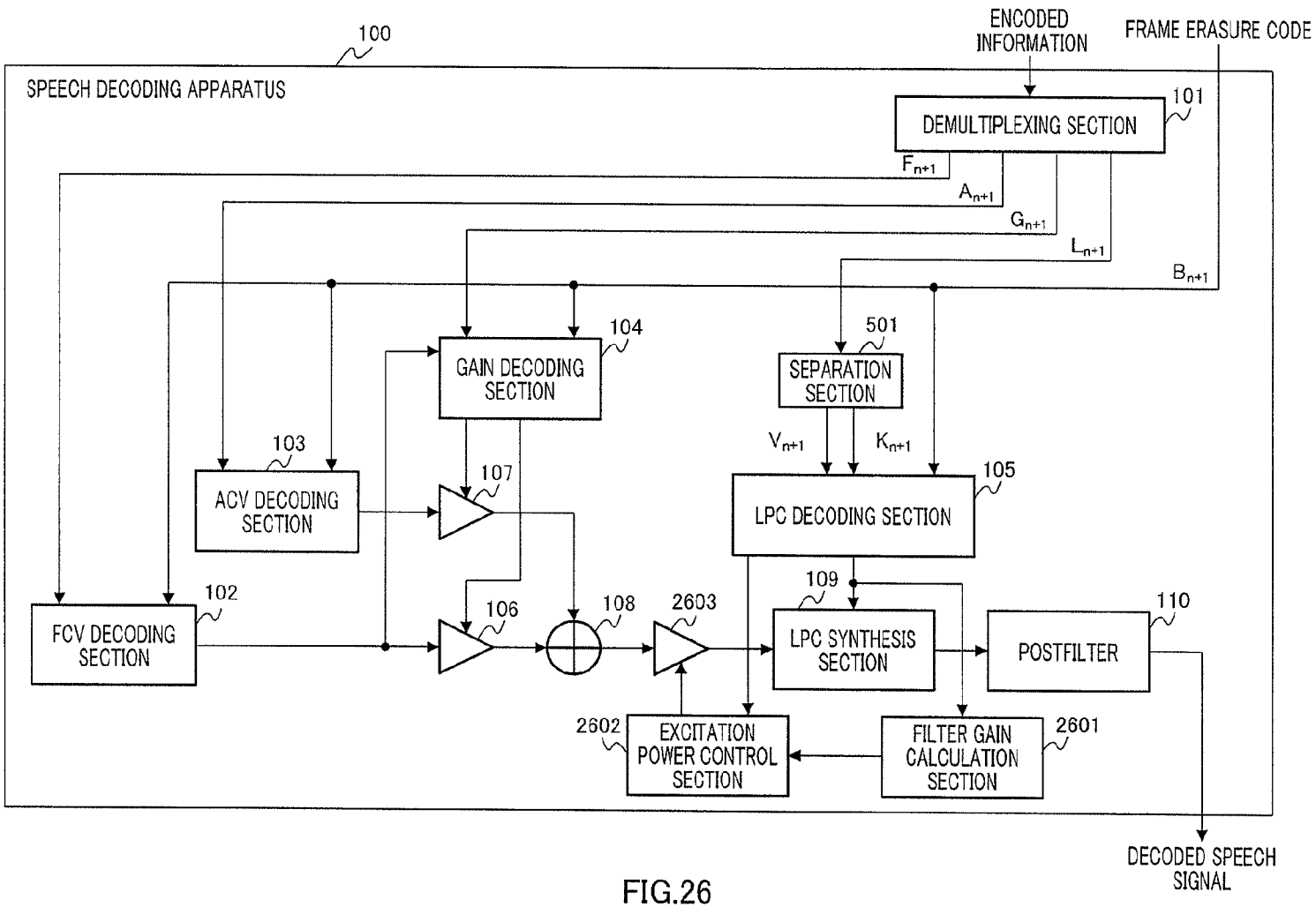
FIG. 26 is a block diagram showing the main configuration of a speech decoding apparatus according to Embodiment 10 of the present invention.

FIG. 26 is a block diagram showing a speech decoding apparatus according to this embodiment. Configuration parts in FIG. 26 common to FIG. 21 are assigned the same reference codes as in FIG. 21, and detailed descriptions thereof are omitted here. Speech decoding apparatus 100 shown in FIG. 26 employs a configuration in which, in comparison with FIG. 21, filter gain calculation section 2601, excitation power control section 2602, and amplifier 2603 have been added.

LPC decoding section 105 outputs a decoded LPC to LPC synthesis section 109 and filter gain calculation section 2601. Also, LPC decoding section 105 outputs frame erasure code $B_n$ corresponding to the n'th frame being decoded to excitation power control section 2602.

Filter gain calculation section 2601 calculates filter gain of a synthesis filter configured by means of an LPC input from LPC decoding section 105. As an example of a filter gain calculation method, there is a method whereby the square root of impulse response energy is found and taken as filter gain. This is based on the fact that, if an input signal is thought of as an impulse with energy of 1, the impulse response energy of a synthesis filter configured by means of an input LPC is filter gain information in itself. Another example of a filter gain calculation method is a one whereby, since the mean square of a linear prediction residue can be found from an LPC using a Levinson-Durbin algorithm, the inverse of this is used as filter gain information, and the square root of the inverse of the mean square of a linear prediction residue is taken as filter gain. The found filter gain is output to excitation power control section 2602. The mean square of impulse response energy or a linear prediction residue may also be output to excitation power control section 2602 without finding the square root.

Excitation power control section 2602 has filter gain from filter gain calculation section 2601 as input, and calculates a scaling factor for excitation signal amplitude adjustment. Excitation power control section 2602 is provided with internal memory, and holds filter gain of one frame before in this memory. After a scaling factor has been calculated, the memory contents are rewritten with the input current-frame filter gain. Calculation of scaling factor $SG_n$ is performed by means of the equation $SG_n=DG_{max}\times FG_{n-1}/FG_n$, where $FG_n$ is current-frame filter gain, is preceding-frame filter gain, and $DG_{max}$ is the upper limit of the gain increase rate. Here, the gain increase rate is defined as $FG_n/FG_{n-1}$, and indicates what multiple of the preceding-frame filter gain the current-frame filter gain is. The upper-limit of the gain increase rate is decided beforehand as $DG_{max}$. If filter gain rises sharply relative to the filter gain of the preceding frame in a synthesis filter created by means of frame erasure concealment processing, synthesis filter output signal energy will also rise sharply, and a decoded signal (synthesized signal) will have large amplitude locally, producing an explosive sound. To avoid this, if filter gain of a synthesis filter configured by means of a decoded LPC generated by frame erasure concealment processing exceeds a predetermined gain increase rate relative to preceding-frame filter gain, the power of the decoded excitation signal that is the synthesis filter drive signal is decreased. The coefficient for this purpose is the scaling factor, and the predetermined gain increase rate is gain increase rate upper limit $DG_{max}$. Normally, the occurrence of an explosive sound can be prevented by setting $DG_{max}$ to a value of 1, or a value less than 1 such as 0.98. If $FG_n/FG_{n-1}$ is less than or equal to $DG_{max}$, $SG_n$ is taken to be 1.0 and scaling need not be performed in amplifier 2603.

Another method of calculating scaling factor $SG_n$ is to use the equation $SG_n=\mathrm{Max}(SG_{max}, FG_{n-1}/FG_n)$, for example. Here, $SG_{max}$ represents the maximum value of the scaling factor, and has a value somewhat greater than 1, such as 1.5, for example, and Max(A,B) is a function that outputs A or B, whichever is greater. If $SG_n=FG_{n-1}/FG_n$, excitation signal power decreases in proportion as filter gain increases, and current-frame decoded synthesized signal energy becomes the same as preceding-frame decoded synthesized signal energy. By this means, an above-described sharp rise in synthesized signal energy can be avoided, and abrupt attenuation of synthesized signal energy can also be avoided. In such a case, if $SG_n=FG_{n-1}/FG_n$, $SG_n$ has a value of 1 or above, and plays a role in preventing local attenuation of synthesized signal energy. However, since an excitation signal generated by frame erasure concealment processing is not necessarily suitable as an excitation signal, making the scaling factor too large may result in marked distortion and quality degradation. Consequently, if an upper limit is provided for the scaling factor and $FG_{n-1}/FG_n$ exceeds that upper limit, $FG_{n-1}/FG_n$ is clipped to the upper limit.

Filter gain of one frame before or a parameter representing filter gain (such as synthesis filter impulse response energy) may be input from outside excitation power control section 2602 rather than being held in memory inside excitation power control section 2602. In particular, if information relating to filter gain of one frame before is used by a part other than a speech decoder, provision is made for an above-described parameter to be input from outside, and not to be rewritten inside excitation power control section 2602.

Then excitation power control section 2602 has frame erasure code $B_n$ as input from LPC decoding section 105, and if $B_n$ indicates that the current frame is an erased frame, outputs a calculated scaling factor to amplifier 2603. On the other hand, if $B_n$ indicates that the current frame is not an erased frame, excitation power control section 2602 outputs "1" to amplifier 2603 as a scaling factor.

Amplifier 2603 multiplies the scaling factor input from excitation power control section 2602 by a decoded excitation signal input from adder 108, and outputs the result to LPC synthesis section 109.

Thus, according to this embodiment, if filter gain of a synthesis filter configured by means of a decoded LPC generated by frame erasure concealment processing changes relative to preceding-frame filter gain, the occurrence of an explosive sound or loss of sound can be prevented by adjusting the power of a decoded speech signal that is the synthesis filter driving signal.

Even if $B_n$ indicates that the current frame is an erased frame, excitation power control section 2602 may output a calculated scaling factor to amplifier 2603 if the immediately preceding frame is an erased frame (that is, if $B_{n-1}$ indicates that the preceding frame is an erased frame). This is because, when predictive encoding is used, there may be residual influence of an error on a frame reconstructed from a frame erasure. In this case, also, the same kind of effects as described above can be obtained.

This concludes a description of embodiments of the present invention.

In the above embodiments, an encoding parameter has been assumed to be an LSF parameter, but the present invention is not limited to this, and can be applied to any kind of parameter as long as it is a parameter with moderate fluctuation between frames. For example, immittance spectrum frequencies (ISFs) may be used.

In the above embodiments, an encoding parameter has been assumed to be an LSF parameter itself, but a post-average-elimination LSF parameter, resulting from extraction of a difference from an average LSF, may also be used.

In addition to being applied to a speech decoding apparatus and speech encoding apparatus, it is also possible for a parameter decoding apparatus and parameter encoding apparatus according to the present invention to be installed in a communication terminal apparatus and base station apparatus in a mobile communication system, by which means a communication terminal apparatus, base station apparatus, and mobile communication system that have the same kind of operational effects as described above can be provided.

A case has here been described by way of example in which the present invention is configured as hardware, but it is also possible for the present invention to be implemented by software. For example, the same kind of functions as those of a parameter decoding apparatus according to the present invention can be realized by writing an algorithm of a parameter decoding method according to the present invention in a programming language, storing this program in memory, and having it executed by an information processing means.

The function blocks used in the descriptions of the above embodiments are typically implemented as LSIs, which are integrated circuits. These may be implemented individually as single chips, or a single chip may incorporate some or all of them.

Here, the term LSI has been used, but the terms IC, system LSI, super LSI, ultra LSI, and so forth may also be used according to differences in the degree of integration.

The method of implementing integrated circuitry is not limited to LSI, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

In the event of the introduction of an integrated circuit implementation technology whereby LSI is replaced by a different technology as an advance in, or derivation from, semiconductor technology, integration of the function blocks may of course be performed using that technology. The application of biotechnology or the like is also a possibility.

The disclosures of Japanese Patent Application No. 2006-305861, filed on Nov. 10, 2006, Japanese Patent Application No. 2007-132195, filed on May 17, 2007, and Japanese Patent Application No. 2007-240198, filed on Sep. 14, 2007, including the specifications, drawings and abstracts, are incorporated herein by reference in their entirety.

INDUSTRIAL APPLICABILITY

A parameter decoding apparatus, parameter encoding apparatus, and parameter decoding method according to the present invention are suitable for use in a speech decoding apparatus and speech encoding apparatus, and furthermore, in a communication terminal apparatus, base station apparatus, and the like, in a mobile communication system.

The invention claimed is:

1. A parameter decoding apparatus comprising:

a prediction residue decoder that finds a quantized prediction residue based on encoded information included in a current frame subject to decoding, an auto-regressive predictor that produces a predicted parameter by multiplying a predictive coefficient with a past decoded parameter; and an adder that decodes a parameter by adding said quantized prediction residue and said predicted parameter, wherein said prediction residue decoder, when said current frame is erased, finds a current-frame quantized prediction residue from a weighted linear sum of a parameter decoded in the past and a future-frame quantized prediction residue.

2. A parameter decoding apparatus according to claim 1, wherein said prediction residue decoder, when said current frame is erased, finds a current-frame quantized prediction residue using the following equation;

$$x[n]=b0x[n+1]+b1y[n-1]$$

where;

b0={b0(i)}, i=0, . . . , M−1, b0(i)=(1−a[0](i))([a[0](i)]^2−2a[0](i)+2)^(−1), b1={b1(i)}, i=0, . . . , M−1, and b1(i)=([a[0](i)]^2−2a[0](i)+2)^(−1)−a[−1](i), where;

a[0](i) is the i-th component of predictive coefficient set of the next frame, a[−1](i) is the i-th component of predictive coefficient set of the current frame, x[n](i) is quantized prediction residue of the i-th component of ISF parameter in the current frame, x[n+1](i) is quantized prediction residue of the i-th component of ISF parameter in the next frame, and y[n−1](i) is the i-th component of decoded ISF parameter in the previous frame.

3. A parameter decoding method comprising:

finding a quantized prediction residue based on encoding information included in a current frame subject to decoding;

producing a predicted parameter by multiplying a predictive coefficient with a past decoded parameter; and decoding a parameter by adding said quantized prediction residue and said predicted parameter, wherein, in the finding, when said current frame is erased, a current-frame quantized prediction residue is found from a weighted linear sum of a parameter decoded in the past and a future-frame quantized prediction residue.

4. A parameter decoding method according to claim 3, wherein in the finding, when said current frame is erased, a current-frame quantized prediction residue is found from the following equation;

$$x[n]=b0x[n+1]+b1y[n-1]$$

where;

b0={b0(i)}, i=0, . . . , M−1, b0(i)=(1−a[0](i))([a[0](i)]^2−2a[0](i)+2)^(−1), b1={b1(i)}, i=0, . . . , M−1, and b1(i)=([a[0](i)]^2−2a[0](i)+2)^(−1)−a[−1](i), where;

a[0](i) is the i-th component of predictive coefficient set of the next frame, a[−1](i) is the i-th component of predictive coefficient set of the current frame, x[n](i) is quantized prediction residue of the i-th component of ISF parameter in the current frame, x[n+1](i) is quantized prediction residue of the i-th component of ISF parameter in the next frame, and y[n−1](i) is the i-th component of decoded ISF parameter in the previous frame.

* * * * *

UNITED STATES PATENT AND TRADEMARK OFFICE

CERTIFICATE OF CORRECTION

PATENT NO. : 8,538,765 B1
APPLICATION NO. : 13/896397
DATED : September 17, 2013
INVENTOR(S) : H. Ehara It is certified that error appears in the above-identified patent and that said Letters Patent is hereby corrected as shown below:

On the Title Page, item (71), Applicant's city of residency of the printed patent "Kadoma (JP)" should be --Osaka (JP)--.

On Title Page 2, second column, Other Publications (last reference), of the printed patent, "3GPP TS 26.091, V5.0.0, Jun. 2002, Technical Specification, "3rd Generation Partnership Project; Techical Specification Group Services and System Aspects; Mandatory Speech Codec speech processing functions; Adaptive Multi-Rate (AMR) speech codec; Error concealment of lose frames (Release 5)," pp. 8-9." should be --3GPP TS 26.091, V5.0.0, Jun. 2002, Technical Specification, "3rd Generation Partnership Project; Technical Specification Group Services and System Aspects; Mandatory Speech Codec speech processing functions; Adaptive Multi-Rate (AMR) speech codec; Error concealment of lose frames (Release 5)," pp. 8-9.--.

Signed and Sealed this
Tenth Day of December, 2013

Margaret A. Focarino

Margaret A. Focarino
*Commissioner for Patents of the United States Patent and Trademark Office*